US007601477B2

(12) United States Patent
Komatsu et al.

(10) Patent No.: US 7,601,477 B2
(45) Date of Patent: Oct. 13, 2009

(54) TONER MANUFACTURING METHOD, TONER MANUFACTURING APPARATUS, AND TONER

(75) Inventors: Harunobu Komatsu, Matsumoto (JP); Keiichi Inoue, Suwa (JP); Takashi Teshima, Shiojiri (JP); Ken Ikuma, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 12/176,567

(22) Filed: Jul. 21, 2008

(65) Prior Publication Data

US 2008/0279734 A1 Nov. 13, 2008

Related U.S. Application Data

(62) Division of application No. 11/280,631, filed on Nov. 16, 2005, now Pat. No. 7,416,829.

(30) Foreign Application Priority Data

Nov. 30, 2004 (JP) ..... 2004-345453

(51) Int. Cl.
*G03G 9/087* (2006.01)

(52) U.S. Cl. ..... 430/137.1

(58) Field of Classification Search ..... 430/137.1
See application file for complete search history.

(56) References Cited

FOREIGN PATENT DOCUMENTS

| | | | |
|---|---|---|---|
| JP | 2003-066649 | | 3/2003 |
| JP | 2003262976 | * | 9/2003 |
| JP | 2003262977 | * | 9/2003 |
| JP | 2004-070303 | | 3/2004 |
| JP | 2004070303 | * | 3/2004 |

OTHER PUBLICATIONS

Abstract of JP 2003262976, Sep. 2003.*
Abstract of JP 2003262977, Sep. 2003.*
Abstract of JP 2004070303, Mar. 2004.*

* cited by examiner

*Primary Examiner*—Hoa V Le
(74) *Attorney, Agent, or Firm*—Harness, Dickey & Pierce, P.L.C.

(57) ABSTRACT

A method of manufacturing a toner by using a liquid dispersion in which a dispersoid containing a material for manufacturing a toner is dispersed in a dispersion medium, and containing a dispersant having a function of improving the dispersibility of the dispersoid, the method including the steps of: preparing the liquid dispersion, applying ozone to the liquid dispersion and/or a liquid dispersion from which at least a portion of the dispersion medium has been removed, and irradiating UV-rays to the liquid dispersion and/or the liquid dispersion from which at least a portion of the dispersion medium has been removed.

2 Claims, 8 Drawing Sheets

TONER MANUFACTURING METHOD, TONER MANUFACTURING APPARATUS, AND TONER

CROSS-REFERENCE TO RELATED APPLICATIONS

This is a divisional application of U.S. Ser. No. 11/280,631 filed Nov. 16, 2005, claiming priority to Japanese Patent Application No. 2004-345453 filed Nov. 30, 2004, all of which are hereby expressly incorporated by reference.

BACKGROUND OF THE INVENTION

1. Field of the Invention

The present invention concerns a toner manufacturing method, a toner manufacturing apparatus, and a toner.

2. Related Art

Various methods are known for performing electrophotography, and they generally include a step of forming electric latent images on a light sensitive body by various mechanisms while utilizing photoconductive material (an exposure step), a developing step of developing the latent images by using a toner (a fine resin particle), a transfer step of transferring toner images onto a transfer material such as paper and a step of fixing the toner images by heating, pressing, or the like using a fixing roller.

As the method of manufacturing the toner used in electrophotography, a pulverization method and a polymerization method are typically used.

The pulverization method is a method of kneading a material containing a resin as a main ingredient (hereinafter simply referred to also as a "resin") and a colorant at a temperature higher than the softening point of the resin to obtain a kneaded product and then cooling and pulverizing the kneaded product. The pulverization method is excellent in that the material can be selected from a wide range and a toner can be manufactured relatively easily. However, the toner obtained by the pulverization method has a drawback in that the shape varies greatly between each of the particles and the grain size distribution thereof tends to be broad. As a result, the charging property, the fixing property, and the like vary greatly between each of the toner particles which lowers the reliability for the entire toner.

The polymerization method manufactures toner particles by using a monomer as a constituent ingredient for the resin, and conducting a polymerizing reaction, for example, in a liquid phase thereby forming an aimed resin. In the polymerization method, the polymerizing reaction is usually conducted in a liquid phase containing a dispersant with the aim of improving the dispersibility of a dispersoid (dispersoid to form toner particles), obtaining mono-dispersion, controlling the molecular weight distribution, and the like. The polymerization method is excellent in that the obtained toner particle can be made to a shape of a relatively high sphericalness (a shape approximate to a geometrical complete spherical shape). However, in the existent polymerization method, it is difficult to obtain a toner having an excellent charging property in the finally obtained toner. That is, the existent polymerization method has a problem in that it is difficult to obtain a sufficiently large absolute value for the charged amount of the toner particle and the charging property (charged amount) between each of the toner particles tends to vary greatly in the finally obtained toner.

In recent years a method of manufacturing toner particles by discharging a liquid dispersion containing a material for manufacturing a toner using a so-called ink jet method (for example, refer to JP-A No. 2004-70303) has been proposed. In the method described above, a liquid dispersion with the addition of a dispersant is used with an aim of making the content of the dispersoid uniform in the discharged liquid droplet or enabling the liquid dispersion to be discharged. That is, in a case of using a liquid dispersion not containing the dispersant, a toner of uniform shape and size can not be obtained and, further, discharge of the liquid dispersion is impossible. In a case of adopting such an ink jet method, while variation of the shape and the size between each of the particles can be relatively decreased, it is also difficult to obtain a toner having an excellent charging property like in the polymerization method described above.

As described above, in a case of adopting a method of using the liquid dispersion, while variation of the shape between each of the particles (toner particles) can be decreased, it is difficult to obtain a toner having an excellent charging property. In addition, in a case of adopting the method of using the liquid dispersion, the obtained toner is poor in circumstantial properties (e.g., water proofness and storability) and caused agglomeration between the toner particles when stored in a cartridge (particularly, stored at a high humidity condition), which results in undissolved clumps (so-called DAMA).

The present inventors have made an earnest study with an aim of solving such problems. As a result, the present inventors have found that the dispersant contained in the liquid dispersion gives undesired effects on the charging property of the toner when it remains in the toner and, further, have found that the dispersant can be selectively removed by the combined use of ozone and UV-rays and, as a result, a toner having an excellent property can be obtained.

SUMMARY

An advantage of the invention is to provide a toner having an excellent charging property, having a uniform shape and with a narrow range of grain size distribution, as well as a manufacturing method of a toner and a toner manufacturing apparatus capable of efficiently manufacturing such a toner. Particularly, it intends to provide a toner having an excellent charging property, having a uniform shape and with a narrow range of grain size distribution by a method minimally impacting the environment.

In accordance with an aspect of the invention, there is provided a method of manufacturing a toner by using a liquid dispersion in which a dispersoid containing a material for manufacturing a toner is dispersed in a dispersion medium, and containing a dispersant having a function of improving the dispersibility of the dispersoid, the method including the steps of:

preparing the liquid dispersion, applying ozone to the liquid dispersion and/or a liquid dispersion from which at least a portion of the dispersion medium has been removed, and irradiating UV-rays to the liquid dispersion and/or the liquid dispersion from which at least a portion of the dispersion medium has been removed.

This can provide a method of efficiently manufacturing a toner having an excellent charging property, having a uniform shape and with a narrow range of grain size distribution (with good productivity). Particularly, this can provide a manufacturing method capable of manufacturing a toner having an excellent charging property, having a uniform shape and with a narrow range of grain size distribution by a method mild to environments.

In a preferred embodiment of a toner manufacturing method according to the invention, at least a portion of the step of applying ozone is conducted simultaneously with the step of irradiating the UV-rays.

This can efficiently decompose the dispersant while sufficiently preventing degradative decomposition of the constituent materials for the toner (ingredients to be contained in the toner).

In a further preferred embodiment of the toner manufacturing method of the invention, the step of applying ozone and/or the step of applying UV-rays are conducted during the step of removing the dispersion medium from the liquid dispersion and/or after the step of removing the dispersion medium.

This can efficiently decompose the dispersant while sufficiently preventing degradative decomposition of the constituent materials for the toner (ingredients to be contained in the toner).

In a further preferred embodiment of the toner manufacturing method of the invention, the step of applying the ozone and/or the step of irradiating the UV-rays are conducted after discharging the liquid dispersion as a discharged product in a droplet form.

This can efficiently decompose the dispersant while sufficiently preventing degradative decomposition of the constituent materials for the toner (ingredients to be contained in the toner).

In a further preferred embodiment of the toner manufacturing method of the invention, the discharged product contains a plurality of dispersoids.

Thus, a toner with particularly less variation of the shape and the size between each of the particles (toner particles) can be obtained.

In a further preferred embodiment of the toner manufacturing method of the invention, the ozone is applied in a step of joining a plurality of the dispersoids constituting the discharged product after the step of removing the dispersion medium from the liquid dispersion.

This can decompose the dispersant efficiently with a relatively small amount of ozone.

In a further preferred embodiment of the toner manufacturing method of the invention, the discharged product is exposed to an atmosphere containing the ozone.

This can reliably apply ozone in a homogeneous state to each of discharged products (liquid dispersion or agglomerate in which the dispersion medium has been removed from the liquid dispersion). As a result, the finally obtained toner varies less in view of the property between each of the particles (toner particles) to improve the reliability for the entire toner.

In a further preferred embodiment of the toner manufacturing method of the invention, the UV-rays are irradiated in the step of joining the plurality of dispersoids constituting the discharged product after the step of removing the dispersion medium from the liquid dispersion.

This can efficiently decompose the dispersant even in a case where the irradiation time of UV-rays is relatively short or in a case where the irradiation intensity of the UV-rays is relatively weak.

In a further preferred embodiment of the toner manufacturing method of the invention, the liquid dispersion is intermittently discharged by piezoelectric pulses.

Thus, a toner with particularly less variation of the shape and the size between each of the particles (toner particles) can be obtained.

In a further preferred embodiment of the toner manufacturing method of the invention, the liquid dispersion contains an anionic dispersant and/or nonionic dispersant as the dispersant.

This can reliably render the charging property of the finally obtained toner excellent even when the conditions for treatment using ozone and UV-rays are relatively mild.

In a further preferred embodiment of the toner manufacturing method of the invention, the content of the dispersant in the liquid dispersion is from 0.001 to 10 wt %.

This can render the charging property of the toner particularly excellent while particularly decreasing variation of the shape and the size between each of the particles (toner particles). Further, the productivity can be made particularly high.

In a further preferred embodiment of the toner manufacturing method of the invention, the dispersion medium mainly comprises water and/or a liquid having excellent compatibility with water.

This can manufacture the toner by a method more mild to environments. Further, this can improve, for example, the dispersibility of the dispersoid in the dispersion medium to render the dispersoid in the liquid dispersion to have a relatively small grain size and to be particularly decreased in view of the variation of the size. As a result, a toner with particularly decreased variation of the shape and of the size between each of the particles (toner particles) can be manufactured efficiently.

In a further preferred embodiment of the toner manufacturing method of the invention, the liquid dispersion contains a charge controller.

This can render the charging property of the toner particularly excellent.

In another aspect of the invention, there is provided a toner manufacturing apparatus to be used for the manufacturing method according to the invention.

This can provide a toner manufacturing apparatus capable of efficiently manufacturing toner particles having an excellent charging property, having a uniform shape and with a narrow range of grain size distribution (with good productivity). Particularly, this can provide a manufacturing apparatus capable of manufacturing a toner having an excellent charging property, having a uniform shape and with a narrow range of grain size distribution by a method mild to environments.

In a further aspect of the invention, there is provided a toner manufacturing apparatus for manufacturing a toner by using a liquid dispersion in which a dispersoid containing a material for manufacturing a toner is dispersed in a dispersion medium and containing a dispersant having a function of improving the dispersibility of the dispersoid, wherein the apparatus includes:

- a device for applying ozone to at least one of a liquid dispersion or a liquid dispersion from which at least a portion of the dispersion medium has been removed, and
- a device for irradiating UV-rays to at least one of the liquid dispersion or the liquid dispersion from which at least a portion of the dispersion medium has been removed.

This can provide a toner manufacturing apparatus capable of efficiently manufacturing toner particles having an excellent charging property, having a uniform shape and with a narrow range of grain size distribution (with good productivity). Particularly, this can provide a manufacturing apparatus capable of manufacturing a toner having an excellent charging property, having a uniform shape and with a narrow range of grain size distribution by a method mild to environments.

In a preferred embodiment according to the further aspect of the invention, the toner manufacturing apparatus includes a discharge portion for discharging the liquid dispersion as a discharged product in a droplet form, and is adapted to apply the ozone or irradiate the UV-rays to the discharged product.

This can extend the time of contact between the discharged product (liquid dispersion, or agglomerate in which a dispersion medium has been removed from the liquid dispersion) and ozone, and efficiently irradiate the UV-rays to the dispersant contained in the discharged product and can utilize the ozone and the energy of the UV-rays efficiently for the removal of the dispersant. Further, this can effectively prevent the degradative decomposition of the constituent materials for the toner (ingredients to be contained in the toner) by the ozone or the UV-rays and, as a result, obtain a toner of higher reliability.

According to a further aspect of the invention there is provided a toner manufactured by using the method of the invention.

This can provide a toner having an excellent charging property, having a uniform shape and with a narrow range of grain size distribution.

In a further aspect of the invention, there is provided a toner manufactured by using the apparatus of the invention.

This can provide a toner having an excellent charging property, having a uniform shape and with a narrow range of the grain size distribution.

BRIEF DESCRIPTION OF THE DRAWINGS

The invention will be described with reference to the accompanying drawings, wherein like numbers reference like elements, and wherein.

DESCRIPTION OF THE EMBODIMENTS

Preferred embodiments of a toner manufacturing method, a toner manufacturing apparatus and a toner of the invention will be described specifically with reference to the attached drawings.

First Embodiment

Figure 1:
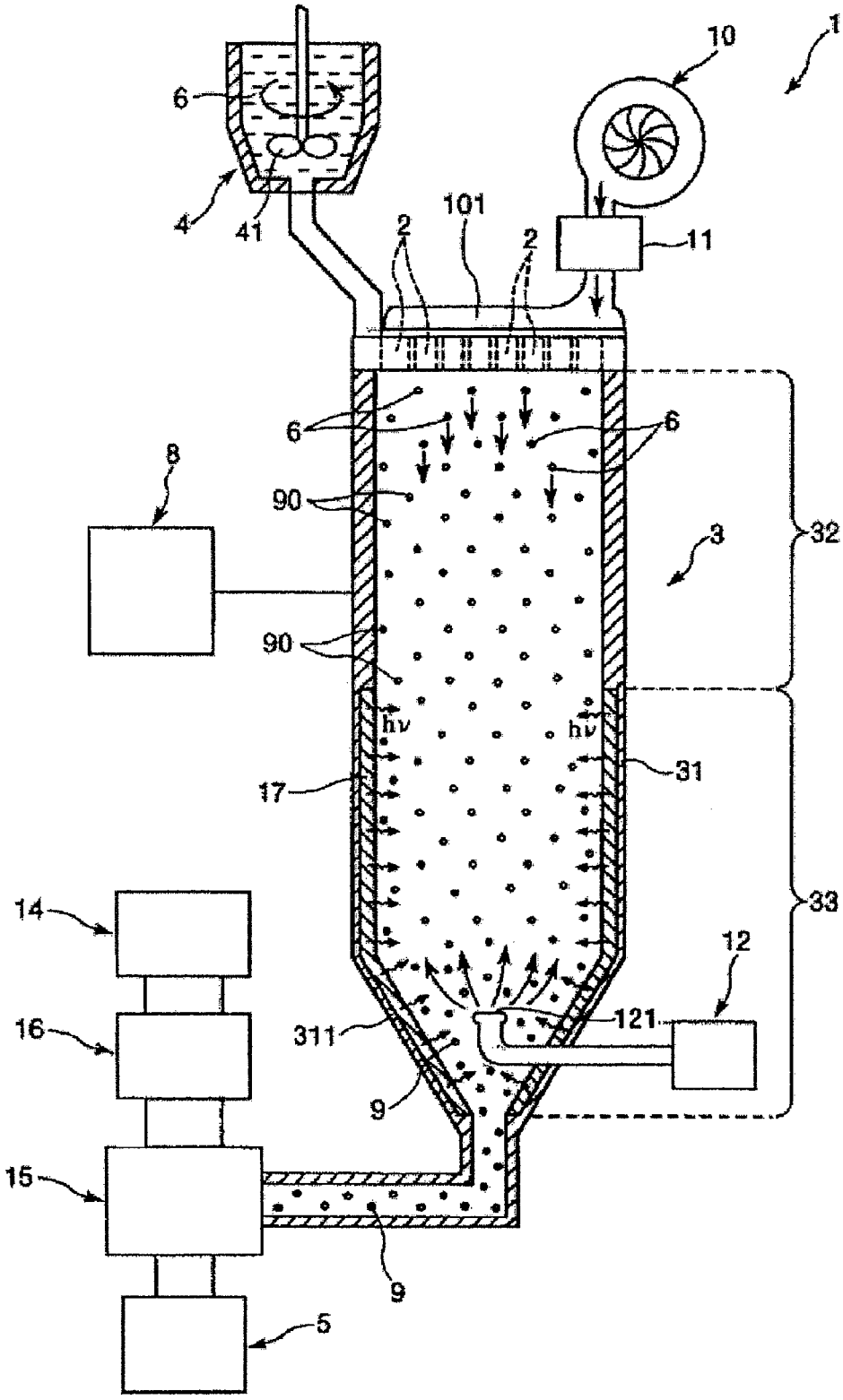
FIG. 1 is a vertical cross sectional view schematically showing a first embodiment of a toner manufacturing apparatus used for the manufacture of a toner according to the invention.
Figure 2:
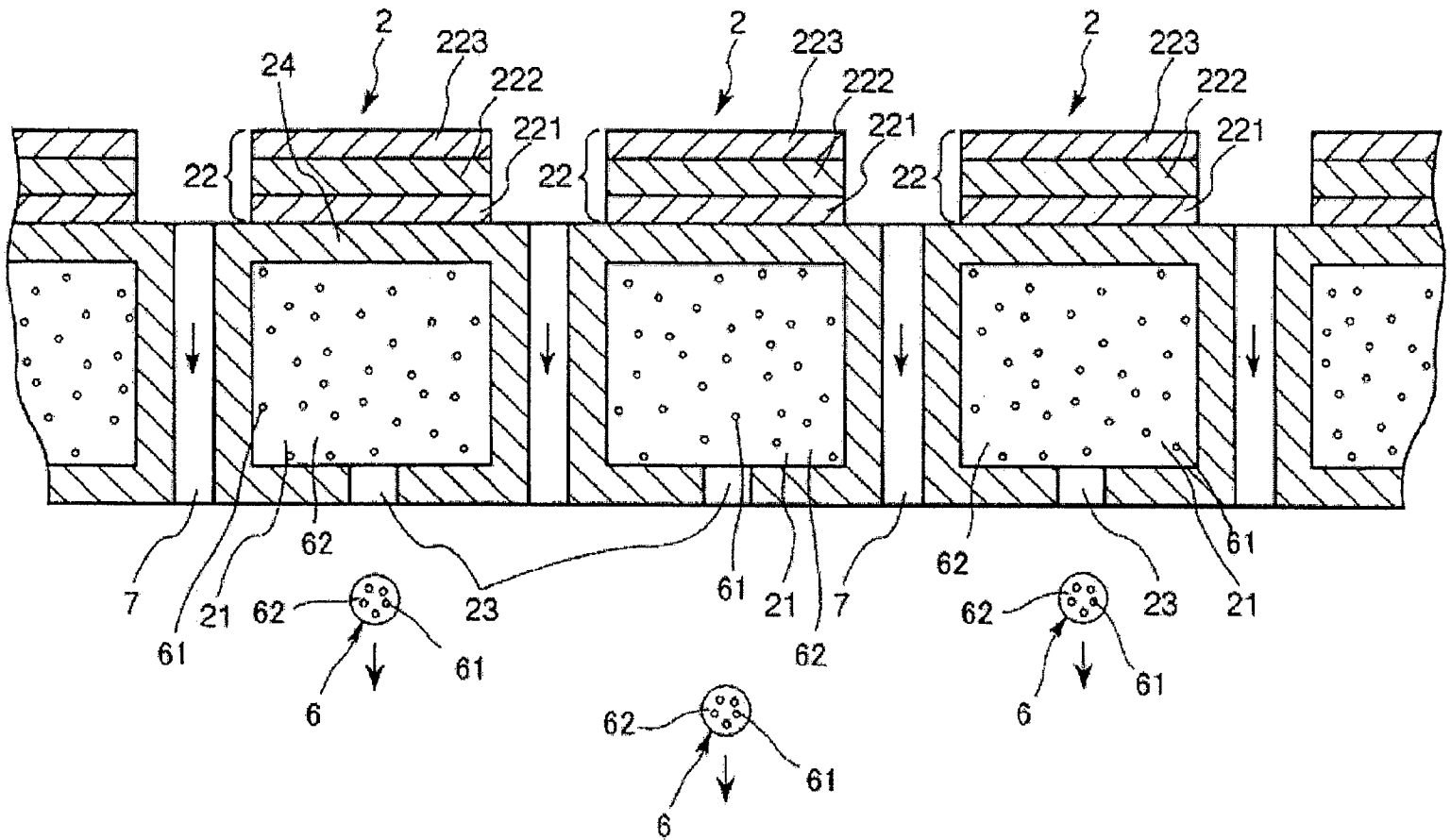
FIG. 2 is an enlarged cross sectional view near the head of the toner manufacturing apparatus shown in FIG. 1.

FIG. 1 is a vertical cross sectional view schematically showing a first embodiment of a toner manufacturing apparatus used for the manufacture of a toner according to the invention and FIG. 2 is an enlarged cross sectional view near a head of the toner manufacturing apparatus shown in FIG. 1

Liquid Dispersion

At first, the liquid dispersion used in the invention is to be described. The toner according to the first embodiment of the invention is manufactured by using a liquid dispersion containing a dispersant. The liquid dispersion includes, for example, a liquid suspension or emulsion (emulsion, emulsified liquid suspension, emulsified liquid). In the specification, "liquid suspension" means a liquid dispersion (including suspended colloid) in which solid dispersoids (suspended particles) are dispersed in a liquid dispersion medium and "emulsion" (emulsion, emulsified liquid suspension, emulsified liquid) means a liquid dispersion in which liquid dispersoids (dispersed particles) are dispersed in a liquid dispersion medium. Further, a solid dispersoid and a liquid dispersoid may be present together in the liquid dispersion. In this case, a liquid dispersion in which the ratio of the solid dispersoid is more than the ratio of the liquid dispersoid is referred to as a liquid suspension, and a liquid dispersion in which the ratio of the liquid dispersoid is more than the ratio of the solid dispersoid is referred to as a liquid emulsion. Further, the liquid dispersion used in the invention is preferably applied with a deaeration treatment. The deaeration treatment is to be described specifically later.

The liquid dispersion 6 has a constitution in which a dispersoid (dispersion phase) 61 is finely dispersed in a dispersion medium 62. Then, the liquid dispersion 6 contains a dispersant having a function of improving the dispersibility of the dispersoid 61.

Dispersion Medium

Any dispersion medium 62 may be used so long as it can disperse the dispersoid 61 to be described later and, a dispersion medium preferably comprises a material generally used as a solvent (hereinafter referred to also as "solvent material").

The material includes, for example, inorganic solvent such as water, carbon disulfide, and carbon tetrachloride, organic solvents, for example, ketones solvents such as methyl ethyl ketone (MEK), acetone, diethyl ketone, methyl isobutyl ketone (MIBK), methyl isopropyl ketone (MIPK), cyclohexanone, 3-heptanone, and 4-heptanone, alcohol solvents such as methanol, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, and phenol, ether solvents such as diethyl ether, dipropyl ether, diisopropyl ether, dibutyl ether, 1,2-methoxyethane (DME), 1,4-dioxane, tetrahydrofuran (THF), tetrahydropyran (THP), anisole, diethylene glycol dimethyl ether (diglyme), and 2-methoxyethanol, cellosolve solvents such as methyl cellosolve, ethyl cellosolve, and phenyl cellosolve, aliphatic hydrocarbon solvents such as hexane, pentane, heptane, cyclohexane, methyl cyclohexane, octane, didecane, methylcyclohexene, and isoprene, aromatic hydrocarbon solvents such as toluene, xylene, benzene, ethylbenzene, and naphthalene, aromatic heterocyclic compound solvents such as pyridine, pyrazine, furan, pyrrole, thiophene, 2-methyl pyridine, 3-methylpyridine, 4-methylpyridine, and furfuryl alcohol, amide solvents such as N,N-dimethylformamide(DMF), and N,N-dimethylacetoamide (DMA), halogenated compound solvents such as dichloromethane, chloroform, 1,2-dichloroethane, trichloroethylene, and chlorobenzene, ester solvents such as acetylacetone, ethyl acetate, methyl acetate, isopropyl acetate, isobutyl acetate, isopentyl acetate, ethyl chloroaceate, butyl chloroacetate, isobutyl chloroacetate, ethyl formate, isobutyl formate, ethyl acrylate, methyl methacrylate, and ethyl benzoate, amine solvents such as trimethyl amine, hexyl amine, triethyl amine, and aniline, nitrile solvents such as acrylonitrile and acetonitrile, nitro solvents such as nitromethane and nitroethane, aldehyde solvents such as acetoaldehyde, propione aldehyde, butyl aldehyde, pentanal, and acrylaldehyde, and one of the solvents selected from them or two or more of them in admixture can be used.

Among the materials described above, the dispersion medium 62 preferably comprises water and/or liquid excellent in compatibility with water (for example, a liquid with a solubility of 30 g or more to 100 g of water at 25° C.). This can improve the dispersibility of the dispersoid 61 in the dispersion medium 62 and can render the grain size of the dispersoid 61 in the liquid dispersion 6 relatively small with less variation in view of the size. As a result, the finally obtained toner (toner particle) varies less for the size and the shape between the particles and has high circularity. Particularly, when the dispersion medium 62 comprises water, this can substantially prevent evaporation of the organic solvent, for example, in the toner manufacturing step. As a result, a toner can be manufactured by a method causing extremely less undesired effects on environments, that is, a method mild to environments. Further, in a case where the dispersion medium 62 mainly comprises water and/or liquid excellent in compatibility with water, the dispersant can be efficiently localized near the surface of the dispersoid 61 in the liquid dispersion 6. As a result, the dispersant can be selectively decomposed and removed while sufficiently preventing the decomposition and degradation of the binder resin, etc. as the constituent material for the toner by the application of ozone and irradiation of UV-rays as will be described later specifically. As a result, a finally obtained toner has particularly excellent property.

In a case of using a mixture of a plurality of ingredients as the constituent material for the dispersion medium 62, those capable of forming azeotropic mixture (lowest boiling point azeotropic mixture) between at least two types of ingredients constituting the mixture may also be used as the constituent material for the dispersion medium. This enables to efficiently remove the dispersion medium 62 in a transport portion of a toner manufacturing apparatus to be described later. Further, this enables to remove the dispersion medium 62 at a relatively low temperature in the transport portion of the toner manufacturing apparatus to be described later and degradation of the characteristics of the toner (toner particles) obtained finally can be prevented effectively. For example, liquid capable of forming an azeotropic mixture with water includes carbon disulfide, carbon tetrachloride, methyl ethyl ketone (MEK), acetone, cyclohexanone, 3-heptanone, 4-heptanone, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, phenol, dipropyl ether, dibutyl ether, 1,4-dioxane, anisole, 2-methoxyethanol, hexane, heptane, cyclohexane, methylcyclohexane, octane, didecane, methylcyclohexene, isoprene, toluene, benzene, ethylbenzene, naphthalene, pyridine, 2-methylpyridine, 3-methylpyridine, 4-methylpyridine, furfuryl alcohol, chloroform, 1,2-dichloroethane, trichloroethylene, chlorobenzene, acetylacetone, ethyl acetate, methyl acetate, isopropyl acetate, isobutyl acetate, isopentyl acetate, ethyl chloroacetate, butyl chloroacetate, isobutyl chloroacetate, ethyl formate, isobutyl formate, ethyl acrylate, methyl methacrylate, ethyl benzoate, trimethyl amine, hexylamine, triethyl amine, aniline, acrylonitrile, acetonitrile, nitromethane, nitroethane and acrylaldehyde.

Further, the boiling point of the dispersion medium 62 is not particularly limited but it is, preferably, 180° C. or lower, more preferably, 150° C. or lower, further preferably, 35 to 130° C. In a case where the boiling point of the dispersion medium 62 is relatively low as described above, the dispersion medium 62 can be removed relatively easily in the transport portion of the toner manufacturing apparatus to be described later. Further, by the use of the material as the dispersion medium 62, the residual amount of the dispersion medium 62 in the finally obtained toner particle can be decreased particularly. As a result, the reliability as the toner is further improved.

The dispersion medium 62 may also contain other ingredients than the materials described above. For example, the dispersion medium 62 may also contain materials exemplified later as the constituent ingredient of the dispersoid 61 and various kinds of additives such as fine inorganic powder, for example, of silica, titanium oxide and iron oxide and fine organic powder such as of fatty acids, and fatty acid metal salts.

Dispersoid

The dispersoid 61 usually comprises a material at least containing a resin or a precursor thereof as a main ingredient (hereinafter also collectively referred to as "resin material"). The resin precursor includes, for example, monomer, dimer, oligomer, and prepolymer of the resin.

The constituent material for the dispersoid 61 is to be described.

1. Resin (Binder Resin)

The resin (binder resin) includes, for example, meth(acryl) type resin, styrene resins such as, polystyrene, poly-α-methyl styrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleate copolymer, styrene-acrylate ester copolymer, styrene-methacrylate ester copolymer, styrene-acrylate ester-methacrylate ester copolymer, methyl styrene-α-chloracrylate copolymer, styrene-acrylonitrile-acrylate ester copolymer, styrene-vinyl methyl ether copolymer, which are monomers or copolymers containing styrene or styrene-substitute, polyester resin, epoxy resin, urethane-modified epoxy resin, silicone-modified epoxy resin, vinyl chloride resin, rosin-modified maleic acid resin, phenol resin, polyethylene, polypropylene, ionomer resin, polyurethane resin, silicone resin, ketone resin, ethylene-ethyl acrylate copolymer, xylene resin, polyvinyl butyral resin, terpene resin, phenol resin, aliphatic or cycloaliphatic hydrocarbon resin, etc., which can be used alone or in combination of two or more of them. Further, in the transport portion of the toner manufacturing apparatus to be described later, in a case of manufacturing the toner by polymerizing the materials in the dispersoid 61, the resin precursor described above (for example, monomer, dimer, oligomer, and prepolymer) is used usually.

While the content of the resin material in the dispersoid 61 is not particularly limited, it is, preferably, from 2 to 98 wt % and, more preferably, from 5 to 95 wt %.

Further, the glass transition point of the resin material constituting the dispersoid 61 is, preferably, from 50 to 70° C. This can efficiently provide a toner suffering from less degradation in the constituent material, excellent in uniformity of the shape and the size, and excellent in mechanical strength. In a case where the resin material constituting the dispersoid 61 comprises a plurality kinds of resin materials (resin ingredients), the value determined as the weighted mean value on the weight base for each of the ingredients can be adopted for the glass transition point of the resin material.

Further, the melting point of the resin material constituting the dispersoid 61 is, preferably, from 90 to 150° C. This enables to conduct the joining step to be described later efficiently. In a case where the resin material constituting the dispersoid 61 comprises a plurality kinds of resin materials (resin ingredients), the value determined as the weighted mean value on the weight base for each of the ingredients can be adopted for the glass transition point of the resin material.

2. Solvent

The dispersoid 61 may also contain a solvent which dissolves at least a portion of the ingredient thereof. This can increase the fluidity of the dispersoid 61 in the liquid dispersion 6, and render the dispersoid 61 in the liquid dispersion 6 to a relatively small grain size and with less variation of the size. As a result, the finally obtained toner can be made with less variation of the size and the shape between the particles (between toner particles) and of relatively high circularity.

Any solvent may be used so long as it can dissolve at least a portion of the ingredients constituting the dispersoid 61 but those removed easily in the transport portion of the toner manufacturing apparatus to be described later (for example, those having a boiling point of 150° C. or lower) are preferred.

Further, the solvent preferably has less compatibility with the dispersion medium 62 described above (for example, those having a solubility of 30 g or less to 100 g of the dispersion medium at 25° C.). This enables to finely disperse the dispersoid 61 in a stable state in the liquid dispersion 6.

Further, the composition for the solvent can be selected properly in accordance with the resin described above, composition of the colorant, the composition of the dispersant, and the like.

For example, the solvent includes inorganic solvents, for example, water, carbon disulfide, and carbon tetrachloride, organic solvents, for example, ketone solvents such as methyl ethyl ketone (MEK), acetone, diethyl ketone, methyl isobutyl ketone (MIBK), methyl isopropyl ketone (MIPK), cyclohexanone, and 3-heptanone, and 4-heptanone, alcoholic solvent such as methanol, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, and phenol, ether solvents such as diethyl ether, dipropyl ether, diisopropyl ether, dibutyl ether, 1,2-dimethoxyethane (DME), 1,4-dioxane, tetrahydrofuran (THF), tetrahydropyran (THP), anisole, diethylene glycol dimethyl ether (diglyme), and 2-methoxyethanol, cellosolve solvents such as methyl cellosolve, ethyl cellosolve and phenyl cellosolve, aliphatic hydrocarbon solvents such as hexane, pentane, heptane, cyclohexane, methyl cyclohexane, octane, didecane, methylcyclohexene, and isoprene, aromatic hydrocarbon solvents such as toluene, xylene, benzene, ethylbenzene, and naphthalene, aromatic heterocyclic compound solvents such as pyridine, pyrazine, furan, pyrrole, thiophene, 2-methyl pyridine, 3-methylpyridine, 4-methylpyridine, and furfuryl alcohol, amide solvents such as N,N-dimethylformamide (DMF), and N,N-dimethylacetoamide (DMA), halogenated compound solvents such as dichloromethane, chloroform, 1,2-dichloroethane, trichloroethylene, and chlorobenzene, ester solvents such as acetylacetone, ethyl acetate, methyl acetate, isopropyl acetate, isobutyl acetate, isopentyl acetate, ethyl chloroaceate, butyl chloroacetate, isobutyl chloroacetate, ethyl formate, isobutyl formate, ethyl acrylate, methyl methacrylate, and ethyl benzoate, amine solvents such as trimethyl amine, hexyl amine, triethyl amine, and aniline, nitrile solvents such as acrylonitrile and acetonitrile, nitro solvents such as nitromethane, and nitroethane, aldehyde solvents such as acetoaldehyde, propione aldehyde, butyl aldehyde, pentanal, and acrylaldehyde, and one or more of the solvents selected from them can be used. Among them, those containing organic solvent are preferred and those containing one or more of the solvents selected from the ether solvents, cellosolve solvents, aliphatic hydrocarbon solvents, aromatic hydrocarbon solvents, aromatic heterocyclic solvents, amide solvents, halogenated compounds solvents, ester solvents, nitrile solvents, nitro solvent, and aldehyde solvents are more preferred. By using such solvents, each of the ingredients described above can be dispersed sufficiently uniformly in the dispersoid 61 relatively easily.

Further, the liquid dispersion 6 (particularly dispersoid 61) usually contains a colorant. For the colorant, pigment, dye, etc. can be used. The pigment and the dye include, for example, carbon black, spirit black, lamp black (C.I. No. 77266), magnetite, titanium black, chrome yellow, cadmium yellow, mineral fast yellow, navel yellow, naphthol yellow, Hanza Yellow G, permanent yellow NCG, chromium yellow, benzidine yellow, quinoline yellow, tartrazine lake, chrome orange, molybdenum orange, permanent orange GTR, pyrazolone orange, benzidine orange G, cadmium red, permanent red 4R, watching red calcium salt, eosin lake, brilliant carmine 3B, manganese violet, fast violet B, methyl violet lake, iron blue, cobalt blue, alkali blue lake, Victoria blue lake, fast sky blue, indanthrene blue BC, ultramarine blue, aniline blue, phthalocyanine blue, chalco oil blue, chrome green, chromium oxide, pigment green B, malachite green lake, phthalocyanine green, final yellow green G, rhodamine 6G, quinacridone, rose Bengal (C.I. No. 45432), C.I. direct red 1, C.I. direct red 4, C.I. acid red 1, C.I. basic red 1, C.I. mordant red 30, C.I. pigment red 48:1, C.I. pigment red 57:1, C.I. pigment red 122, C.I. pigment red 184, C.I. direct blue 1, C.I. direct blue 2, C.I. acid blue 9, C.I. acid blue 15, C.I. basic blue 3, C.I. basic blue 5, C.I. mordant blue 7, C.I. pigment blue 15:1, C.I. pigment blue 15:3, C.I. pigment blue 5:1, C.I. direct green 6, C.I. basic green 4, C.I. basic green 6, C.I. pigment yellow 17, C.I. pigment yellow 93, C.I. pigment yellow 97, C.I. pigment yellow 12, C.I. pigment yellow 180, C.I. pigment yellow 162, nigrosine dye (C.I. No. 50415B), metal complex salt dyes, metal oxides such as silica, aluminum oxide, magnetite, maghemite, various kinds of ferrites, cupric oxide, nickel oxide, zinc oxide, zirconium oxide, titanium oxide, and magnesium oxide, and magnetic materials containing magnetic metals such as Fe, Co, and Ni, which can be used alone or in combination of two or more of them. Such a colorant is usually contained in the dispersoid 61 in the liquid dispersion 6.

While the content of the colorant in the dispersoid 61 is not particularly limited, it is, preferably, from 0.1 to 10 wt % and, more preferably, from 0.3 to 3.0 wt %. In a case where the content of the colorant is less than the lower limit described above, this may possibly result in a difficulty for forming visible images at a sufficient density depending on the kind of the colorant. On the other hand, in a case where the content of the colorant exceeds the upper limit value, this may possibly lower the fixing property or the charging property of the finally obtained toner.

Further, the liquid dispersion 6 may also contain a wax. The wax is usually used with an aim of improving the releasability. The wax includes, for example, natural waxes, for example, plant waxes such as candellila wax, carnauba wax, rice wax, cotton wax, and Japan wax, animal waxes such as bees wax and lanolin, mineral waxes such as montan wax, ozokelite, and ceresin, petroleum waxes such as paraffin wax, micro-wax, microcrystalline wax, and petrolactum, and synthesis waxes, for example, synthesis hydrocarbon waxes such as Fischer Tropsch wax, polyethylene wax (polyethylene resin), polypropylene wax (polypropylene resin), oxidized type polyethylene wax, and oxidized type polypropylene wax, fatty acid amides such as 12-hydroxystearic acid amide, stearic acid amide, phthalic acid anhydride imide and chlorinated hydrocarbons, esters, ketones, and ethers, which can be used alone or in combination of two or more of them. Further, a low molecular weight crystalline polymer resin can also be used as the wax and, for example, crystalline polymers having long alkyl groups on the side chain, for example, homopolymers or copolymers of polyacrylates such as poly n-stearyl methacrylate and poly n-lauryl methacrylate (for example, copolymer with n-stearyl acrylate-ethyl methacrylate) can also be used.

While the content of the wax in the liquid dispersion 6 is not particularly limited, it is, preferably, from 1.0 wt % or less and, more preferably, from 0.5 wt % or less. In a case where the content of the wax is excessive, the wax is liberated and grown in the finally obtained toner particle and leaching of the wax to the surface of the toner particle occurs remarkably tending to lower the toner transfer efficiency.

While the softening point of the wax is not particularly limited, it is preferably from 50 to 180° C. and, more preferably, from 60 to 160° C.

Further, the liquid dispersion 6 contains a dispersant. Incorporation of the dispersant in the liquid dispersion 6 improves the dispersibility of the dispersoid 61 in the liquid dispersion. As a result, a toner with less variation of the size and the shape between each of the particles (toner particles) can be obtained. In the specification, "dispersant" means those having a function of improving the dispersibility of the dispersoid in the liquid dispersion, and this is a concept also including emulsifiers, dispersion aids, etc. in addition to the dispersant in view of the strict meaning.

The dispersant includes, for example, nonionic dispersants, anionic dispersants, cationic dispersants, and amphoteric dispersants.

The nonionic dispersant includes, for example, ether dispersants, ester dispersants, ether ester dispersants, and nitrogen-containing dispersant and, more specifically, polyvinyl alcohol, carboxymethyl cellulose, polyethylene glycol, acrylate ester, methacrylate ester.

The anionic dispersants include, for example, various kinds of rosins, various kinds of carboxylates, various kinds of sulfate ester salts, various kinds of sulfonate salts, various kinds of phosphate ester salts and, more specifically, gum rosins, polymerized rosins, inhomogeneous rosins, maleated rosins, fumarated rosins, maleated rosin penta esters, maleated rosin glycerin esters, tristearate salts (for example, metal salts such as aluminum salt), distearate salts (for example, metal salts such as aluminum salts, and barium salts) stearate salts (for example, metal salts such as calcium salts, lead salts, and zinc salts), linoleic acid salts (for example, metal salts such as cobalt salts, manganese salts, lead salts, and zinc salts), octanate salts (for example, metal salts such as aluminum salts, calcium salts, cobalt salts), oleate salts (for example, metal salts such as calcium salts, cobalt salts), palmitate salts (for example, metal salts such as zinc salts), naphthenic acid salts (for example, metal salts such as calcium salts, cobalt salts, manganese salts, lead salts, and zinc salts), resinate salts (for example, metal salts such as calcium salts, cobalt salts, manganese lead salts, and zinc salts), polyacrylate salts (for example, metal salts such as sodium salts), polymethacrylate salts (for example, metal salts such as sodium salts), polymaleate salts (for example, metal salts such as sodium salts), acrylic acid-maleic acid copolymer salt (for example, metal salts such as sodium salts), celluloses, dodecylbenzene sulfonates (for example, sodium salts), alkyl sulfonate salts, polystyrene sulfonate salts (for example, metal salts such as sodium salts), alkyl diphenyl ether disulfonates (for example, metal salts such as sodium salts).

The cationic dispersant includes, for example, various ammonium salts such as primary ammonium salts, secondary ammonium salts, tertiary ammonium salts, quaternary ammonium salts and, more specifically, (mono)alkylamine salts, dialkyl amine salts, trialkyl amine salts, tetraalkyl amine salts, benzalconium salts, alkyl piridium salts, and imidazolinium salts.

The amphoteric dispersant includes, for example, various kinds of betaines such as carboxybetaine and sulfobetaine, various kinds of aminocarboxylic acids, and various kinds of phosphate ester salts.

Particularly, in a case of using those containing the anionic dispersant among them, the charging property of the finally obtained toner can reliably be made more excellent even when the conditions for the treatment using ozone and UV-rays as will be described specifically later are relatively mild.

In a case of using the dispersant containing the cationic dispersant, the effect according to the invention can be provided particularly remarkably. That is, while negatively charged toners are usually used generally for the toner, in a case where the cationic dispersant is used in the manufacture of such toner, the cationic dispersant in the final toner gives a significant undesired effect on the charging property of the toner even when the content is relatively small. Accordingly, in the existent method (method of using the liquid dispersion) not removing the dispersant, the undesired effect of the cationic dispersant develops remarkably. On the contrary, in the invention, as will be detailed later, since the dispersant contained in the liquid dispersion can be removed efficiently in the toner manufacturing step, occurrence of the problem described above can be prevented effectively even in a case of using the cationic dispersant.

Further, in a case of using the nonionic dispersant for the dispersant, the charging property of the finally obtained toner can reliably be made excellent even when the conditions for the treatment using ozone and UV-rays as will be described specifically later are relatively moderate.

While the content of the dispersant in the liquid dispersion 6 is not particularly limited, it is, preferably, from 0.001 to 10 wt %, more preferably, from 0.005 to 5 wt % and, further preferably, from 0.01 to 3 wt %. In a case where the content of the dispersant is within the range of the values described above, the dispersant does not remain substantially in the finally obtained toner, or the content of the dispersant (residual amount) can be decreased sufficiently while keeping the excellent dispersibility of the dispersoid 61 in the liquid dispersion 6 sufficiently. As a result, the charging property of the toner can be made particularly excellent while particularly suppressing the variation of the shape and the size between each of the particles (toner particles) in the finally obtained toner. Further, the toner productivity can be improved particularly.

Further, the liquid dispersion 6 preferably contains the charge controller. This can render the charging property of the finally obtained toner particularly excellent. Further, in the existent toner manufacturing method using the liquid dispersion, the function of the charge controller can not be provided sufficiently even by the use of the liquid dispersion containing the charge controller. It is considered that this is attributable to the localized distribution of the dispersant contained in the liquid dispersion over the entire surface of the toner particle. On the contrary, in the invention, since the residue of the dispersant in the final toner can be prevented effectively, the function of the charge controller can be provided more effectively.

The charge controller includes, for example, metal salts of benzoic acid, metal salts of salicylic acid, metal salts of alkyl salicylic acids, metal salts of catechol, metal-containing bisazo dyes, nigrosine dyes, tetraphenyl borate derivatives, quaternary ammonium salts, alkyl pyridinium salts, chlorinated polyesters, and nitrofumic acids.

Further, the liquid dispersion 6 may also contain other ingredients than described above. Such ingredients include, for example, a magnetic powder or the like.

The magnetic powder includes, for example, metal oxides such as magnetite, maghemite, various kinds of ferrites, cupric oxide, nickel oxide, zinc oxide, zirconium oxide, titanium oxide, and magnesium oxide, and magnetic materials containing magnetic metals such as Fe, Co, and Ni.

Further, in addition to the materials described above, zinc stearate, zinc oxide, and cerium oxide may also be added in the liquid dispersion 6.

Further, other ingredients than the dispersoid 61 may also be dispersed as an insoluble component in the liquid dispersion 6. For example, fine inorganic powder such as of silica, titanium oxide, iron oxide or fine organic powder such as of fatty acids, fatty acid metal salts may also be dispersed in the liquid dispersion 6.

In the liquid dispersion 6, the dispersoid 61 is finely dispersed in the dispersion medium 62.

While the average grain size of the dispersoid 61 in the liquid dispersion 6 is not particularly limited, it is, preferably, from 0.05 to 1.0 μm and, more preferably, from 0.1 to 0.8 μm. In a case where the average grain size of the dispersoid 61 is within a range of the values described above, the finally obtained toner particle has a sufficiently high circularity and is excellent in view of the uniformity of the characteristics and the shape between each of the particles.

While the content of the dispersoid 61 in the liquid dispersion 6 is not particularly limited, it is, preferably, from 1 to 99 wt % and, more preferably, from 5 to 95 wt %. In a case where the content of the dispersoid 61 is less than the lower limit value, the circularity of the finally obtained toner particle tends to be lowered. On the other hand, in a case where the content of the dispersoid 61 exceeds the upper limit value, the viscosity of the liquid dispersion 6 increases depending on the composition or the like of the dispersion medium 62 tending to increase variation of the shape and the size of the finally obtained toner (toner particle).

In the liquid dispersion 6, the dispersoid 61 may be either solid or liquid or both of the states may be present together. That is, the liquid dispersion 6 may be either liquid suspension or liquid emulsion.

In a case where the dispersoid 61 is a liquid (for example, in a solution or molten state), the average grain size of the dispersoid 61 finely dispersed in the dispersion medium 62 can be within the range described above relatively easily. Further, in a case where the dispersoid 61 is a liquid, since the variation of the shape and the size between each of the dispersoids 61 can be made particularly smaller, variation of the shape and the size between each of the toner particles can be decreased particularly in the finally obtained toner.

Further in a case where the dispersoid 61 is a solid, remaining of unnecessary ingredients such as a solvent in the finally obtained toner can be prevented more effectively. As a result, the reliability of the toner is particularly excellent. Further, in a case where the dispersoid 61 is a solid, that is, where the liquid dispersion 6 is a liquid suspension, the liquid suspension as the liquid dispersion 6 may be prepared, for example, by way of an emulsion. This can provide the advantage in a case where the dispersoid 61 is the liquid effectively while providing an advantage in a case where the dispersoid 61 is the solid.

Further, the dispersoid 61 dispersed in the dispersion medium 62 may have a substantially identical composition or different composition, for example, between each of the particles. For example, the liquid dispersion 6 may also contain those mainly comprising a resin material and those mainly comprising a wax as the dispersoid 61.

In a case where the liquid dispersion 6 is an emulsion, the liquid dispersion 6 is preferably an O/W type emulsion, that is, an emulsion in which an oily (liquid with less solubility to water) dispersant 61 is dispersed in an aqueous dispersion medium 62. This can stably manufacture a toner with less variation of the shape and the size between each of the particles (between toner particles). Further, by the use of an aqueous liquid for the dispersion medium 62, the evaporation amount of an organic solvent in the transport portion of the toner manufacturing apparatus to be described later is decreased, or the organic solvent is not evaporated substantially. As a result, the toner can be manufactured by a method causing extremely less undesired effects on environments.

Assuming the average grain size of the dispersoid 61 in the liquid dispersion 6 as Dm [μm] and the average grain size of the toner particle as Dt [μm], it is preferred to satisfy a relation: $0.005 \leqq Dm/Dt \leqq 0.5$ and more preferably, satisfy a relation: $0.01 \leqq Dm/Dt \leqq 0.2$. When such a relation is satisfied, a toner of particularly less variation of the shape and the size between each of the particles (toner particles) can be obtained.

The liquid dispersion 6 described above can be prepared by using, for example, the following method (first method).

At first, an aqueous solution containing water or a liquid having excellent compatibility with water (water soluble liquid) and a dispersant is prepared.

On the other hand, a resin liquid containing a resin material as the main ingredient of the toner is prepared. In the preparation of the resin liquid, for example, the solvent described above may also be used in addition to the resin material. Further, the resin liquid may be a molten liquid obtained by heating the resin material.

By gradually dropping and adding the resin liquid into the aqueous solution in a stirred state, a liquid dispersion 6 in which the dispersoid 61 containing the resin material is dispersed in the aqueous dispersion medium 62 is obtained. By preparing the liquid dispersion 6 by the method described above, the circularity of the dispersoid 61 in the liquid dispersion 6 can be further improved. As a result, the finally obtained toner particles have particularly high circularity and particularly less variation of the shape between each of the particles (toner particles). When the resin liquid is dropped, the aqueous solution and/or resin liquid may also be heated. Further, in a case of using a solvent for the preparation of the resin liquid, at least a portion of the solvent contained in the dispersoid 61 may be removed by heating the obtained liquid dispersion 6 or placing the same in a reduced pressure atmosphere after conducting the dropping as described above. For example, by removing a most portion of the solvent contained in the dispersoid 61, the liquid dispersion 6 can be obtained as a liquid suspension. In a case of adopting such a method, the solvent can be recovered easily and reliably. As a result, a toner can be manufactured by a method giving extremely less undesired effects on the environment.

While an example for the method of preparing the liquid dispersion 6 has been described above, the liquid dispersion is not restricted to those prepared by such a method. For example, the liquid dispersion 6 can also be prepared by the following method (second method).

At first, an aqueous solution containing water or a liquid having excellent compatibility with water, and a dispersant is prepared.

On the other a hand, powdery or granular material containing a resin material is prepared.

Then, when the powdery or granular material is gradually charged into the aqueous solution in a stirred state, a liquid dispersion 6 in which the dispersoid 61 containing the resin material is dispersed in the aqueous dispersion medium 62 is obtained. In a case of preparing the liquid dispersion 6 by such a method, the organic solvent can be made not substantially evaporating in the transport portion of a toner manufacturing apparatus to be described later. As a result, the toner can be manufactured by a method giving extremely less undesired effects on the environment. In a case of charging the material, the aqueous solution may also be heated for instance.

Further, the liquid dispersion 6 can also be prepared by the following method (third method).

At first, a liquid resin dispersion in which at least a resin material is dispersed and a liquid colorant dispersion in which at least a colorant is dispersed are prepared.

Then, the liquid resin dispersion and the liquid colorant dispersion are mixed and stirred. In this case, an agglutinant such as an inorganic metal salt may be added optionally while stirring.

When stirring is conducted for a predetermined time, an agglomerate is formed by agglomeration of the resin material, the colorant, etc. As a result, a liquid dispersion 6 in which the agglomerate is dispersed as the dispersoid 61 is obtained.

Further, in the preparation method for the liquid dispersion described above, a kneaded product containing a resin material (binder resin) may be used. That is, a kneaded product containing the resin material may be used as the "resin material" in the first method and the third method described above, or the kneaded product containing the resin material may be used as "powdery or granular material" in the second method. The toner particle can thus be obtained as a more uniform mixture of each of the constituent ingredients. Particularly, even in a case where the toner constituent ingredients contain two or more kinds of ingredients of poor dispersibility and compatibility, the effects described above can be obtained. As the kneaded product, those, for example, containing other ingredients than the resin ingredient (for example, ingredients such as colorant, wax, and charge controller) can also be used. This makes the effects described above more remarkable.

Further, for the preparation of the liquid dispersion 6, a method, for example, described in the specification of Japanese Patent Application No. 2003-113428 may be applied. That is, a method of jetting a liquid containing a powdery or granular resin material (kneaded product) from a plurality of nozzles, colliding the liquids jetted out from each of the nozzles against each other, particulating the resin material (kneaded product) and obtaining a liquid dispersion 6 containing the particulated dispersoid 61 may be applied. This can relatively decrease the size of the dispersoid 61 contained in the liquid dispersion 6 easily (to the size of the range described above) and can decrease the variation of the size for each of the dispersoids 61.

Further, the liquid dispersion 6 obtained by the method as described above is preferably applied with a deaeration treatment (subjected to deaeration step) before being discharged in the toner manufacturing apparatus to be described later. This can reduce the amount of a gas dissolved in the liquid dispersion 6 and can effectively prevent generation of bubbles in the liquid dispersion 6 upon removing the dispersion medium 62 from the liquid dispersion 6 discharged in a droplet form in the transport portion of a toner manufacturing apparatus to be described later. As a result, this can effectively prevent the intrusion of the toner particles of irregular shape (hollow particle, depleted particle, etc.) in the finally obtained toner. Accordingly, a toner in which each of the toner particles has a uniform shape and with small range of grain size distribution can be obtained easily and reliably. Further, this can render the finally obtained toner to be particularly excellent in the characteristics such as transferability, fluidity, and cleaning property. Further, by applying the deaeration treatment to the liquid dispersion 6, the ratio of pores (voids) in the finally obtained toner particle can be decreased. As a result, the reliability of the toner is further improved.

While the method of deaeration treatment is not particularly limited, a method of applying supersonic vibrations to the liquid dispersion (supersonic vibration method) or a method of putting the liquid dispersion in a reduced pressure atmosphere (pressure reduction method) can be used for instance.

In a case of using the pressure reduction methods as a method for the deaeration treatment, the pressure of the atmosphere in which the liquid dispersion is placed is, preferably, 80 kPa or less and, more preferably, from 0.1 to 40 kPa and, further preferably, from 1 to 27 kPa. In a case where the atmospheric pressure during the deaeration is within such a range of values, dissolved gas can be removed efficiently while sufficiently maintaining the shape of the dispersoid 61 in the liquid dispersion 6.

A method of manufacturing a toner and an apparatus for manufacturing a toner using the liquid dispersion as described above are to be described specifically.

Toner Manufacturing Apparatus

A toner manufacturing apparatus 1 has a head 2 for discharging the liquid dispersion 6 as described above (particularly liquid dispersion 6 applied with deaeration treatment) as a discharged product, a liquid dispersion supply portion 4 for supplying the liquid dispersion 6 to the head 2, a transport portion 3 for transporting the liquid dispersion 6 (discharged product) discharged from the head 2, an ozone applying device 12 for applying ozone to the agglomerate 90 formed in the transport portion 3, a UV-ray irradiating device 17 for irradiating UV-rays to the agglomerate 90, a recovery portion 5 for recovering the manufactured toner particle 9, and an ozone recovering device 14 for recovering ozone supplied to the transport portion 3 (unreacted ozone). Then, the transport portion 3 has a first region 32 for removing the dispersion medium 62 from the dispersion liquid 6 in the droplet form (conducting dispersion medium removing step) to obtain the agglomerate 90, and a second region 33 for joining a plurality of dispersoids constituting the agglomerate 90 to each other (conducting joining step) and applying ozone (conducting ozone applying step) to the agglomerate 90 (discharged product) and irradiating UV-rays (conducting UV-ray irradiation step) to the agglomerate 90 (discharged product). In the present specification, "discharged product" means the liquid dispersion discharged in the droplet form or those derived therefrom (granular product), which is a concept including, for example, the liquid dispersion per se discharged in the droplet form, as well as those formed by removing the dispersion medium from the liquid dispersion, those in which the dispersoid constituting the liquid dispersion is modified (for example, at least a portion of the constituent material for the dispersoid is polymerized), etc. Further, in the present specification, "dispersoid" joined in the joining step (for example, melt joining) means the dispersoid constituting the liquid dispersion or those derived therefrom, which is a concept including, for example, the dispersoid per se for constituting the liquid dispersion, as well as those formed by removing, from the dispersoid, a portion of the ingredients thereof (for example, solvent), and those in which at least a portion of the constituent ingredient for the dispersoid is modified (at least a portion of the constituent material for the dispersoid is polymerized), etc.

In the liquid dispersion supply portion 4, the liquid dispersion 6 described above is stored and the liquid dispersion 6 is supplied into the head 2.

Any liquid dispersion supply portion 4 may be used so long as it has a function of supplying a liquid dispersion 6 to the head 2 and it may have a stirring device 41 for stirring the liquid dispersion 6 as shown in the drawing. This can supply the liquid dispersion 6 in which the dispersoid 61 is dispersed sufficiently uniformly into the head 2 even when the dispersoid 61 is less dispersed in the dispersion medium.

The head 2 has a dispersion liquid store portion 21 a piezoelectric device 22, and a discharge portion 23. The liquid dispersion store portion 21 stores the liquid dispersion 6 as described above.

The liquid dispersion 6 stored in the liquid dispersion store portion 21 is discharged as a discharged product in the droplet form from the discharge portion 23 to the transport portion 3 by a pressure pulse (piezoelectric pulse) of the piezoelectric device 22.

As described above, the invention has a feature in using the liquid dispersion. This can provides, for example, the following effects.

That is, by the use of the liquid dispersion as the discharged liquid, when the discharged liquid (liquid dispersion) is discharged from the discharge portion, it is selectively cut at a portion of the dispersing medium of low viscosity in a micro point of view and discharged as droplets. Accordingly, the size of the discharged liquid dispersion varies less in view of the size between each of the droplets. Accordingly, the finally obtained toner varies less in view of the size between each of the particles (toner particles).

Then, the droplet discharged from the discharge portion is rapidly formed into a spherical shape after being discharged by the surface tension of the dispersion medium. Further, the droplet constituted with the liquid dispersion is excellent in the stability of the shape also during transportation in the transport portion and solidified in a state of keeping the substantially spherical shape. Accordingly, the finally obtained toner (toner particle) has a high circularity and varies less for the shape between each of the particles (toner particles).

On the contrary, such an effect cannot be obtained in a case of using a solution or a molten liquid as a discharged liquid. Since such a discharged liquid has a uniform viscosity in micro point of view when it is discharged from the discharge portion, it tends to be in a so-called poor liquid cut state and the droplet tends to take a trailing shape. Further, also during transportation in the transport portion, it tends to form a trailing shape as described above. Accordingly, in a case of using the solution or molten liquid as the discharged liquid, the finally obtained toner tends to vary greatly for the size and the shape between each of the particles (toner particles) and have low circularity of the toner particle.

Further, by the use of the liquid dispersion as the discharged liquid, even in a case where the grain size of the toner particle to be manufactured is sufficiently small, the circularity thereof can be made sufficiently high and the distribution of the grain size can be made sharp easily. Thus, the obtained toner has particularly high uniformity for the charging between each of the particles and, when the toner is used for printing, a thin layer of the toner formed on a developing roller is leveled and increased in the density. As a result, it causes fewer defects such as fogging and can form more sharp images. Further, since the shape and the grain size of the toner particles are uniform, the bulk density as the entire toner (assembly of toner particles) can be increased. As a result, it is also advantageous in increasing the filling amount of the toner in a cartridge of an identical volume more or reducing the size of the cartridge.

While the shape of the discharge portion 23 is not particularly limited, it is preferably a substantially cylindrical shape. This can increase the sphericalness of the discharged liquid dispersion 6, the agglomerate 90 formed in the transport portion 3 and, further, the finally obtained toner particle 9.

In a case where the discharge portion 23 is in a substantially circular shape, the diameter (nozzle diameter) is, preferably, from 5 to 500 μm and, more preferably, from 10 to 200 μm for instance. In a case where the diameter of the discharge portion 23 is less than the lower limit value, clogging tends to occur and the discharged liquid dispersion 6 (discharged product) sometimes varies greatly in view of the size. On the other hand, in a case where the diameter of the discharge portion 23 exceeds the upper limit value, the discharged liquid dispersion 6 may possibly involve bubbles depending on the relation between the negative pressure of the liquid dispersion store portion 21 and the surface tension of the nozzle.

Further, the head 2 preferably has liquid repellency to the liquid dispersion 6 near the liquid discharge portion 23 (particularly, at the surface for the opening of the discharge 23 or at the surface of the head 2 on the side provided with the discharge portion 23 (lower surface in the drawing)). This can effectively prevent the liquid dispersion 6 from depositing in the vicinity of the discharge portion thereof. This can effectively prevent the so-called poor liquid cut state or occurrence of discharge failure of the liquid dispersion 6. Further, since deposition of the liquid dispersion 6 in the vicinity of the discharge portion can be prevented effectively, the stability of the shape of the discharged droplet is improved (decreasing variation of the shape and the size between each of the droplets), and variation of the shape and the size of the finally obtained toner particles is also decreased.

The material having such liquid repellency includes, for example, fluoro-resin such as polytetrafluoroethylene (PTFE) and silicone materials.

Further, a hydrophobic treatment is preferably applied near the discharge portion 23 of the head 2 (particularly at a surface for the opening of discharge portion 23 and at a surface of the head 2 on the side provided with the discharge portion 23 (lower surface in the drawing)). This can preferably provide the liquid repellency, for example, in a case where the dispersion medium 62 of the liquid dispersion 6 mainly comprises water and the effect described above develops more remarkably. The method of hydrophobic treatment includes, for example, formation of films constituted with a hydrophobic material (for example, material having the liquid repellency described above). By the way, while water has a relatively high viscosity among various kinds of liquids, even when such water is used as the constituent material for the dispersion medium 62, occurrence of disadvantage caused by deposition of the liquid dispersion 6 near the discharge port can be prevented effectively. Accordingly, when the hydrophobic treatment is applied near the discharge port 23 of the head 2, a liquid dispersion 6 not substantially containing or scarcely containing an organic solvent can be used suitably and the toner can be manufactured by a method scarcely giving undesired effects on environments.

As shown in FIG. 2, a piezoelectric device 22 is formed by stacking a lower electrode (first electrode) 221, a piezoelectric body 222 and an upper electrode (second electrode) 223 in this order. That is, a piezoelectric electrode 22 has such a constitution that the piezoelectric body 222 is interposed between the upper electrode 223 and the lower electrode 221.

The piezoelectric device 22 functions as a vibration source and a vibration plate 24 vibrates by the vibration of the piezoelectric device (vibration source) 22 and has a function of instantaneously increasing the inner pressure of the liquid dispersion store portion 21.

The head 2 does not cause deformation to the piezoelectric body 222 in a state where a predetermined discharge signal is not inputted from a piezoelectric driving circuit (not illustrated), that is, in a state where a voltage is not applied between the lower electrode 221 and the upper electrode 223 of the piezoelectric device 22. Accordingly, the vibration plate 24 is neither deformed and volumic change is not caused to the liquid dispersion store portion 21. Accordingly, the liquid dispersion 6 is not discharged from the discharge portion 23.

On the other hand, in a state where a predetermined discharge signal is inputted from the piezoelectric device driving circuit, that is, in a state where a predetermined voltage is applied between the lower electrode 221 and the upper electrode 223 of the piezoelectric device 22, the piezoelectric body 222 is deformed. This greatly distorts the vibration plate 24 (downward distortion in FIG. 2) and the volume of the liquid discharge store portion 21 decreases (changes). In this case, the pressure in the liquid dispersion store portion 21 increases instantaneously to discharge a granular liquid dispersion 6 from the discharge portion 23.

When the discharge of the liquid dispersion 6 for one shot is completed, the piezoelectric device driving circuit stops the application of the voltage between the lower electrode 221 and the upper electrode 223. Thus, the piezoelectric device 22 substantially restores the original shape to increase the volume of the liquid dispersion store portion 21. In this instance, a pressure from the liquid dispersion supply portion 4 to the discharge portion 23 (pressure in the positive direction) exerts on the liquid dispersion 6. Accordingly, intrusion of air from the discharge portion 23 to the liquid dispersion store portion 21 is prevented and the liquid dispersion 6 in an amount corresponding to the discharge amount of the liquid dispersion 6 is supplied from the liquid dispersion supply portion 4 to the liquid dispersion store portion 21.

By the application of the voltage at a predetermined period as described above, the piezoelectric device 22 oscillates to discharge the granular liquid dispersion 6 repetitively.

By discharging (jetting) the liquid dispersion 6 by a pressure pulse under the vibrations of the piezoelectric body 222, the liquid dispersion 6 can be discharged intermittently drop by drop, and the shape of the liquid dispersion to be discharged is stabilized. As a result, a toner having less variation of the shape and the size between each of the particles (each of the toner particles) can be obtained, and the sphericalness of the manufactured toner particles can be increased (shape geometrically approximate to a complete spherical shape) relatively easily.

In a case of manufacturing a toner by the discharge of the liquid dispersion as described above, varying of the grain size between each of the particles can be decreased particularly, and the range for the selection of the constituent material (particularly binder resin) for the toner can be extended.

Further, by discharging (jetting) the liquid dispersion (discharged product) described above, the number of vibrations of the piezoelectric body, the opening area (nozzle diameter) of the discharge portion, the temperature and the viscosity of the liquid dispersion, the discharge amount for one drop of the liquid dispersion, the content of the dispersoid in the liquid dispersion, and the grain size of the dispersoid in the liquid dispersion can be controlled relatively accurately, and the toner particle to be manufactured can be controlled to a desired shape and the size easily. Further, by controlling the conditions described above, the manufacturing amount of the toner, for example, can be administrated easily and reliably.

Further, by using the vibrations of the piezoelectric body for the discharge of the liquid dispersion, the liquid dispersion can be discharged at a predetermined interval more reliably. Accordingly, this can effectively prevent the discharged granular liquid dispersion (discharged product) from colliding and agglomerating to each other and formation of irregularly shaped toner particle can be prevented more effectively.

The initial velocity of the liquid dispersion 6 (discharged product) discharged from the head 2 to the transport portion 3 is, preferably, from 0.1 to 10 m/sec and, more preferably, 2 to 8 m/sec for instance. In a case where the initial velocity of the liquid dispersion 6 is less than the lower limit value, the toner productivity is lowered. On the other hand, in a case where the initial velocity of the liquid dispersion 6 exceeds the upper limit value, the sphericalness of the finally obtained toner particle tends to be decreased.

While the viscosity of the liquid dispersion 6 discharged from the head 2 is not particularly limited and, for example, it is, preferably, from 0.5 to 200 [mPa·s] and, more preferably, from 1 to 25 [mPa·s]. In a case where the viscosity of the liquid dispersion 6 is less than the lower limit value, it may be difficult to sufficiently control the size of the discharged liquid dispersion 6 and the finally obtained toner particle may sometimes vary greatly. On the other hand, in a case where the viscosity of the liquid dispersion 6 exceeds the upper limit value, the grain size of the formed particles is increased, the discharging speed of the liquid dispersion 6 is retarded, and the amount of energy required for discharging the liquid dispersion 6 tends to be increased. In a case where the viscosity of the liquid dispersion 6 is particularly high, the liquid dispersion 6 can no more be discharged as a droplet.

The liquid dispersion 6 discharged from the head 2 may be previously heated. By heating the liquid dispersion 6, the dispersoid 61 in a case where it is, for example, in a solid state at a room temperature (or in a state where the viscosity is relatively high), the dispersoid can be rendered in a molten state (in a state where the viscosity is relatively low, that is, in a softened state) upon discharging. As a result, agglomeration of the dispersoids 61 contained in the granular liquid dispersion 6, or joining of the dispersoids 61 proceeds smoothly in the transport portion 3 to be described later, the circularity of the formed agglomerate 90 becomes particularly high and, as a result, the circularity can be high also for the finally obtained toner particle.

Further, the liquid dispersion 6 discharged from the head 2 may be previously cooled. By cooling the liquid dispersion 6, undesirable evaporation (volatilization) of the dispersion medium 62, for example, from the liquid dispersion 6 near the discharge portion 23 can be prevented effectively. As a result, change of the discharged amount, etc. of the liquid dispersion 6 due to the aging decrease of the opening area of the discharge portion can be prevented effectively and a toner with particularly reduced varying of the size and the shape between each of the particles can be obtained.

While the discharged amount for one droplet of the liquid dispersion 6 differs somewhat, for example, depending on the content of the dispersoid 61 in the liquid dispersion 6, it is, preferably, from 0.5 to 500 pl and, more preferably, from 0.5 to 5 pl. By defining the discharged amount for one drop of the liquid dispersion 6 within such a range, the grain size of the formed agglomerate 90 or the toner particle 9 can be controlled appropriately.

While the average grain size of the liquid dispersion 6 (discharged product) discharged from the head 2 differs somewhat depending on the content of the dispersoid 61 in the liquid dispersion 6, etc., it is, preferably, from 2 to 50 μm and, more preferably, 4 to 15 μm. By defining the average grain size of the liquid dispersion 6 (discharged product) within such a range of the values, the grain size of the formed agglomerate 90 or the toner particle 9 can be controlled appropriately.

The granular liquid dispersion 6 discharged from the head 2 is generally large enough compared with the dispersoid 61 in the liquid dispersion 6. That is, a number of dispersoids 61 are dispersed in the granular liquid dispersion 6. Accordingly, even when the grain size of the dispersoid 61 varies relatively largely, the content of the dispersoid 61 in the discharged granular liquid dispersion 6 is substantially uniform for each of the droplets. Accordingly, even in a case where the grain size of the dispersoid 61 varies relatively largely, the toner particle 9 has less grain size variation between each of the particles by controlling the discharged amount of the liquid dispersion 6 substantially uniformly. Such a trend becomes remarkable in a case of satisfying the following relation. That is, assuming the average grain size of the discharged liquid dispersion 6 as Dd [μm] and the average grain size of the dispersoid 61 in the liquid dispersion 6 as Dm [μm], it is preferred to satisfy a relation: $Dm/Dd<0.5$ and, more preferred to satisfy a relation: $Dm/Dd<0.2$.

Further, assuming the average grain size of the discharged liquid dispersion 6 as Dd [μm], and the average grain size of the manufactured toner particles as Dt [μm], it is preferred to satisfy a relation: $0.05 \leqq Dt/Dd \leqq 1.0$ and it is more preferred to satisfy a relation; $0.1 \leqq Dt/Dd \leqq 0.8$. By satisfying the relation described above, a toner which is sufficiently fine, has high circularity and a sharp grain size distribution can be obtained relatively easily.

While the number of vibrations (frequency of piezoelectric pulse) of the piezoelectric device 22 is not particularly limited, it is, preferably, from 1 kHz to 500 MHz and, more preferably, 5 kHz to 200 MHz. In a case where the number of vibrations of the piezoelectric device 22 is less than the lower limit value, the toner productivity is lowered. On the other hand, in a case where the number of vibrations of the piezoelectric device 22 exceeds the upper limit value, discharging of the granular liquid dispersion 6 can no more follow and the size for the one droplet of the liquid dispersion 6 may possibly vary greatly.

The toner manufacturing apparatus 1 of the constitution shown in the drawings has a plurality of heads 2. Then, granular liquid dispersion 6 is discharged from the heads 2 respectively to the transport portion 3.

Each of the heads 2 may be adapted to discharge the liquid dispersion 6 substantially at the same time but it is preferred to be controlled such that the discharging timing for the liquid dispersion 6 is different between at least two adjacent heads. This can effectively prevent that the granular liquid dispersion (discharged products) discharged from the two adjacent heads 2 are collided against each other and agglomerated before the granular liquid dispersion 6 (discharged products) is solidified (before forming the agglomerate 90).

Further, as shown in FIG. 2, the toner manufacturing apparatus 1 has a gas flow supplying device 10 and a gas supplied from the gas flow supplying device 10 is adapted to be jetted by way of a duct 101 from each of gas jetting ports 7 provided between the head 2 and the head 2 substantially at a uniform pressure. This can transport the discharged product while keeping the distance of the granular discharged products (liquid dispersion 6) discharged intermittently from the discharge portion 23 to obtain the agglomerate 90 and the toner particle 9. As a result, collision and the agglomeration of the discharged granular liquid dispersion 6 (droplets) to each other can be prevented more effectively.

By jetting the gas supplied from the gas supplying device 10 from the gas jetting port 7, a gas flow flowing substantially in one direction (downward direction in the drawing) can be formed in the transport portion 3. When such a gas flow is formed, granular discharged product (liquid dispersion 6, agglomerate 90) in the transport portion 3 can be transported efficiently.

Since the gas is jetted from the gas jetting port 7, a gas stream curtain is formed between the particles (discharged products) discharged from each of the heads 2 and, for example, collision and agglomeration between in each of the particles discharged from adjacent heads can be prevented more effectively.

A heat exchanger 11 is attached to the gas flow supplying device 10. This can set the temperature of the gas jetted from the gas jetting port 7 to a preferred value, and the granular liquid dispersion 6 discharged to the transport portion 3 can be solidified efficiently.

When such a gas flow supplying device 10 is provided, the solidifying speed of the liquid dispersion 6 (speed of removing the dispersion medium from the liquid dispersion 6, etc.) discharged from the discharge portion 23 can also be controlled easily by controlling the gas supply amount.

While the temperature of the gas jetted from the gas jetting port 7 is different depending on the dispersoid 61 contained in the liquid dispersion 6, the composition of the dispersion medium 62, etc., usually it is, preferably, from 0 to 70° C. and, more preferably, from 15 to 60° C. In a case where the temperature of the gas jetted from the gas jetting port 7 is within such a range of the values, the dispersion medium 62 contained in the liquid dispersion 6 can be removed efficiently while increasing the uniformity and the stability for the shape of the obtained agglomerate 90 and the toner particle 9 sufficiently.

The humidity of the gas jetted from the gas jetting port 7 is, for example, preferably, 50% RH or less and, more preferably, 10% RH or less. In a case where the humidity of the gas jetted from the gas jetting port 7 is 50% RH or less, the dispersion medium 62 contained in the liquid dispersion 6 can be removed efficiently in the transport portion 3 (particularly, in the first region 32) to be described later and the toner productivity is further improved.

The transport portion 3 is formed as a cylindrical housing 31 and has a first region 32 and a second region 33 along the transporting direction of the discharged product (in the direction from the discharge portion 23 to the recovery portion 5). In the first region 32, a dispersion medium removing step of removing the dispersion medium 62 from the liquid dispersion 6 in the droplet form and forming the agglomerate 90 (dispersion medium removing treatment) is conducted. Further in the second region 33, a joining step of joining a plurality of dispersoids constituting the agglomerate 90 to each other (joining treatment) is conducted. Particularly, in this embodiment, as described above, the joining step (joining treatment) is conducted, and an ozone applying step of applying ozone to the discharged product (agglomerate 90) (ozone applying treatment) and a UV-ray irradiation step of irradiating UV-rays to the discharged product (agglomerate 90)(UV-ray irradiation processing) are conducted in the second region 33. That is, in this embodiment, the joining treatment, the ozone applying treatment and the UV-ray irradiating treatment are conducted in one identical step (in the identical second region).

Usually, the first region 32 is set to a temperature lower than the temperature for the second region 33.

While the temperature for the first region 32 (low temperature region) (processing temperature in the dispersion medium removing step) differs depending on the dispersoid 61 contained in the liquid dispersion 6, the composition of the dispersion medium 62, etc., usually it is, preferably, from 0 to 50° C. and, more preferably, from 15 to 40° C. In a case where the temperature of the first region 32 (atmospheric temperature) is within the range of such values, the dispersion medium 62 contained in the liquid dispersion 6 can be removed efficiently while maintaining the uniformity and the stability for the shape of the obtained agglomerate 90 sufficiently higher and, as a result, the toner productivity can be made particularly excellent. Further, since formation of the agglomerate 90 can proceed more smoothly, this can contribute to the size reduction of the toner manufacturing apparatus 1.

Further, assuming the temperature of the first region 32 (processing temperature in the dispersion medium removing step) as $T_1$[° C.], and the glass transition point of the resin material constituting the dispersoid 61 as $T_g$[° C.] it is preferred to satisfy a relation: $0 \leqq T_g - T_1 \leqq 70$ and more preferred to satisfy a relation: $0 \leqq T_g - T_1 \leqq 50$, and it is further preferred to satisfy a relation: $10 \leqq T_g - T_1 \leqq 40$. When such relations are satisfied, the dispersion medium 62 contained in the liquid dispersion 6 can be removed efficiently while sufficiently increasing the uniformity and the stability for the shape of the obtained agglomerate 90 and, as a result, the toner productivity can be made particularly excellent. In a case where the dispersoid 61 comprises a plurality kinds of resin materials (resin ingredients), a value determined as a weighted means value on the weight base for each of the ingredients can be adopted for $T_g$.

Processing time for the dispersion medium removing step descried above (time from the jetting of the liquid dispersion 6 in the droplet form to the formation of the agglomerate 90) is, preferably, from 5 to 120 sec, more preferably, from 10 to 60 sec and, further preferably, from 10 to 20 sec. In a case where the processing time of the dispersion medium removing step is within the range of such values, the productivity as the toner can be improved sufficiently while maintaining the strength of the obtained agglomerate 90 sufficiently (while sufficiently preventing decomposition and collapse of the agglomerate 90 until the manufacture of the toner particle 9).

The granular liquid dispersion 6 discharged from the head 2 is removed with the dispersion medium 62 while being transported in the first region 32 to form the agglomerate 90 in which a plurality of dispersoids 61 are agglomerated. That is, the dispersoids 61 contained in the liquid dispersion 6 are agglomerated along with removal of the dispersion medium 62 in the discharged liquid dispersion 6 and, as a result, the agglomerate 90 is obtained. In a case where the solvent described above is contained in the dispersoid 61, the solvent is also removed usually in the first region 32.

Since the agglomerate 90 obtained in this step (discharged product applied with the dispersion medium removing treatment) is removed with a most portion of the dispersion medium 62, it can maintain the shape sufficiently until it is supplied to the joining step to be described later. In other words, it may suffice that the agglomerate 90 obtained in this step may have a stability sufficient to maintain the shape thereof until it is supplied to the joining step and, for example, a portion of the dispersion medium 62 may remain in the inside thereof. Also in such a case, the residual dispersion medium, etc. can sufficiently be removed by applying the joining step or the like to be described later. Usually, the ratio of the constituent ingredients for the dispersion medium contained in the agglomerate 90 obtained by this method is 15 wt % or less.

The grain size of the dispersoid 61 contained in the liquid dispersion 6 is usually sufficiently smaller compared with the obtained agglomerate 90 (discharged granular liquid dispersion 6). Accordingly, the obtained agglomerate 90 has a relatively high circularity.

Since the dispersion medium 62 is removed in the transport portion 3 (first region 32), the obtained agglomerate 90 is usually smaller compared with the liquid dispersion 6 in the droplet form (discharged product) discharged from the discharge portion 23. Accordingly, even in a case where the area (opening area) of the discharged portion 23 is relatively large, the size of the obtained agglomerate 90 can be made relatively small. Accordingly, a sufficiently fine agglomerate 90 and a toner particle 9 can be obtained even in a case where the head 2 is not obtained by applying any special precision fabrication (those that can be manufactured relatively easily).

As described above, since it is not necessary to extremely decrease the area of the discharge portion 23, the grain size distribution of the liquid dispersion 6 discharged from each of the heads 2 can be made sufficiently sharp. As a result, also the finally obtained toner can be adapted to have less variation of grain size between each of the particles (toner particles), that is, to have a sharp grain size distribution.

The agglomerate 90 (discharged product removed with the dispersion medium 62) formed in the first region 32 is sent to the second region 33 (high temperature region) and a plurality of dispersoids 61 constituting the agglomerate 90 are joined (joining step). A toner particle 9 having an excellent mechanical stability can be obtained by applying such treatment (joining treatment). That is, since the bonding strength between the dispersoids 61 constituting the agglomerate 90 (bonding strength between dispersoid 61—dispersoid 61) is relatively small, collapse (disintegration) tends to occur even in a case where a relatively small external force exerts. Then, a toner particle 9 having an excellent mechanical stability can be obtained by applying the joining treatment. Further, the agglomerate 90 has a number of concave/convex portions corresponding to the shape of the dispersoid 61 in the liquid dispersion 6 near the surface thereof and, accordingly, while the circularity of the agglomerate 90 is relatively large, the concave/convex portions can be moderated by applying the joining treatment to the agglomerate 90, and the circularity of the finally obtained toner particle 9 can be increased further.

The joining treatment (joining step) is preferably conducted by applying a heat treatment to the agglomerate 90 at a temperature higher than the processing temperature in the dispersion medium removing step described above. This can effectively proceed joining of a plurality of dispersoids 61 constituting the agglomerate 90 easily and reliably.

More specifically, assuming the processing temperature in the dispersion medium removing step (temperature in the first region 32) as $T_1$[° C.] and a processing temperature in the joining step (temperature in the second region 33) as $T_2$ [° C.], it is preferred to satisfy a relation: $0 \leqq T_2 - T_1 \leqq 200$, it is more preferred to satisfy a relation: $10 \leqq T_2 - T_1 \leqq 200$, it is further preferred to satisfy a relation: $20 \leqq T_2 - T_1 \leqq 100$ and it is most preferred to satisfy a relation: $25 \leqq T_2 - T_1 \leqq 80$. By satisfying the relations described above, the uniformity of the shape and the stability of the obtained toner particles 9 can be improved sufficiently while preventing degradation and denaturation of the constituent ingredients sufficiently and, further, the circularity of the toner particle 9 can be made relatively higher.

Further, assuming the processing temperature in the joining step (joining treatment) as $T_2$ [° C.] and the melting point of a resin material constituting the dispersoid 61 (dispersoid 61 constituting the agglomerate 90) as $T_m$[° C.], it is preferred to satisfy a relation: $-100 \leqq T_2 - T_m \leqq 110$, more preferred satisfy a relation: $-80 \leqq T_2 - T_m \leqq 80$, further preferred to satisfy a relation: $-50 \leqq T_2 - T_m \leqq 70$ and, most preferred to satisfy a relation: $-40 \leqq T_2 - T_m \leqq 30$. The uniformity of the shape and the stability of the obtained toner particle 9 can be improved sufficiently while preventing degradation and denaturation of the constituent ingredients sufficiently and, further, the circularity of the toner particles 9 can be made relatively larger by satisfying the relations described above. Further, in a case where the resin material constituting the dispersoid 61 (dispersoid 61 constituting the agglomerate 90) comprises a plurality kinds of resin materials (resin ingredients), a value determined as a weighted mean value on the weight base for the each of the ingredients can be adopted for $T_m$.

While specific value for the processing temperature in the joining step (joining treatment) (temperature in the second region 33) is not particularly limited, usually, it is preferably from 50 to 200° C. and, more preferably, from 60 to 150° C. in a case where the processing time for the joining step (joining treatment) is within a range of the values as to be described later. The uniformity of the shape and the stability of the obtained toner particle 9 can be improved sufficiently while preventing degradation and denaturation of the constituent ingredients sufficiently by satisfying the relations described above and, further, the circularity of the toner particle 9 can be made relatively larger.

While the processing time for the joining step (joining treatment) as described above is not particularly limited, it is preferably from 0.01 to 10 sec, more preferably, from 0.05 to 10 sec and, further preferably, from 0.1 to 5 sec in a case where the processing temperature for the joining step (joining treatment) is within the range of the values as described above. In a case where the processing time for the joining step is within the range of the values as described above, the circularity of the toner particle 9 can be increased sufficiently while preventing degradation, denaturation, etc. of the constituent material for the toner.

Further, as described above, in the second region, the joining step (joining treatment) as described above is conducted and, at the same time, ozone is applied to the discharged product (agglomerate 90 or the joined product formed by joining a plurality of dispersoids constituting the agglomerate 90) (ozone applying treatment), and UV-rays are irradiated (UV-ray irradiation treatment).

As described above, the invention has a feature in applying ozone and irradiating UV-rays in the manufacturing method using the liquid dispersion. As described above, while the liquid dispersion containing the toner constituent material usually contains a dispersant, by decomposing and removing the dispersant by ozone and UV-rays, a toner excellent in the charging property, having a uniform shape and with small grain size distribution can be manufactured efficiently and by a method mild to the environment. Further, by decomposing the dispersant with ozone and UV-rays, the finally obtained toner is excellent in the circumstantial property (water resistance and storability). Particularly, in the invention, application of ozone and irradiation of UV-rays have a synergistic effect and, as a result, an excellent effect (synergistic effect) can be obtained. Referring more specifically, by applying ozone together with irradiation of UV-rays, ozone can be effectuated in a state where the reactivity (activity) of the dispersant to be removed is enhanced by the irradiation of UV-rays thereby capable of efficiently removing the dispersant.

On the contrary, without removal of the dispersant, it may be difficult to obtain a satisfactory charging property in the finally obtained toner (more specifically, it may be difficult to sufficiently increase the absolute value for the charged amount of the toner particle, or charging property (charged amount) tends to vary between each of the toner particles) and the toner is also deteriorated in view of the circumstantial property (water resistance, storability). This is considered to be attributable to that the residual dispersant neutralizes (hinders) the charges of the toner resin or the charge controller.

While it may be considered to restrict the lowering of the absolute value for the charged amount described above also in the method of not using ozone by applying a treatment, for example, water washing to the obtained toner particles, this requires a great amount of water (cleaning agent) for the cleaning of the toner particle to give large burden on the environment. Further, even when the cleaning described above is conducted sufficiently, it may be difficult to thoroughly dissolve the problems described above, and the charge amount varies greatly between each of the particles.

Further, by the use of ozone and UV-rays for the removal of the dispersant, the following effects can also be obtained.

That is, in a case of using ozone and UV-rays for the removal of the dispersant, the dispersant is usually decomposed to a low molecular weight compound (for example, carbon dioxide, water, nitrogen, etc.) (into low molecular weight). Therefore, the decomposing product of the dispersant evaporates easily and undesired effects caused by the residue of the decomposition product less occur in the finally obtained toner.

Further, the dispersant has a function of improving the dispersibility of the dispersoid in the liquid dispersion and it is usually localized near the surface of the dispersoid. That is, the concentration of the dispersant (existence probability) is higher near the surface of the dispersoid compared with the concentration inside the dispersant or in the dispersion medium. Accordingly, by applying ozone and irradiating UV-rays to the discharged product (agglomerate, etc. as an assembly of a plurality of dispersoids), the dispersant localized near the surface of the dispersoid (dispersoid constituting the discharged product) can be decomposed and removed selectively to prevent degradative decomposition of the toner constituent materials (ingredients to be contained in the toner) for constituting the dispersoid easily and reliably.

Further, ozone is a highly reactive substance and can decompose and remove the dispersant with an extremely small amount and, on the other hand, has low chemical stability in a usual circumstance. Accordingly, even when ozone that could not contribute to the decomposition and removal of the dispersant should be leaked to the outside of the toner manufacturing apparatus, the amount can be minimized and, since this is chemically changed to a substance of high safety (oxygen) in a relatively short time, it extremely reduces the possibility of undesired effects on human bodies, environments, etc.

Further, the effect as in the invention can not be obtained in a case of conducting only one of application of ozone or irradiation of UV-rays without combined use of the application of ozone and irradiation of UV-rays. That is, in a case of conducting only one of application of ozone and irradiation of UV-rays, it may be difficult to sufficiently remove the dispersant. Further, while the ozone application condition (for example, partial pressure, temperature and application time, etc. of ozone) or UV-ray irradiation condition (for example, irradiation intensity, irradiation time, wavelength, etc. of UV-rays) may also be controlled with an aim of improving the removal ratio of the dispersant, selective removal of the dispersant is difficult in such a case, and the constituent material for the toner (ingredient to be contained in the toner) is degraded and decomposed, and the property of the obtained toner can not be made excellent sufficiently.

Particularly, in this embodiment, after removing the dispersion medium 62 from the discharged product (liquid dispersion 6), ozone is applied and UV-rays are irradiated in the step of joining a plurality of dispersoids constituting the discharged product (agglomerate 90), that is, the joining treatment, the ozone application treatment, and the UV-ray irradiation treatment are conducted in one identical step. Thus, the energy of UV-rays and ozone can be utilized efficiently for the decomposition and removal of the dispersant. That is, while the transmittance of the UV-rays in a medium such as water used as the dispersion medium 62 is relatively low, since the content of the ingredient used as the dispersion medium 62 such as water (particularly, content near the surface of the dispersoid 61 constituting the agglomerate 90 or the joined product on which the dispersant is deposited) is lowered in the agglomerate 90 or the joined product, the energy of the UV-rays can be utilized at a high efficiency for the decomposition and removal of the dispersant and, as a result, the irradiation intensity of the UV-rays to be irradiated can be made relatively weak, or the irradiation time of the UV-rays can be shortened. Further, in the same reason as described above, by conducting the joining treatment and the ozone application treatment in one identical step, ozone can be utilized more efficiently for the decomposition and removal of the dispersant and, as a result, the amount of ozone to be used can be decreased further. Accordingly, the manufacturing cost of the toner can be decreased. Further, in a case of decomposing and removing the dispersant by the irradiation of UV-rays, heat of reaction is generally generated. Accordingly, with the constitution as in this embodiment, the heat of reaction can be effectively utilized for the joining of the dispersoid 61. Further, since the ozone reactivity increases as the temperature is higher, the amount of ozone to be used can be decreased further by the heat of reaction in view of the foregoing, the toner manufacturing cost can be decreased further and this is effective also with a view point of energy saving.

Further, by decomposing the dispersant by conducting the UV-ray irradiation treatment and ozone application treatment in one identical step as in this embodiment, consumed ozone can be regenerated at a high efficiency. That is, ozone is usually decomposed per se by the decomposing reaction of the dispersant to generate oxygen ($O_2$), etc. since the ozone application treatment and the UV-ray irradiation treatment are conducted in one identical step, a portion of the energy of the irradiated UV-rays (energy of UV-rays not used for the removal of the dispersant) can be utilized for generation of ozone from oxygen ($O_2$). As a result, the energy of UV-rays can be used directly for the decomposition of the dispersant, and also can be utilized indirectly by the generation of ozone.

As described above, by conducting the ozone application treatment (ozone application step) and the UV-ray irradiation treatment (UV-ray irradiation step) in one identical step, the synergistic effect as described above can be provided more remarkably.

Ozone is supplied by the ozone applying device 12 into the transport portion 3 and applied to the agglomerate 90 in the second region 33.

The ozone applying device 12 has a jetting port 121 for jetting ozone in the direction opposed to the transporting direction of the discharged product (liquid dispersion 6, agglomerate 90). Then, ozone is jetted at a pressure higher than the pressure in the transport portion 3 from the jetting port 121. With such a constitution, ozone can be applied efficiently to the agglomerate 90 (discharged product) and, as a result, the amount of ozone to be used can be decreased.

Further, ozone used in the invention may be any form, for example, a gaseous state, a solution state (for example, aqueous solution ozone), etc. and the gaseous form is preferred. This can apply ozone in a homogeneous state more reliably to each discharged product (agglomerate 90). As a result, the finally obtained toner is less varied in view of the property between each of the particles (toner particles) to improve the reliability for the entire toner.

Further, ozone supplied into the transport portion 3 may be supplied as a substantially elemental ozone (ozone as pure substance) or as a mixture containing other ingredients than ozone and the ozone reactivity can be controlled more reliably by supplying ozone as a mixture.

The concentration of ozone in the region of conducting the ozone application step (second region 33) is, preferably, from 0.1 to 500 ppm, more preferably, 0.5 to 100 ppm, further preferably, from 1 to 50 ppm. In a case where the concentration of ozone is within the range of the values as described above, the dispersant can be decomposed and removed more efficiently while reliably preventing the degradation of the constituent ingredients for the toner (particularly, binder resin, etc.). On the other hand, in a case where the concentration of ozone is less than the lower limit value, it takes a longer time required for removing the dispersant to lower the toner productivity. Further, this results in enlargement for the toner manufacturing apparatus. Further, in a case where the concentration of ozone exceeds the upper limit value, the selective decomposition and removal of the dispersant may be difficult depending on the temperature of the region for conducting ozone application step (second region 33) to possibly cause degradation of the constituent material for the toner, etc.

The exposure time of the discharged product (agglomerate 90, toner particle 9) to ozone is, preferably, from 0.1 to 60 min, more preferably, from 0.1 to 30 min and, further preferably, from 0.1 to 10 min. In a case where the exposure time to ozone is within the range of the values as described above, the dispersant can be decomposed and removed more efficiently while reliably preventing the degradation of the constituent ingredients for the toner (particularly, binder resin, etc.). On the contrary, in a case where the exposure time to ozone is less than the lower limit value as described above, sufficient decomposition and removal of dispersant may possibly be difficult depending on the content and the kind of the dispersant, etc. Further, in a case where exposure time to ozone exceeds the upper limit value, this may possibly degrade the constituent ingredients for the toner (particularly, binder resin, etc.), etc. depending on the content and the kind of the dispersant.

Further, the UV-rays may be irradiated by a UV-ray irradiating device (optical source) 17 to the discharged product transported in the transport portion 3, particularly, discharged product transported to the second region 33.

The peak wavelength of UV-rays irradiated to the discharged product (wavelength showing the highest irradiation intensity in the irradiation spectrum of UV-rays) is different depending on the composition of the ingredients to be contained in the final toner (binder resin), etc., and, it is, preferably, from 100 to 400 nm, more preferably, from 150 to 350 nm and, further preferably, from 250 to 300 nm. In a case where that wavelength of UV-rays is within the values described above, the dispersant can be decomposed more efficiently while reliably preventing degradation of the constituent ingredients for the toner (particularly, binder resin, etc.). On the contrary, in a case where the peak wavelength of the UV-rays is less than lower limit value, this may possibly cause degradation of the constituent ingredients for the toner (particularly, binder resin, etc.) depending on the content, the kind, etc. of the dispersant. Further, in a case where the peak wavelength of the UV-rays exceeds the upper limit value, it may be possibly difficult to sufficiently decompose and remove the dispersant depending on the content and the kind, etc. of the dispersant.

Further, as described above, the peak wavelength of the UV-rays is different depending on the composition of the ingredients to be contained in the final toner (particularly, binder resin). For example, in a case the binder resin for the toner to be manufactured mainly comprises a polyester resin, the peak wavelength of the UV-rays to be irradiated is, preferably, from 200 to 400 nm, more preferably, from 250 to 400 nm and, further preferably, from 300 to 400 nm. This can efficiently decompose and remove the dispersant while effectively preventing degradation or decomposition of the binder resin contained in the liquid dispersion 6. Further, in a case where the binder resin for the toner to be manufactured mainly comprises a styrene-acrylate ester copolymer, the peak wavelength of the UV-rays to be irradiated is, preferably, from 200 to 400 nm, more preferably, from 220 to 400 nm and, further preferably, from 250 to 400 nm. This can efficiently decompose and remove the dispersant while effectively preventing degradation or decomposition of the binder resin contained in the liquid dispersion 6.

Further, the irradiation time of the UV-rays is, preferably, from 0.01 to 60 min, more preferably, from 0.1 to 10 min and, further preferably, from 0.5 to 4 min. In a case where the irradiation time of the UV-rays is within the range of the values described above, the dispersant can be decomposed efficiently while preventing degradation of the constituent ingredients for the toner (particularly, binder resin, etc.) more reliably. On the contrary, in a case where the irradiation time of the UV-rays is less than the lower limit described above, sufficient decomposition and removal of the dispersant may possibly be difficult depending on the content, kind, etc. of the dispersant. In a case where the irradiation time of the UV-rays exceeds the upper limit value, this may possibly degrade the constituent ingredients for the toner (particularly, binder resin, etc.) depending on the content, the kind, etc. of the dispersant.

Further, the UV-rays may be irradiated continuously or intermittently (discontinuously).

The inner wall surface of the housing 31 constituting the transport portion 3 (particularly, inner wall surface for a portion constituting the second region 33) is preferably made of a material having high reflectance to UV-rays (UV-ray reflection material). Such material includes, for example, polycarbonate and titanium oxide. In a case where the inner wall surface of the housing 31 constituting the transport portion 3 (particularly, the inner wall surface for the portion constituting the second region 33) is constituted with a material described above, the UV-rays emitted from the UV-ray irradiating device 12 can be irradiated efficiently to the discharged product (agglomerate 90, joined product, liquid dispersion 6 in the droplet) and the dispersant can be removed more efficiently. In the same manner, also the surface of the head 2 on the side providing with the discharge portion (exit port) 23 of the head may also be made of the same material as described above. This provides the effect described above more remarkably. Further, by forming the inner wall surface for the region to be irradiated with the UV-rays among the inner wall surface of the housing 31 (second region 33 in this embodiment) with a material of high reflectance to UV-rays (UV-ray reflection material) and forming the inner wall surface in other regions than described above with a material of low reflectance to the UV-rays, control for the irradiation time, etc. of the UV-rays relative to the discharged product can be controlled more reliably.

With an aim of keeping the temperature for the first region 32 and the second region 33 within a predetermined range, a heating source or a cooling source may be disposed to the inside or the outside of the housing 31 (first region 32, second region 33), or the housing 31 may be a jacket in which a flow channel for heat medium or cooling medium is formed.

Further, pressure in the housing 31 (first region 32, second region 33) is adapted to be controlled, for example, by the amount of a gas supplied from the gas flow supplying device 10 and the amount of gas (ozone-containing gas) supplied by the ozone applying device 12 described above and the suction amount of an ozone recovering device 14 to be detailed later. By controlling the pressure in the housing 31 as described above, the agglomerate 90 and the toner particles 9 can be formed efficiently and, as a result, the toner productivity is improved.

While the pressure in the housing 31 is not particularly limited, it is, preferably, 150 kPa or less, more preferably, from 100 to 120 kPa and, further preferably, from 100 to 110 kPa. In a case where the pressure in the housing 31 is within the range of the values described above, sudden removal of the dispersion medium 62 from the discharged product (bumping) and the like can be prevented effectively and toner particle 9 can be manufactured more efficiently while preventing formation of irregularly shaped toner particle 9 sufficiently. The pressure in the housing 31 may be substantially identical for each of the portions or may be different for each of the portions. For example, it may be constituted such that the pressure is different between the first region 32 and the second region 33.

Further, a voltage applying device 8 is connected to the housing 31 for applying a voltage. Application of a voltage at a polarity identical with that of the granular discharged product (liquid dispersion 6, agglomerate 90) to the inner surface of the housing 31 by the voltage applying device 8 can provide the following effects.

Usually, a toner particle or agglomerate 90 as an intermediate product for the manufacture thereof are charged positively or negatively. Accordingly, in a case where a charged material charged to a polarity different from the agglomerate 90 is present, the agglomerate 90 is electrostatically attracted and deposited to the charged material. On the other hand, in a case where a charged product charged to the polarity identical with the agglomerate 90 is present, the charged product and the agglomerate 90 repel to each other and the agglomerate 90 is prevented from depositing to the surface of the charged product. Therefore, by applying a voltage at a polarity identical with that of the granular discharged product (liquid dispersion 6, agglomerate 90) is applied to the inner surface of the housing 31, deposition of the discharged product (liquid dispersion 6, agglomerate 90) to the inner surface of the housing 31 can be prevented effectively. This can effectively prevent formation of irregularly shaped toner particle, as well as improve the recovery efficiency of the toner particle 9.

Further, the housing 31 has a diametrically reduced portion 311 which decreases the inner diameter downward (downstream in the transporting direction of the discharged product) in FIG. 1 on the side of the recovery portion 5 (downstream in the transporting direction of the discharged product). Provision of the diametrically reduced portion 311 enables efficient recovery of the toner particle 9. As described above, while the liquid dispersion 6 discharged from the discharge portion 23 (discharged product) is formed by way of the agglomerate 90 into the toner particle 9 in the transport portion 3, formation of such toner particle 9 is substantially completed near the diametrically reduced portion 311 and a problem such as agglomeration scarcely occurs even when particles are in contact with each other.

Then, the toner particle 9 formed as described above is introduced together with unreacted ozone, etc. into a cyclone 15. The cyclone 15 is connected to the recovering portion 5, and also to an ozone recovering device 14 by way of a bag filter 16 for preventing suction of the toner particle 9, etc. This can efficiently recover the manufactured toner particle 9 by the recovery portion 5, and recover the unreacted ozone efficiently by the ozone recovering device 14, particularly, recover the same while preventing leakage to the outside of the apparatus sufficiently. The ozone recovered by the ozone recovering device 14 is sent, for example, by way of a tubular member not illustrated into the ozone applying device 12 which can be utilized for the ozone application treatment (ozone application step), etc. As described above, since the toner manufacturing apparatus 1 of this embodiment has a constitution of recovering the unreacted ozone, ozone can be utilized efficiently for the manufacture of the toner.

For the toner obtained as described above, various treatments such as a heat treatment may be optionally applied. This can proceed joining of dispersoids constituting the toner particle 9 to render the mechanical strength (mechanical stability) of the toner particle 9 more excellent and can reduce the water content contained in the toner particle 9. The water content contained in the toner particle 9 can be lowered in the same manner as described above also by applying a treatment such as aeration to the obtained toner or leaving the toner in a reduced pressure atmosphere.

Further, various treatments such as classification and external addition may optionally be applied to the toner described above.

For the classification, sieves, gas stream type classifier, etc. can be used.

Further, external additives used for external addition include, for example, fine particles constituted with inorganic materials, for example, metal oxides such as silica, aluminum oxide, titanium oxide, strontium titanate, cerium oxide, magnesium oxide, chromium oxide, titania, zinc oxide, alumina, and magnetite, fine particles constituted with inorganic materials, for example, nitrides such as silicon nitride, carbides such as silicon carbides, calcium sulfate, calcium carbonate, and aliphatic metal salts (inorganic fine particles), fine particles constituted with organic materials, for example, acrylic resin, fluoro resin, polystyrene resin, polyester resin, and aliphatic metal salts (organic fine particles), as well as fine particles comprising composite products thereof (composite fine particles). The fine composite particles include, for example, those fine particles formed by coating the fine particles (granular product) comprising the inorganic material described above with a coating layer comprising the organic material described above, or fine particles formed by providing the fine particles (granular product) comprising the organic materials with a coating layer comprising the inorganic material described above.

Further, as the external additives, those applied with the surface treatment by HMDS, silane coupling agent, titanate coupling agent, fluorine-containing silane coupling agent, and silicone oil on the surface thereof may also be used.

The toner according to the first embodiment of the invention manufactured as described above has a uniform shape and a sharp (narrow range) grain size distribution. Particularly, a toner particle of a shape approximate to a true sphere can be obtained in the invention.

Specifically, the toner (toner particle) has an average circularity R represented by the following formula (I) of, preferably, 0.95 or more, more preferably, 0.96 or more, further preferably, 0.97 or more and, most preferably, 0.98 or more. In a case where the average circularity R is 0.95 or more, the toner transfer efficiency becomes further excellent.

$$R=L_0/L_1 \quad \text{(I)}$$

(where $L_1$ [μm] represents a peripheral length of a projected image of a toner particle as an object of measurement and $L_0$ [μm] represents a peripheral length of a true circle (complete geometrical circle) having an area equal with the area of the projected image of the toner particle as an object of measurement).

Further, the toner has a standard deviation of the average circularity between each of the particles (toner particles) of, preferably, 0.02 or less, more preferably, 0.015 or less and, further preferably, 0.01 or less. In a case where the standard deviation of the average circularity between each of the particles is 0.02 or less, variation for charging property and fixing property is particularly decreased and the reliability for the entire toner is improved further.

The average grain size on the weight base of the toner obtained as described above is, preferably, from 2 to 20 μm and, more preferably, from 4 to 10 μm. In a case where the average grain size of the toner is less than the lower limit value, it is difficult for uniform charging, and adhesion to the surface of an electrostatic latent image carrier (for example, light sensitive body) increases to sometimes result in increase of a residual toner after transfer. On the other hand, in a case where the average grain size of the toner exceeds the upper limit value, the reproducibility in development for the profile portion of the image formed by using the toner, particularly, character images or light pattern is lowered.

The toner has a standard deviation of the grain size between each of the particles (toner particles) of, preferably, 1.5 μm or less, more preferably, 1.3 μm or less and, further preferably, 1.0 μm or less. In a case where the standard deviation of the grain size between each of the particles is 1.5 μm or less, variation for the charging property, the fixing property, etc. is particularly decreased and the reliability for the entire toner is further improved.

While the water containing amount (water content) of the toner particle 9 is not particularly limited, it is, preferably, 5 wt % or less, more preferably, from 0.01 to 4 wt % and, further preferably, from 0.02 to 1 wt %. In a case where the water content in the toner particle 9 is excessive, this may possibly result in a problem that charging becomes instable. Further, in a case where the water content in the toner particle 9 is extremely decreased, this tends to degrade or denature the constituent material for the toner, it is not preferred to decrease the water content than required.

Second Embodiment

Then, the second embodiment of the invention is to be described. For this embodiment, description is to be made mainly for the difference from the previous embodiment, while saving the description for identical matters.

Figure 3:
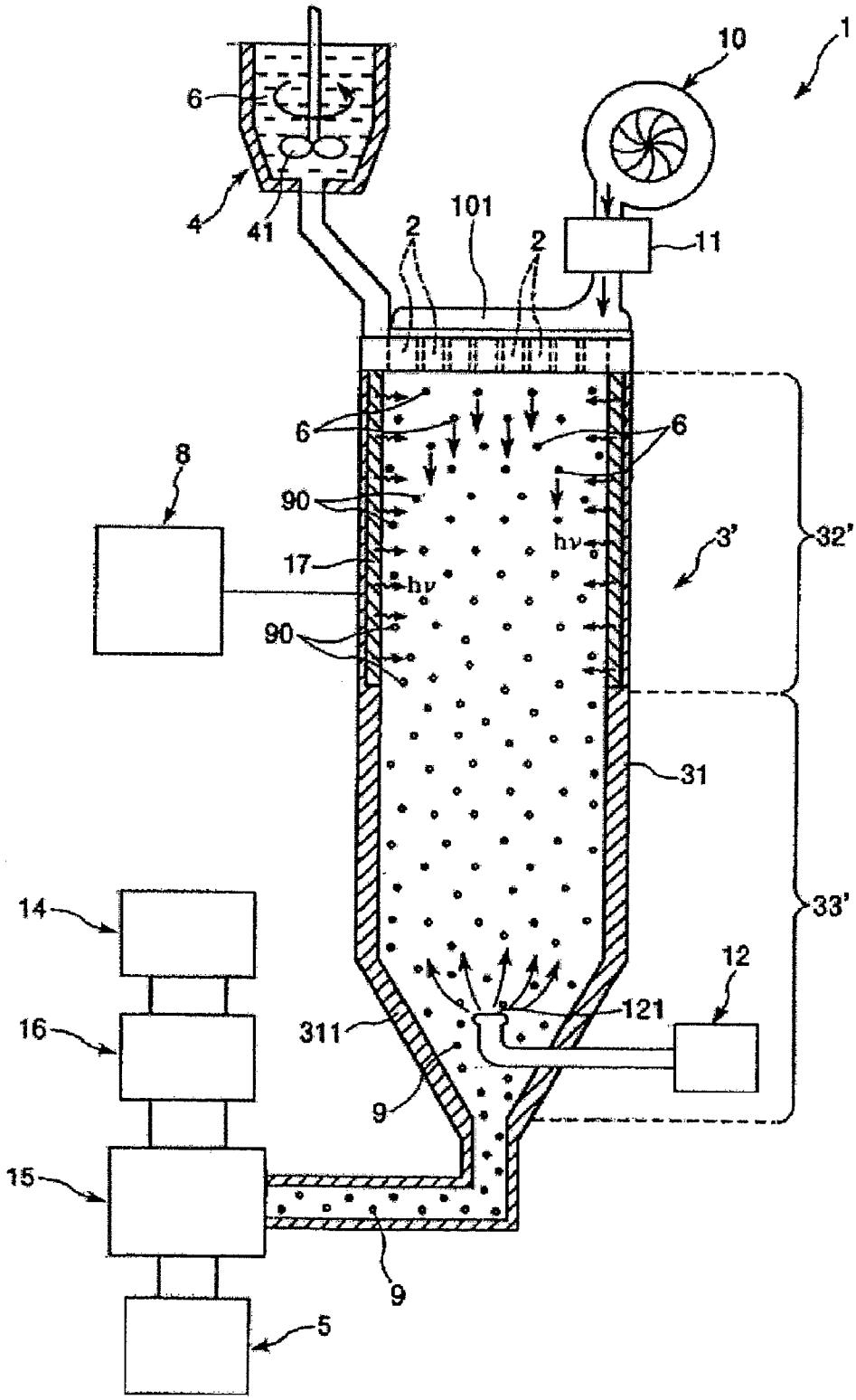
FIG. 3 is a vertical cross sectional view schematically showing a second embodiment of a toner manufacturing apparatus used for the manufacture of a toner according to the invention.

FIG. 3 is a vertical cross sectional view schematically showing a second embodiment of a toner manufacturing apparatus used in the manufacture of a toner according to the invention.

A toner manufacturing apparatus 1' of this embodiment has a first region 32' for removing a dispersion medium 62 from a liquid dispersion 6 in a droplet form to obtain an agglomerate 90 (conducting dispersion medium removing step) and irradiating UV-rays to a discharged product (liquid dispersion 6, agglomerate 90) (conducting UV-ray irradiation step) and a second region 33' for joining a plurality of dispersoids constituting the agglomerate 90 (conducting joining step) and applying ozone to the agglomerate 90 (conducting ozone application step). That is, this embodiment is identical with the first embodiment described above except for conducting the UV-ray irradiation treatment (UV-ray irradiation step) in the first region of conducting the dispersion medium removing step (dispersion medium removing treatment) not in the second region for conducting the joining step (joining treatment). Further, the toner manufacturing apparatus of this embodiment is identical with the first embodiment excepting that the UV-ray irradiating device is disposed so as to irradiate UV-rays to the first region. As described above, in the invention, ozone application (ozone application treatment) and UV-ray irradiation (UV-ray irradiation treatment) may be conducted in different steps. This enables to increase the reactivity of the dispersant previously by either one of the treatments and then perform the decomposing reaction effectively by the succeeding treatment to further improve the removing efficiency of the dispersant. Further, the constitution described above can extend the contact time longer between the discharged product (liquid dispersion 6, agglomerate 90) and ozone compared with the embodiment described previously. As a result, ozone can be utilized efficiently for the removal of the dispersant. Further, as described above, ozone is a material of relatively low chemical stability. Accordingly, by making the contact time longer between the discharged product and ozone, ozone can be utilized (consumed) efficiently in the transport portion 3' and leakage of the ozone to the outside of the apparatus can be prevented more reliably. Further, by applying ozone to the discharged product (particularly, liquid dispersion 6 containing the dispersion medium 62) in the first region 32' contact of the constituent material for the toner (ingredient to be contained in the toner) with ozone can be prevented effectively. As a result, the finally obtained toner has higher reliability. In the foregoing, while it has been described that the ozone application treatment and the UV-ray irradiation treatment are conducted in the steps different from each other, the ozone application treatment and the UV-ray irradiation treatment may be conducted while being partially overlapped with each other.

Third Embodiment

Then, a third embodiment of the invention is to be described. For this embodiment, description is to be made mainly for the difference from the previous embodiment, while saving the description for identical matters.

Figure 4:
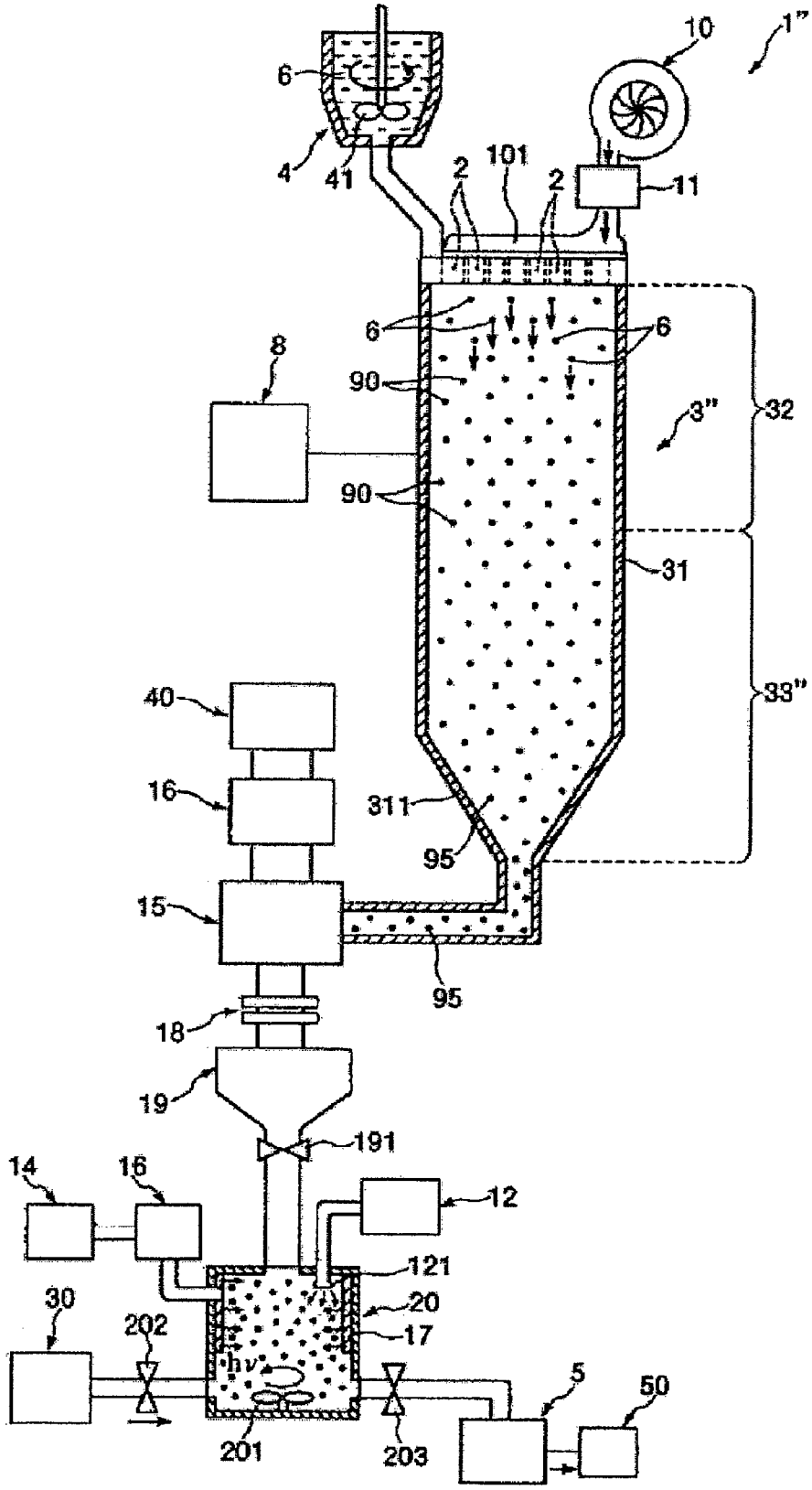
FIG. 4 is a vertical cross sectional view schematically showing a third embodiment of a toner manufacturing apparatus used for the manufacture of a toner according to the invention.

FIG. 4 is a vertical cross sectional view schematically showing a third embodiment of a toner manufacturing apparatus used in the manufacture of a toner according to the invention.

A toner manufacturing apparatus 1" has a transport portion 3" having a first region 32 for removing a dispersion medium 62 from a liquid dispersion 6 in a droplet form (conducting dispersion medium removing step) to obtain an agglomerate 90 and a second region 33" for joining a plurality of dispersoids constituting the agglomerate 90 (conducting joining step) to obtain a joined product, a joined product containing portion 19 for containing (storing) the joined product 95, and an ozone/UV-ray treatment portion 20 applying ozone application and UV-ray irradiation to the joined product 95. That is, in the toner manufacturing apparatus 1" of this embodiment, the ozone application and the UV-ray irradiation are conducted at the outside of the transport portion 3".

Further, in the toner manufacturing apparatus 1" of this embodiment, a cyclone 15 is connected by way of a double dumper 18 to the joined product containing portion 19 and also connected to an exhausting device 40 by way of a bag filter 16 for preventing sucking of toner particles 9, etc. With such a constitution, the transporting speed of the discharged product in the transport portion 3" can be controlled preferably to send the manufactured joined product 95 to the joined product store portion 19 efficiently.

The joined product 95 discharged from the cyclone 15 is supplied by way of the double dumper 18 to the joined product store portion 19 and stored in the joined portion store portion 19. Then, after a predetermined amount of joined product 95 is stored in the joined product store portion 19, a closed valve 191 is opened to supply the joined product 95 in the joined product store portion 19 to an ozone/UV-ray treatment portion 20. Then, the valve 191 is closed again and then a predetermined amount of ozone is supplied from the ozone applying device 12 while rotating a stirring device (propeller) 201 in the ozone/UV-ray treatment portion 20, and UV-rays at a predetermined wavelength and at a predetermined intensity are irradiated from the UV-ray irradiating device 17. Then, the dispersant deposited to the joined product 95 is decomposed and removed to form a toner particle 9. As described above, in this embodiment, ozone application and UV-ray irradiation are conducted batchwise to the once recovered (stored) predetermined amount of the joined product 95. This can provide the synergistic effect between the ozone application and the UV-ray irradiation described above more remarkably. Referring more specifically, the constitution as in this embodiment can decrease the amount of ozone to be supplied and the amount of total energy in a case of manufacturing a predetermined amount of the toner. Further, since the ozone supplied from the ozone applying device 12 can be provided efficiently to the joined product 95 and UV-rays from the UV-ray irradiating device 17 can be irradiated to the joined product 95 efficiently, this is excellent also in view of the resource saving or energy saving and improvement for the life of constituent members of the toner manufacturing apparatus. Further, in this embodiment, since ozone is supplied and UV-rays are irradiated while stirring the joined product 95, ozone can be applied more uniformly and UV-rays can be irradiated more uniformly over the entire outer surface of the joined product 95. As a result, the reliability of the finally obtained toner is further improved. Further, ozone may be supplied into the ozone/UV-ray treatment portion 20 continuously or not continuously during the ozone/UV-ray treatment (ozone application treatment and UV-ray irradiation treatment). For example, ozone may be supplied at the initial stage of the ozone/UV-ray treatment and then the supply of ozone is interrupted, or supply and the interruption of ozone may be conducted repetitively. Further, in the same manner, UV-rays may be irradiated into the ozone/UV-ray treatment portion 20 continuously or not continuously during the ozone/UV-ray treatment (ozone application and UV-ray irradiation). For example, UV-rays may be irradiated at the initial stage of ozone/UV-ray treatment and then irradiation of the UV-rays is not conducted, or irradiation of UV-rays and interruption for the irradiation of UV-rays may be conducted repetitively.

After conducting treatment with ozone and UV-rays for a predetermined period of time, an ozone recovering device 14 is driven in a state of interrupting the supply of ozone and irradiation of UV-rays. Then, ozone in the ozone/UV-ray treatment portion 20 is recovered. Since the bag filter 16 is located between the ozone recovering device 14 and the ozone/UV-ray treatment portion 20, sucking of the manufactured toner particle 9 can be prevented effectively. When the ozone is recovered by the ozone recovering device 14, external air may be introduced into the ozone application treatment portion 20, for example, by opening a valve not illustrated located in the ozone application treatment portion 20 to control the inner pressure of the ozone application treatment portion 20.

Then, driving of the ozone recovering device 14 is interrupted, an injection valve 202 and a transport valve 203 are opened to generate a gas stream from the injection valve 202 to the transport valve 203 and the toner particle 9 in the ozone/UV-ray treatment portion 20 is sent to the recovery portion 5. The gas stream in the ozone/UV-ray treatment portion 20 (gas stream from the injection valve 202 to the transport valve 203) can be formed, for example, by sending a gas from a gas supplying device 30 disposed on the side of the injection valve 202 into the ozone/UV-ray treatment portion 20, or exhausting a gas into the ozone/UV-ray treatment portion 20 by an exhausting device 50 disposed on the side of the transport valve 203. A filter (not illustrated) is located between the gas supplying device 30 and the ozone/UV-ray treatment portion 20 for preventing intrusion of obstacles. Further, a filter (not illustrated) is located between the exhausting device 50 and the recovery portion 5 for preventing sucking of toner particle.

While the invention has been described with reference to preferred embodiments, the invention is not restricted to them.

For example, each of the portions constituting the toner manufacturing apparatus may be replaced with optional portions that provide similar functions, or other constitution may also be added.

Further, while it has been described for the first and the second embodiments that ozone is jetted (supplied) in the direction opposite to the transporting direction of the discharged product (liquid dispersion, agglomerate), the direction of jetting (supplying) ozone is not limited to such a direction.

Further, while it has been described for the embodiment above that ozone is supplied (jetted) from one jetting port (supply port), it may be supplied from two or more jetting ports (supply ports). For example, ozone may also be supplied in the first region and the second region respectively. Further, ozone may be supplied also into the transport portion in addition to the ozone application treatment portion as described in the third embodiment.

Further, while it has been described for the first and the second embodiments that the UV-rays are irradiated to the discharged product (liquid dispersion, agglomerate) in the second region of the transport portion, it may be constituted, for example, that the UV-rays are irradiated to the discharged product (liquid dispersion, agglomerate, etc.) substantially over the entire length of the transport portion. Further, the toner manufacturing apparatus may have a plurality of UV-ray irradiating devices. For example, the toner manufacturing apparatus may have a first UV-ray irradiating device for irradiating UV-rays to the discharged product in the first region and a second UV-ray irradiating device for irradiating UV-rays to the discharged product in the second region.

Further, while it has been described for the embodiments described above that the dispersion medium removing treatment (dispersion medium removing step), ozone application treatment (ozone application step), UV-ray irradiation treatment (UV-ray irradiation step), and joining treatment (joining step) are conducted continuously by using one identical apparatus, at least one of the treatments may be conducted in separate apparatus. For example, an agglomerate obtained by removing a dispersion medium from a liquid dispersion discharged in a fine particle form may be recovered once and then the ozone application treatment and UV-ray irradiation treatment may be applied to the agglomerate by using other apparatus. In the same manner, dispersoids constituting the agglomerate (fine particle derived from dispersoids) may be joined into a joined product, which is once recovered and then ozone application treatment and UV-ray irradiation treatment may be applied to the joined product by using other apparatus. In the same manner, after once recovering the agglomerate applied with the ozone application treatment and UV-ray irradiation treatment, a joining treatment may be applied to the agglomerate by using other apparatus. Also in such cases, the same effects as described above can be obtained. Further, after once recovering agglomerate, etc. obtained as an intermediate product of the manufacturing step, a subsequent treatment may be conducted by using the same apparatus. Further, UV-rays may be irradiated while transporting the once recovered agglomerate, etc. by transporting device such as a belt conveyor.

Further, the ozone application step (ozone application treatment), and UV-ray irradiation step (UV-ray irradiation treatment) may also be conducted, for example, as a preceding step (pre-treatment) to the dispersion medium removing step (dispersion medium removing treatment). That is, after discharging the liquid dispersion, ozone may be applied and UV-rays may be irradiated to the discharged liquid dispersion before substantial removal of the dispersion medium (while maintaining under the condition by cooling or the like so that the dispersion medium is not removed substantially). Further, the ozone application step (ozone application treatment) and the UV-ray irradiation step (UV-ray irradiation treatment) may be conducted as an intermediate step (intermediate treatment) between the dispersion medium removing step (dispersion medium removing treatment) and the joining step (joining treatment).

While it has been described for the third embodiment described above that the toner manufacturing apparatus has a propeller as the stirring device, the stirring device is not restricted thereto and it may be a gas stream generating device for generating a gas stream. That is, the ozone/UV-ray treatment (ozone application treatment and UV-ray irradiation treatment) may be conducted, for example, by using a device for stirring the powdery product in a fluidized layer (in gas stream), that is, so-called aeration device or the like.

Figure 5:
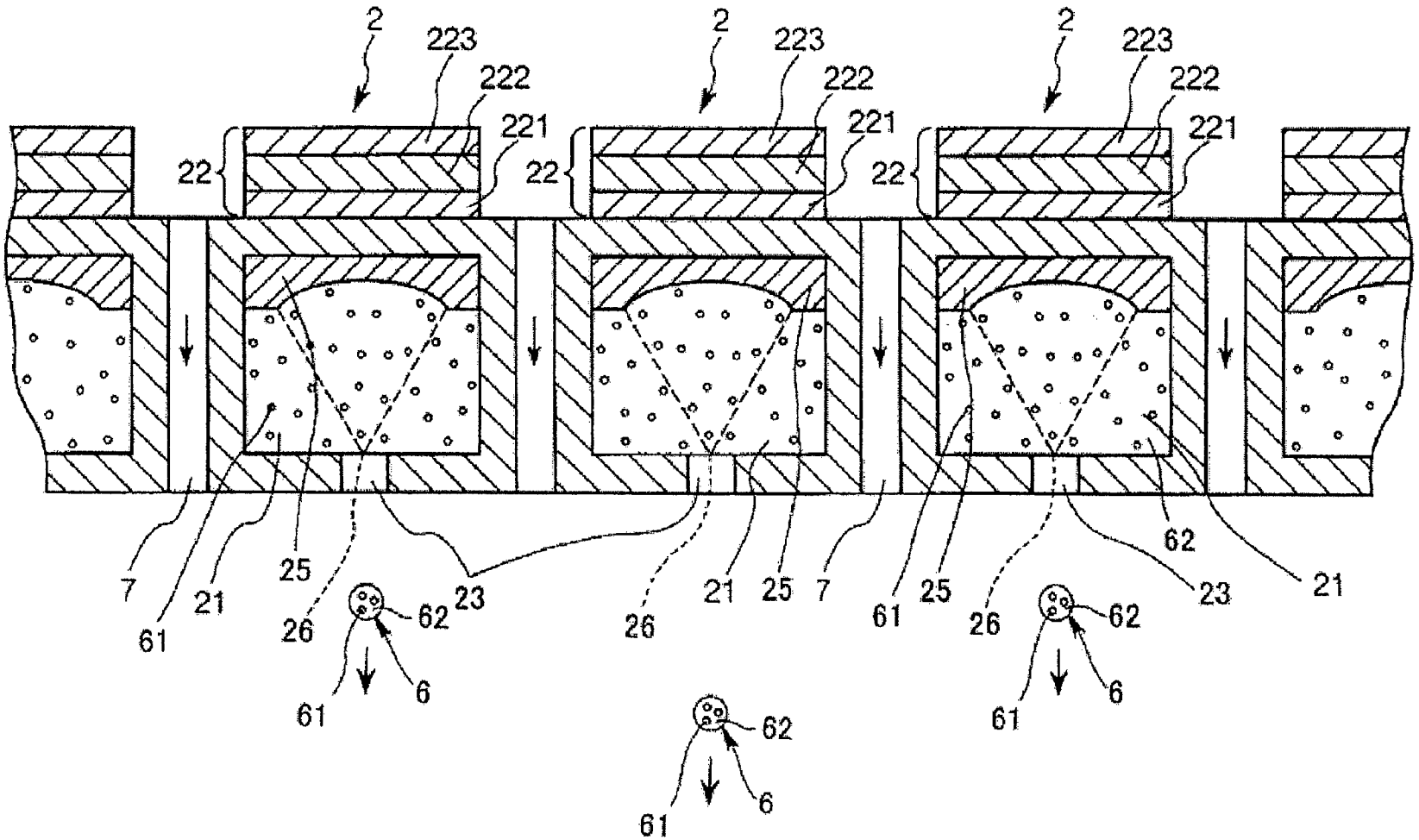
FIG. 5 is a view schematically showing another example of a structure near the head of a toner manufacturing apparatus.

Further, as shown in FIG. 5, an acoustic lens (concave lens) 25 may be disposed to a head 2. By the provision of the acoustic lens 25, pressure pulses (vibration energy) generated by the piezoelectric device 22 can be converged in a pressure pulse converging portion 26 near the discharge portion 23. As a result, the vibration energy generated from the piezoelectric device 22 can be utilized efficiently as energy for discharging the liquid dispersion 6. Accordingly, the liquid dispersion 6 stored in the liquid dispersion store portion 21 can be discharged reliably from the discharge portion 23 even when it has a relatively high viscosity. Further, since the liquid dispersion 6 stored in the liquid dispersion store portion 21 can be discharged as fine droplets even when it has a relatively large agglomerating effect (surface tension), the grain size of the toner particles 9 can be controlled to a relatively small value easily and reliably.

With the constitution as illustrated in the drawing, since toner particle 9 can be controlled to desired shape and size even in a case of using a material of higher viscosity or a material of large agglomerating effect as the liquid dispersion 6, the range for the selection of the materials is particularly extended to obtain a toner having a desired property further easily.

Further, in the constitution shown in the drawing, since the liquid dispersion 6 is discharged by the converged pressure pulse, the size of the discharged liquid dispersion 6 can be decreased relatively smaller even in a case where the area (opening area) of the discharging portion 23 is relatively large. That is, the area of the discharging portion 23 can be increased even in a case where the grain size of the toner particle 9 is decreased relatively. This can prevent occurrence of clogging, etc. in the discharge portion 23 more effectively even in a case where the liquid dispersion 6 has a relatively high viscosity.

The acoustic lens is not restricted to a concave lens and, for example, a Fresnel lens, electron scanning lens, or the like may also be used.

Figure 6:
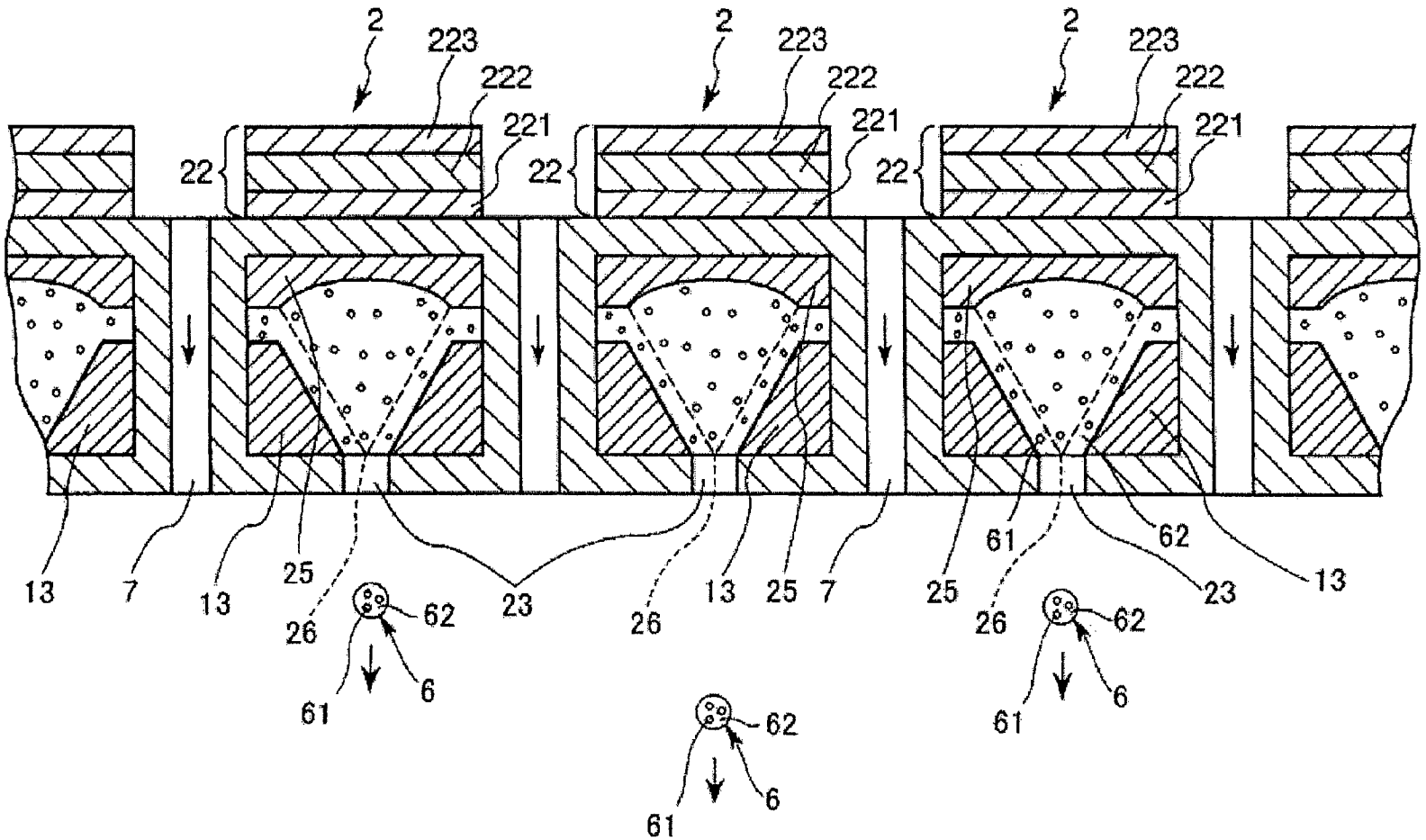
FIG. 6 is a view schematically showing a further example of a structure near the head of a toner manufacturing apparatus.
Figure 7:
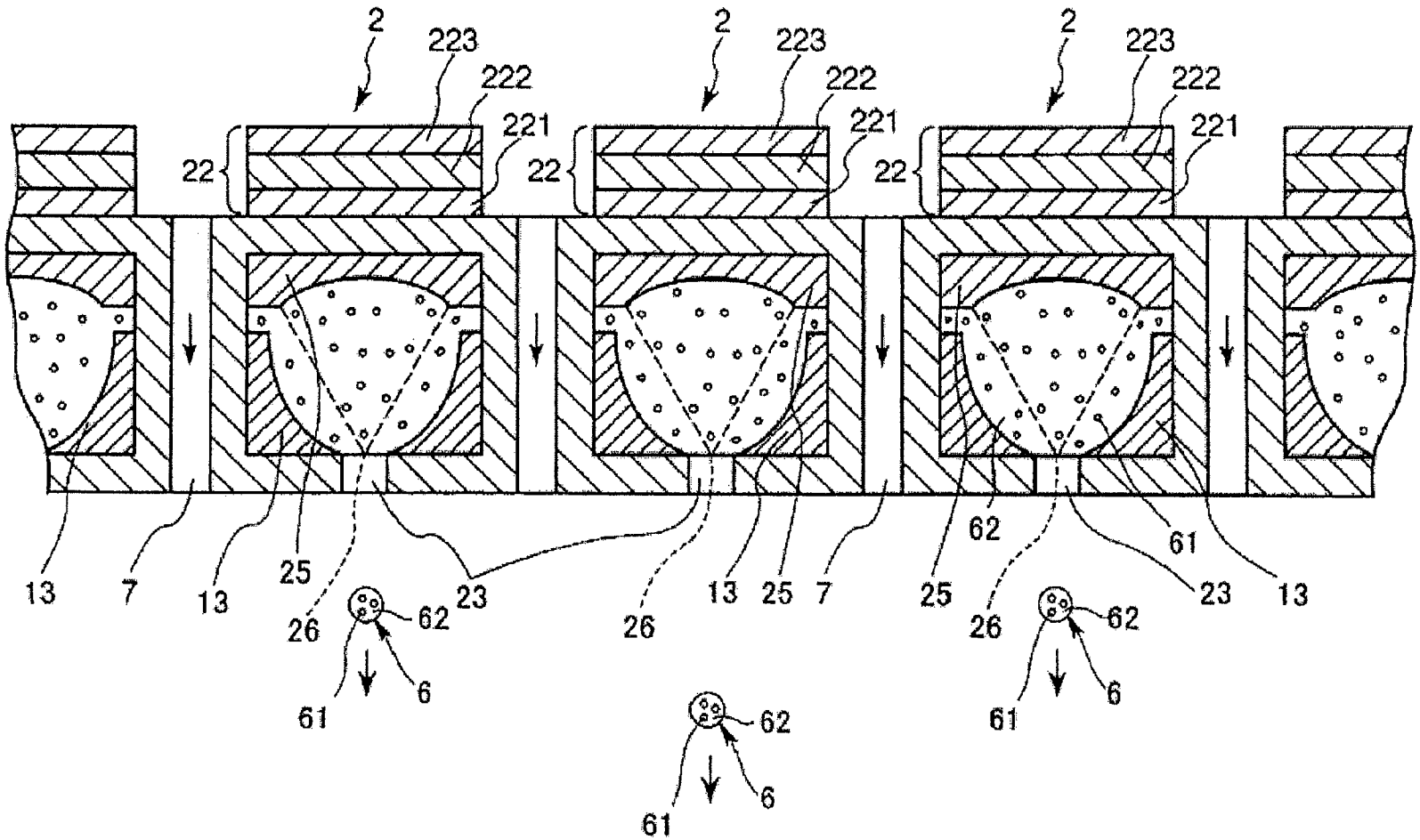
FIG. 7 is a view schematically showing a further example of a structure near the head of a toner manufacturing apparatus.
Figure 8:
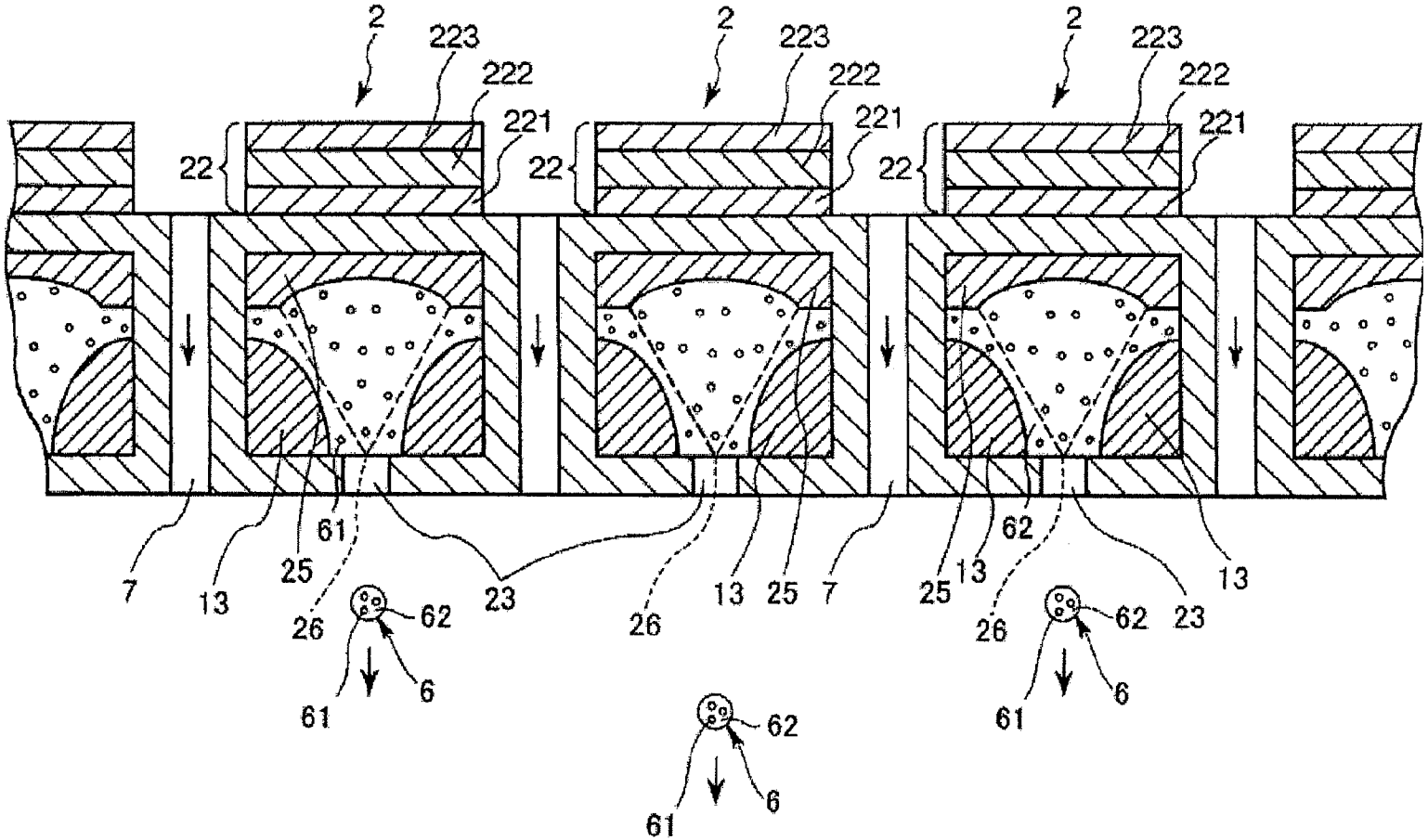
FIG. 8 is a view schematically showing a further example of a structure near the head of a toner manufacturing apparatus.

Further, as shown in FIG. 6 to FIG. 8, a restriction member 13 having a shape converging toward the discharge portion 23 may be located between the acoustic lens 25 and the discharged portion 23. This can assist the converging of the pressure pulse (vibration energy) generated from the piezoelectric device 22, and the pressure pulse generated from the piezoelectric device 22 can be utilized more efficiently.

Further, while it has been described for the previous embodiments that the constituent ingredients of the toner are contained in the dispersoid as the solid ingredient, at least a portion of the constituent ingredients for the toner may be contained in the dispersion medium.

Further, while it has been described for the previous embodiments that the liquid dispersion is discharged intermittently from the head by the piezoelectric pulse, other method may also be used for the discharging method (jetting method) of the liquid dispersion. For example, the method of discharging (jetting) the liquid dispersion usable herein includes a spray drying method, or a so-called bubble jet ("bubble jet" is a registered trade mark) method and, in addition, "method of using a nozzle of "urging a liquid dispersion by a gas stream to a flat and smooth surface into a thin layer stream, peeling the thin layer stream from the smooth surface and jetting the same as minute droplets to jet the liquid dispersion in droplet form as described in the specification of Japanese Patent Application No. 2002-321889", etc. The spray drying method is a method of jetting (spraying) a liquid (liquid dispersion) using a high pressure gas thereby obtaining droplets. Further, the method of applying the so-called bubble jet method ("bubble jet" is a registered trade mark) includes, for example, a method as described in the specification of Japanese Patent Application No. 2002-169348. That is, as a method of discharging (jetting) a liquid dispersion, "a method of intermittently discharging the liquid dispersion from the head by volumic change of the gas" can be applied.

While it has been described for the previous embodiments that the ozone is applied and UV-rays are irradiated during dispersion medium removing step and/or after dispersion medium removing step (after discharging the liquid dispersion as a discharged product in droplet form), the ozone may be applied and UV-rays may be irradiated not to the discharged product of the liquid dispersion but to the liquid dispersion in the container or vessel (ozone application and UV-ray irradiation may also be conducted batchwise). More specifically, ozone may be applied and the UV-rays may be irradiated to the liquid dispersion (for example, liquid dispersion containing dispersoid corresponding to the toner particle prepared by polymerization method or the like) in a container containing a dispersoid of a desired size (dispersoid controlled to a size corresponding to the mother particle of the toner to be manufactured). This decomposes and removes the dispersant in the liquid dispersion. As described above, when the dispersant is removed in the liquid dispersion in the container, the dispersoid can no more maintain the dispersed state but it settles or floats near the liquid surface, and particle corresponding to the toner particle (mother particle of the toner) can be obtained, for example, by filtration of the dispersoid. Then, various kinds of treatments such as drying may also be applied optionally. By adopting such a method, the toner can be manufactured efficiently by using an apparatus of more simple constitution (without using large-scaled apparatus).

Further, while the description has been made for the previous embodiments that the toner manufacturing apparatus according to the invention is used for manufacturing the toner per se, but this is not restrictive, and can be used for any apparatus usable for the preparation of the powder for manufacturing the toner. For example, the toner manufacturing apparatus of the invention may also be apparatus for manufacturing a powder to be a mother particle for the toner (toner mother particle manufacturing apparatus), apparatus for manufacturing an agglomerate formed by removing a dispersant from a liquid dispersion (agglomerate manufacturing apparatus), or apparatus for manufacturing a joined product formed by removing a dispersant from an agglomerate in which the dispersant has not yet been removed (joined product manufacturing apparatus).

EXAMPLE

1 Manufacture of Toner

Example 1

At first, a mixture of 200 parts by weight of a polyester resin (glass transition point Tg: 58.6° C., KOKA type flow tester softening temperature: 102.0° C., melting point: 243° C.) as a binder resin, 12 parts by weight of a phthalocyanine pigment (phtalocyanine blue manufactured by Dainichiseika Color & Chemicals Mfg. Co., Ltd.) as a colorant, and 3 parts by weight of Bontron E-84 (Orient Chemical Industries, Ltd.) as a charge controller was prepared.

On the other hand, a water solution (aqueous solution) formed by dissolving 30 parts by weight of sodium polyacrylate (manufactured by Wako Pure Chemicals Industries Ltd., average polymerization degree: n=2700 to 7500), and 0.5 parts by weight of sodium alkyl diphenyl ether disulfonate to 569.5 parts by weight of ion exchanged water was prepared.

Then, 600 parts by weight of the aqueous solution was charged in a 3 liter volume round bottomed stainless steel vessel and stirred at a number of rotation of 4000 rpm while heating at 100° C. 215 parts by weight of the mixture (mixture of polyester resin, colorant, and charge controller) was charged little by little into the aqueous solution in this state and, after completion of the charging of the mixture, stirred for further 5 min. Then, when it was cooled to a room temperature while continuing stirring, a liquid suspension of the binder resin in which solid dispersoid was dispersed (liquid dispersion) was obtained.

Then, deaeration was applied to the obtained liquid suspension of the binder resin (liquid dispersion). Deaeration was conducted by placing the liquid suspension of the binder resin (liquid dispersion) in the stirred state in an atmosphere at 14 kPa for 10 min. The atmospheric temperature during deaeration was 25° C. The concentration of the solid content (dispersoid) in the obtained liquid suspension of the binder resin (liquid dispersion) was 38 wt %. The viscosity of the liquid suspension of the binder resin (liquid dispersion) at 25° C. was 180 cps. The average grain size Dm of the dispersoid constituting the liquid suspension of the binder region was 0.5 μm. The average grain size of the dispersoid was measured by using a laser diffraction/variation type grain size distribution measuring apparatus (LA-700, manufactured by Horiba Ltd.)

The liquid dispersion (liquid suspension of the binder resin) after deaeration was charged in a liquid dispersion supply portion of a toner manufacturing apparatus as shown in FIG. 1 and FIG. 2. The liquid dispersion in the liquid dispersion supply portion was supplied while being stirred by a stirring device to a liquid dispersion store portion in a head by a metering pump and discharged from a discharge portion to a transport portion. The discharge portion was in a circular form of 25 μm in diameter. Further, a head applied with a hydrophobic treatment near the discharge portion by a fluoro resin (polytetrafluoroethylene) coating was used.

The liquid dispersion was discharged in a state of controlling the temperature for the liquid dispersion in the head at 40° C., the number of vibrations of a piezoelectric body at 30 kHz, an initial velocity of the liquid dispersion discharged from the discharge portion to 3 m/sec, and a discharged amount for one drop of the liquid dispersion discharged from the head to 4 pl (grain size Dd: 10 μm, weight: about 4 ng). The liquid dispersion was discharged such that the discharge timing of the liquid dispersion was displaced at least between adjacent heads among a plurality of heads.

Further, upon discharging the liquid dispersion, air at a temperature of 40° C. and a humidity of 27% RH, and at a flow rate of 3 m/sec was vertically jetted from a gas jetting port downward. The temperature in the housing (atmospheric temperature) was set such that a first region as a region on the side near the discharge portion was at 35 to 40° C. and a second region as a region near the recovery portion was at 70 to 75° C. The pressure in the housing was about 101 kPa. The length of the first region (length in the transporting direction) was 2 m and the length of the second region (length in the transporting direction) was 3 m. In the inner wall surface of the housing, a portion corresponding to the second region was formed of titanium oxide and other portions than described above were formed of a benzophenone derivative (UV-ray absorbent material). The inner diameter of the housing (inner diameter for portions excluding the diameter reduced portion) was 50 cm.

On the other hand, a gas mixture of ozone and nitrogen was jetted from a jetting port of an ozone applying device in a direction substantially opposite to the transporting direction of the liquid dispersion (discharged product) to supply ozone in the second region (refer to FIG. 1). The mixed gas (ozone) was jetted while controlling the ozone concentration in the second region to 10 ppm based on the result of detection by an ozone density sensor. Together with supply of ozone from the ozone applying device, UV-rays were emitted from a UV-ray irradiating device (UV-ray lamp) to irradiate UV-rays to the discharged product in the second region (refer to FIG. 1). The peak wavelength of UV-rays emitted from the UV-lamp was 300 nm. The lamp power of the UV-lamp was 0.5 kW. The irradiation time of UV-rays to each discharged product (processing time) and exposure time of each discharged product to ozone (processing time) was 0.5 min.

As a result, the liquid dispersion in droplet form discharged into the transport portion was removed with the dispersion medium in the first region to form an agglomerate in which a plurality of dispersoids were agglomerated (dispersion medium removing step). Then, the agglomerate was successively transported to the second region, in which a plurality of dispersoids constituting the agglomerate were joined, ozone was applied and UV-rays were irradiated, and the dispersant present near the surface of the discharged product (agglomerate, joined product) was selectively decomposed and removed to form toner particles (ozone application, UV-ray irradiation, and joining steps). Then, the toner particles were introduced into a cyclone and then recovered in a recovery portion. Among the ozone supplied in the transport portion, those not yet reacted were introduced together with the toner particles to the cyclone and recovered by way of a bag filter to an ozone recovering device. The thus recovered ozone was reutilized in the ozone applying step as described above. The processing time in the dispersion medium removing step for individual particles (droplet and agglomerate formed from the droplet) (time necessary for the discharged product to pass through the first region) was 12 sec and a processing time for ozone application, UV-ray irradiation and joining steps (time necessary for the discharged product to pass through the second region) was 0.5 min. The water content of the obtained toner particles was 3 wt %. The water content was measured by a Karl-Fischer Method.

Then, the obtained toner particles were applied with aeration at 50° C. for 1 hour to lower the water content of the toner particles.

The toner particles obtained as described above had a water content of 0.3 wt %, an average circularity R of 0.98, and a standard deviation of the circularity of 0.011. The average grain size Dt on the weight base was 6.8 μm. The standard deviation of the grain size on the weight base was 0.4 μm. The circularity was measured in an aqueous dispersion system by using a flow type particle image analyzer (FPIA-2000, manufactured by Toa Medical Electronics Co.). Circularity R was represented by the following formula (I):

$$R=L_0/L_1 \quad \text{(I)}$$

in which $L_1$ [μm] represents the peripheral length of a projected image of a particle as a target for the measurement, and $L_0$ [μm] represents the peripheral length of a true circle having an area equal with that of the projected image of the particle as a target of measurement).

Example 2

A toner was prepared in the same manner as in Example 1 except for using a UV-ray irradiating device (UV-lamp) having a peak wavelength λ for emitted UV-ray of 250 nm.

Example 3

A toner was prepared in the same manner as in Example 1 except for using a UV-ray irradiating device (UV-lamp) having a peak wavelength λ for emitted UV-ray of 400 nm.

Example 4

A toner was prepared in the same manner as in Example 1 except for using a UV-ray irradiating device (UV-lamp) having a peak wavelength λ for emitted UV-ray of 180 nm.

Examples 5 to 7

A toner was prepared in the same manner as in Example 1 except for changing the processing time in the ozone application, UV-irradiation and joining steps (exposure time of the discharged product to the ozone-containing atmosphere, UV-ray irradiation time) as shown in Table 1 by changing the length of the transport portion (second region) and changing the density of ozone in the second region as shown in Table 1 by controlling the amount of ozone supplied from the ozone supplying device, etc.

Example 8

A toner was prepared in the same manner as in Example 7 except for repeating emission and interruption of UV-rays from the UV-ray irradiating device (UV-lamp) at 20 sec interval.

Example 9

A toner was prepared in the same manner as in Example 1 except for using a polyethylene glycol (manufactured by Wako Pure Chemicals Industries Ltd., average polymerization degree: n=10 to 50) instead of sodium polyacrylate in the preparation of the aqueous solution.

Example 10

A toner was prepared in the same manner as in Example 1 except for not using Bontron E-84 as the charge controller in the preparation of the binder resin solution (liquid resin).

Example 11

At first, 200 parts by weight of a styrene-acrylate ester copolymer (glass transition point Tg: 60° C., KOKA type flow tester softening temperature: 115° C., melting point: 210° C.) as a binder resin, 12 parts by weight of a phthalocyanine pigment (phthalocyanine blue, manufactured by Dainichiseika Color & Chemicals Mfg. Co., Ltd.) as a colorant and 3 parts by weight of Bontron E-84 (manufactured by Orient Chemical Industries, Ltd.) as a charge controller were added to 800 parts by weight of toluene (manufactured by Wako Pure Chemicals Industries Ltd.) and mixed at 75° C. Then, they were further mixed in a ball mill to prepare a binder resin solution (resin liquid).

On the other hand, a water solution (aqueous solution) formed by dissolving 30 parts by weight of sodium polyacrylate (manufactured by Wako Pure Chemicals Industries Ltd., average polymerization degree: n=2700 to 7500), and 0.5 parts by weight of a sodium alkyl diphenyl ether disulfonate in 800 parts by weight of ion exchanged water was prepared.

Then, 830.5 parts by weight of the aqueous solution was charged in a 3 liter volume round bottomed stainless steel vessel, and 1015 parts by weight of the binder resin solution described above were gradually dropped for 10 min while stirring at a number of rotation of 4000 rpm by using a TK homomixer (manufactured by Tokushu Kikakogyo Co., Ltd.), to obtain an emulsion. The liquid temperature was kept at 75° C.

Then, toluene in the emulsion (dispersoid) was removed (solvent removal) under the condition at a temperature of 45° C. and at an atmospheric pressure of 10 to 20 kPa and then it was cooled to a room temperature and, further, ion exchanged water was added to obtain a liquid suspension of the binder resin in which solid dispersoid was dispersed (liquid dispersion).

Then, deaeration was applied to the obtained liquid suspension of the binder resin (liquid dispersion). Deaeration was conducted by placing the liquid suspension of the binder resin in a stirred state (liquid dispersion) in an atmosphere at 14 kPa for 10 min. The atmospheric temperature during deaeration was 25° C. The concentration of the solid content (dispersoid) in the obtained liquid suspension of the binder resin (liquid dispersion) was 13 wt %. The viscosity of the liquid suspension of the binder resin (liquid dispersion) at 25° C. was 205 cps. The average grain size Dm of the dispersoid constituting the liquid suspension of the binder resin was 0.5 μm.

A toner was prepared in the same manner as in Example 1 except for using the liquid dispersion (liquid suspension of the binder resin) obtained as described above as a discharged liquid.

Example 12

A toner was prepared in the same manner as in Example 11 except for using, as a UV-ray irradiating device (UV-lamp), those having a peak wavelength λ for emitted UV-ray of 350 nm.

Example 13

A toner was prepared in the same manner as in Example 11 except for using, as a UV-ray irradiating device (UV-lamp), those having a peak wavelength λ for emitted UV-ray of 170 nm.

Examples 14 to 16

A toner was prepared in the same manner as in Example 11 except for changing the processing time of the ozone application, UV-irradiation and joining steps (exposure time of the discharged product to the ozone-containing atmosphere, UV-ray irradiation time) as shown in Table 1 by changing the length of the transport portion (second region) and changing the ozone density in the second region as shown in Table 1 by controlling the amount of ozone supplied from the ozone supplying device, etc.

Example 17

A toner was prepared in the same manner as in Example 16 except for repeating emission and interruption of UV-rays from the UV-ray irradiating device (UV-lamp) at 20 sec interval.

Example 18

A toner was prepared in the same manner as in Example 11 except for using a polyethylene glycol (manufactured by Wako Pure Chemicals Industries Ltd., average polymerization degree: n=10 to 50) instead of the sodium polyacrylate in the preparation of the aqueous solution.

Example 19

A toner was prepared in the same manner as in Example 11 except for not using Bontron E-84 as a charge controller in the preparation of the binder resin solution (liquid resin).

Example 20

At first, a liquid suspension of a binder resin applied with deaeration (liquid dispersion) was prepared in the same manner as in Example 1.

The liquid dispersion (liquid suspension of the binder resin) after the deaeration was charged in a liquid dispersion supply portion of a toner manufacturing apparatus as shown in FIG. 2 and FIG. 3. The liquid dispersion in the liquid dispersion supply portion was supplied while being stirred by a stirring device to a liquid dispersion store portion in a head by a metering pump and discharged from a discharge portion to a transport portion. The discharge portion was in a circular form of 25 μm in diameter. A head applied with a hydrophobic treatment near the discharge portion with a fluororesin (polytetrafluoroethylene) coating was used.

The liquid dispersion was discharged in a state of controlling the temperature for the liquid dispersion in the head at 40° C., the number of vibrations of a piezoelectric body at 30 kHz, an initial velocity of the liquid dispersion discharged from the discharge portion to 3 m/sec, and a discharged amount for one drop of the liquid dispersion discharged from the head to 4 μl (grain size Dd: 10 μm, weight: about 4 nm). The liquid dispersion was discharged such that the discharge timing of the liquid dispersion was displaced at least between adjacent heads among a plurality of heads.

Further, upon discharging the liquid dispersion, air at a temperature of 40° C. and a humidity of 27% RH, and at a flow rate of 3 m/sec was vertically jetted from a gas jetting port downward. The temperature in the housing (atmospheric temperature) was set such that the first region as a region on the side near the discharge portion was at 35 to 40° C. and a second region as a region near the recovery portion was at 70 to 75° C. The pressure in the housing was about 101 kPa. The length of the first region (length in the transporting direction) was 5 m and the length of the second region (length in the transporting direction) was 2 m. A portion of the inner wall surface of the housing corresponding to the second region was formed of titanium oxide and other portions than described above were formed of a benzophenone derivative (UV-ray absorbent material). The inner diameter of the housing (inner diameter for portions excluding the diameter reduced portion) was 50 cm.

Further, in the first region, UV-ray was emitted from the UV-ray irradiating device (UV-lamp) to irradiate UV-rays to the discharged product (refer to FIG. 3). The peak wavelength of the UV-rays emitted from the UV-lamp was 300 nm. The lamp power of the UV-lamp was 0.5 kW. The UV-ray irradiation time to each discharged product (processing time) was 0.5 min.

On the other hand, a gas mixture of ozone and nitrogen was jetted from a jetting port of an ozone applying device in a direction substantially opposite to the transporting direction of the liquid dispersion (discharged product) to supply ozone in the second region (refer to FIG. 3). The mixed gas (ozone) was jetted while controlling the ozone density in the second region to 10 ppm based on the result of detection by an ozone density sensor. The exposure time of each discharged product to ozone (processing time) was 0.5 min.

As a result, the liquid dispersion in the liquid droplet form discharged into the transport portion was removed with the dispersion medium, irradiated with UV-rays and formed into an agglomerate in which a plurality of dispersoids were agglomerated in the first region (dispersion medium removal, UV-ray irradiation step). Then, the agglomerate was successively transported to the second region in which a plurality of dispersoids constituting the agglomerate were joined and ozone was applied to form toner particles removed with the dispersant (joining, ozone application step). Then, the toner particles were introduced into a cyclone and then recovered in a recovery portion. Among the ozone supplied into the transport portion, those not yet reacted (residual amount) was introduced together with the toner particles to the cyclone and then recovered by way of a bag filter to an ozone recovering device. Further, the processing time in the dispersion medium removal and UV-ray irradiation step for individual particles (liquid droplets and agglomerate formed from the liquid droplets) (time required for the discharged product to pass through the first region) was 0.5 min, the processing time for joining and ozone application steps (time required for discharged product to pass through the second region) was 0.5 min. The water content in the obtained toner particle was 3 wt %. The water content was measured by a Karl-Fischer method.

The obtained toner particles was applied with aeration at 50° C. for one hour to lower the water content in the toner particle.

The toner particle obtained as described above had a water content of 0.3 wt %, an average circularity R of 0.95, a standard deviation of circularity of 0.011. The average grain size Dt on the weight base was 6.8 μm. The standard deviation of grain size on the weight base was 0.50 μm.

Example 21

A toner was prepared in the same manner as in Example 20 except for using, as a UV-ray irradiating device (UV-lamp), those having a peak wavelength λ for emitted UV-ray of 400 nm.

Example 22

A toner was prepared in the same manner as in Example 20 except for using, as a UV-ray irradiating device (UV-lamp), those having a peak wavelength λ for emitted UV-ray of 180 nm.

Examples 23 to 25

A toner was prepared in the same manner as in Example 20 except for changing the processing time for dispersion medium removal, UV-ray irradiation step, joining, ozone application step as shown in Table 2 by changing the length of the transport portion (first region and second region), and changing the ozone density in the second region as shown in Table 2 by controlling the amount of ozone supplied from the ozone supplying device, etc.

Example 26

A toner was prepared in the same manner as in Example 25 except for repeating emission and interruption of UV-rays from the UV-ray irradiating device (UV-lamp) at 20 sec interval.

Example 27

A toner was prepared in the same manner as in Example 20 except for using a polyethylene glycol (manufactured by Wako Pure Chemicals Industries Ltd., average polymerization degree: n=10 to 50) instead of the sodium polyacrylate in the preparation of the aqueous solution.

Example 28

A toner was prepared in the same manner as in Example 20 except for not using Bontron E-84 as the charge controller in the preparation of the binder resin solution (liquid resin)

Example 29

At first, 200 parts by weight of a styrene-acrylate ester copolymer (glass transition point Tg: 60° C., KOKA type flow tester softening temperature: 115° C., melting point: 210° C.) as a binder resin, 12 parts by weight of a phthalocyanine pigment (phthalocyanine blue, manufactured by Dainichiseika Color & Chemicals Mfg. Co., Ltd.) as a colorant, and 3 parts by weight of Bontron E-84 (manufactured by Orient Chemical Industries, Ltd.) as a charge controller were added to 800 parts by weight of toluene (manufactured by Wako Pure Chemicals Industries Ltd.) and mixed at 75° C. Then, they were further mixed in a ball mill to prepare a binder resin solution (resin liquid).

On the other hand, a water solution (aqueous solution) formed by dissolving 30 parts by weight of a sodium polyacrylate (manufactured by Wako Pure Chemicals Industries Ltd., average polymerization degree: n=2700 to 7500), and 0.5 parts by weight of a sodium alkyl diphenyl ether disulfonate in 800 parts by weight of ion exchanged water was prepared.

Then, 830.5 parts by weight of the aqueous solution was charged in a 3 liter volume round bottomed stainless steel vessel, and 1015 parts by weight of the binder resin solution described above was gradually dropped for 10 min while stirring at a number of rotation of 4000 rpm by using a TK homomixer (manufactured by Tokushu Kikakogyo Co., Ltd.), to obtain an emulsion. The liquid temperature was kept at 75° C.

Then, toluene in the emulsion (dispersoid) was removed (solvent removal) under the condition at a temperature of 45° C. and at an atmospheric pressure of 10 to 20 kPa and then it was cooled to a room temperature and, further, ion exchanged water was added to obtain a liquid suspension of the binder resin in which solid dispersoid was dispersed (liquid dispersion).

Then, deaeration was applied to the obtained liquid suspension of the binder resin (liquid dispersion). Deaeration was conducted by placing the liquid suspension of the binder resin in the stirred state (liquid dispersion) in an atmosphere at 14 kPa for 10 min. The atmospheric temperature during the deaeration was 25° C. The concentration of the solid content (dispersoid) in the obtained liquid suspension of the binder resin (liquid dispersion) was 13 wt %. The viscosity of the liquid suspension of the binder resin (liquid dispersion) at 25° C. was 205 cps. The average grain size Dm of the dispersoid constituting the liquid suspension of the binder resin was 0.5 μm.

A toner was prepared in the same manner as in Example 20 except for using the liquid dispersion (liquid suspension of the binder resin) obtained as described above as a discharged liquid.

Example 30

A toner was prepared in the same manner as in Example 29 except for using, as a UV-ray irradiating device (UV-lamp), those having a peak wavelength λ for emitted UV-ray of 400 nm.

Example 31

A toner was prepared in the same manner as in Example 29 except for using, as a UV-ray irradiating device (UV-lamp), those having a peak wavelength λ for emitted UV-ray of 180 nm.

Examples 32 to 34

A toner was prepared in the same manner as in Example 29 except for changing the processing time in the ozone application, UV-irradiation and joining steps (exposure time of the discharged product to the ozone-containing atmosphere, UV-ray irradiation time) as shown in Table 2 by changing the length of the transport portion (second region) and changing the ozone density in the second region as shown in Table 2 by controlling the amount of ozone supplied from the ozone supplying device, etc.

Example 35

A toner was prepared in the same manner as in Example 34 except for repeating emission and interruption of UV-rays from the UV-ray irradiating device (UV-lamp) at 20 sec interval.

Example 36

A toner was prepared in the same manner as in Example 29 except for using a polyethylene glycol (manufactured by Wako Pure Chemicals Industries Ltd., average polymerization degree: n=10 to 50) instead of the sodium polyacrylate in the preparation of an aqueous solution.

Example 37

A toner was prepared in the same manner as in Example 29 except for not using Bontron E-84 as a charge controller in the preparation of the binder resin solution (liquid resin).

Example 38

At first, a liquid suspension of a binder resin applied with deaeration (liquid dispersion) was prepared in the same manner as in Example 1.

The liquid dispersion (liquid suspension of the binder resin) after deaeration was charged in a liquid dispersion supply portion of a toner manufacturing apparatus as shown in FIG. 2 and FIG. 4. The liquid dispersion in the liquid dispersion supply portion was supplied while being stirred by a stirring device to a liquid dispersion store portion in a head by a metering pump and discharged from a discharge portion to a transport portion. The discharge portion was in a cylindrical form of 25 μm in diameter. A head applied with a hydrophobic treatment near the discharge portion with a fluororesin (polytetrafluoroethylene) coating was used.

The liquid dispersion was discharged in a state of controlling the temperature for the liquid dispersion in the head at 40° C., the number of vibrations of a piezoelectric body at 30 kHz, an initial velocity of the liquid dispersion discharged from the discharge portion to 3 m/sec, and a discharged amount for one drop of the liquid dispersion discharged from the head to 4 pl (grain size Dd: 10 μm, weight: about 4 ng). The liquid dispersion was discharged such that the discharge timing of the liquid dispersion was displaced at least between adjacent heads among a plurality of heads.

Further, upon discharging the liquid dispersion, air at a temperature of 40° C., at a humidity of 27% RH, and at a flow rate of 3 m/sec was vertically jetted from a gas jetting port downward. The temperature in the housing (atmospheric temperature) was set such that the first region as a region on the side near the discharge portion was at 35 to 40° C. and a second region as a region near the recovery portion was at 70 to 75° C. The pressure in the housing was about 101 kPa. The length of the first region (length in the transporting direction) was 2 m and the length of the second region (length in the transporting direction) was 3 m. The inner diameter of the housing (inner diameter for portions excluding the diameter reduced portion) was 50 cm.

As a result, the liquid dispersion in the droplet form discharged into the transport portion was removed with the dispersion medium in the first region to form an agglomerate in which a plurality of dispersoids were agglomerated (dispersion medium removing step). Then, the agglomerate was successively transported to the second region, in which a plurality of dispersoids constituting the agglomerate were joined, and a joint body was formed (bonding step). The processing time in the dispersion medium removing step for individual particles (droplets and agglomerate formed from the droplets) (time necessary for discharged product to pass through the first region) was 12 sec and a processing time for joining step (time necessary for the charged product to pass through the second region) was 0.5 min.

Then the joined product formed in the transport portion was introduced to the cyclone and then supplied into the ozone/UV-ray treatment portion.

In the ozone/UV-ray treatment portion, ozone was applied to the joined product while stirring the joined product by a stirring device (propeller) by using the same ozone applying device as used in Example 1 (ozone applying treatment) and UV-rays were irradiated to the joined product by using the same UV-ray irradiating device as used in Example 1 (UV-ray irradiation treatment). The peak wavelength of the UV-rays emitted from the UV-lamp was 300 nm. The lamp power of the UV-lamp was 0.5 Kw. The UV-ray irradiation time to each discharged product (processing time) and the exposure time of each discharged product to ozone (processing time) was 0.5 min. The ozone applying treatment was conducted by jetting a gas mixture containing ozone and nitrogen in accordance with the result of detection by ozone density sensor while controlling the ozone density in the ozone applying treatment portion at 10 ppm. The number of rotation of the stirring device (propeller) was set at 180 rpm. Further, the processing time for the treatment in the ozone/UV-ray treatment portion (ozone application treatment and UV-ray irradiation treatment) was 0.5 min. The irradiation distance (average value) of the UV-rays to the discharged product was 100 mm.

After applying the ozone/UV-ray treatment (ozone applying treatment and UV-ray irradiation treatment) for 2 min, an ozone recovering device was driven in a state of interrupting the supply of ozone and irradiation of UV-rays into the ozone applying treatment portion, ozone in the ozone applying treatment portion was recovered and the atmosphere in the ozone applying treatment portion was replaced with air.

Then, driving of the ozone recovering device was stopped, an injection valve and a transport valve were opened, a gas was sent into the ozone/UV-ray treatment portion from the gas supply device disposed on the side of the injection valve and the gas in the ozone/UV-ray treatment portion was exhausted by an exhausting device disposed on the side of the transport valve thereby generating an air stream (gas stream) from the injection valve to the transport valve and toner particles in the ozone/UV-ray treatment portion were recovered. The water content of the obtained toner particles was 3 wt %. The water content was measured by a Karl Fischer method.

The obtained toner particles were applied with aeration at 50° C. for one hour to lower the water content of the toner particle.

The toner particle obtained as described above had a water content of 0.3 wt %, an average circularity R of 0.97, and a standard deviation of circularity of 0.012. The average grain size Dt on the weight base was 6.6 μm. The standard deviation of grain size on the weight base was 0.6 μm.

Example 39

A toner was prepared in the same manner as in Example 38 except for using, as a UV-ray irradiating device (UV-lamp), those having a peak wavelength λ for emitted UV-ray of 400 nm.

Example 40

A toner was prepared in the same manner as in Example 38 except for using, as a UV-ray irradiating device (UV-lamp), those having a peak wavelength λ for emitted UV-ray of 180 nm.

Examples 41 to 43

A toner was prepared in the same manner as in Example 38 except for changing the processing time for ozone/UV-ray treatment as shown in Table 3, and changing the ozone density in the ozone/UV-ray treatment portion as in Table 3 by controlling the amount of ozone supplied from the ozone supplying device, etc.

Example 44

A toner was prepared in the same manner as in Example 43 except for repeating emission and interruption of UV-rays from the UV-ray irradiating device (UV-lamp) at 20 sec interval.

Example 45

A toner was prepared in the same manner as in Example 38 except for using a polyethylene glycol (manufactured by Wako Pure Chemicals Industries Ltd., average polymerization degree: n=10 to 50) instead of the sodium polyacrylate in the preparation of the aqueous solution.

Example 46

A toner was prepared in the same manner as in Example 38 except for not using Bontron E-84 as the charge controller in the preparation of the binder resin solution (liquid resin).

Example 47

At first, 200 parts by weight of a styrene-acrylate ester copolymer (glass transition point Tg: 60° C., KOKA type flow tester softening temperature: 115° C., melting point: 210° C.) as a binder resin, 12 parts by weight of a phthalocyanine pigment (phthalocyanine blue, manufactured by Dainichiseika Color & Chemicals Mfg. Co., Ltd.) as a colorant, and 3 parts by weight of Bontron E-84 (manufactured by Orient Chemical Industries, Ltd.) as a charge controller were added to 800 parts by weight of toluene (manufactured by Wako Pure Chemicals Industries Ltd.) and mixed at 75° C. Then, they were further mixed in a ball mill to prepare a binder resin solution (resin liquid).

On the other hand, a water solution (aqueous solution) formed by dissolving 30 parts by weight of a sodium polyacrylate (manufactured by Wako Pure Chemicals Industries Ltd., average polymerization degree: n=2700 to 7500), and 0.5 parts by weight of a sodium alkyl diphenyl ether disulfonate in 800 parts by weight of ion exchanged water was prepared.

Then, 830.5 parts by weight of the aqueous solution was charged in a 3 liter volume round bottomed stainless steel vessel, and 1015 parts by weight of the binder resin solution described above was gradually dropped for 10 min while stirring at a number of rotation of 4000 rpm by using a TK homomixer (manufactured by Tokushu Kikakogyo Co., Ltd.), to obtain an emulsion. The liquid temperature was kept at 75° C.

Then, toluene in the emulsion (dispersoid) was removed (solvent removal) under the condition at a temperature of 45° C. and at an atmospheric pressure of 10 to 20 kPa, then it was cooled to a room temperature and, further, ion exchanged water was added to obtain a liquid suspension of the binder resin in which solid dispersoid was dispersed (liquid dispersion).

Then, deaeration was applied to the obtained liquid suspension of the binder resin (liquid dispersion). Deaeration was conducted by placing the liquid suspension of the binder resin in the stirred state (liquid dispersion) in an atmosphere at 14 kPa for 10 min. The atmospheric temperature during the deaeration was 25° C. The concentration of the solid content (dispersoid) in the obtained liquid suspension of the binder resin (liquid dispersion) was 13 wt %. The viscosity of the liquid suspension of the binder resin (liquid dispersion) at 25° C. was 205 cps. The average grain size Dm of the dispersoid constituting the liquid suspension of the binder resin was 0.5 μm.

A toner was prepared in the same manner as in Example 38 except for using the liquid dispersion (liquid suspension of the binder resin) obtained as described above as a discharged liquid.

Example 48

A toner was prepared in the same manner as in Example 47 except for using, as a UV-ray irradiating device (UV-lamp), those having a peak wavelength λ for emitted UV-ray at 400 nm.

Example 49

A toner was prepared in the same manner as in Example 47 except for using, as a UV-ray irradiating device (UV-lamp), those having a peak wavelength λ for emitted UV-ray at 180 nm.

Examples 50 to 52

A toner was prepared in the same manner as in Example 47 except for changing the processing time in the ozone application, UV-irradiation, joining steps (exposure time of the discharged product to the ozone-containing atmosphere, UV-ray irradiation time) as shown in Table 3 by changing the length of the transport portion (second region) and changing the ozone density in the second region as shown in Table 3 by controlling the amount of ozone supplied from the ozone supplying device, etc.

Example 53

A toner was prepared in the same manner as in Example 52 except for repeating emission and interruption of UV-rays from the UV-ray irradiating device (UV-lamp) at 20 sec interval.

Example 54

A toner was prepared in the same manner as in Example 47 except for using a polyethylene glycol (manufactured by Wako Pure Chemicals Industries Ltd., average polymerization degree: n=10 to 50) instead of sodium polyacrylate in the preparation of the aqueous solution.

Example 55

A toner was prepared in the same manner as in Example 47 except for not using Bontron E-84 as a charge controller in the preparation of the binder resin solution (liquid resin).

Comparative Example 1

A toner was prepared in the same manner as in Example 1 except for using a toner manufacturing apparatus having the same constitution as that in the toner manufacturing apparatus used in Example 1 except for not having the ozone applying device and the UV-ray irradiating device.

Comparative Example 2

A toner was prepared in the same manner as in Example 1 except for using a toner manufacturing apparatus having the same constitution as that in the toner manufacturing apparatus used in Example 1 except for not having the ozone applying device.

Comparative Example 3

A toner was prepared in the same manner as in Example 1 except for using a toner manufacturing apparatus having the same constitution as that in the toner manufacturing apparatus used in Example 1 except for not having the UV-ray irradiating device.

Comparative Example 4

A toner was prepared in the same manner as in Comparative Example 1 except for using the product prepared in Example 9 as a liquid dispersion (liquid suspension of binder resin).

Comparative Example 5

A toner was prepared in the same manner as in Comparative Example 1 except for using the product prepared in Example 11 as a liquid dispersion (liquid suspension of binder resin).

Comparative Example 6

A toner was prepared in the same manner as in Example 20 except for using a toner manufacturing apparatus having the same constitution as that in the toner manufacturing apparatus used in Example 20 except for not having the ozone applying device.

Comparative Example 7

A toner was prepared in the same manner as in Comparative Example 6 except for using the product prepared in Example 27 as a liquid dispersion (liquid suspension of binder resin).

Comparative Example 8

A toner was prepared in the same manner as in Comparative Example 6 except for using the product prepared in Example 29 as a liquid dispersion (liquid suspension of binder resin).

Comparative Example 9

A toner was prepared in the same manner as in Example 38 except for using a toner manufacturing apparatus having the same constitution as that in the toner manufacturing apparatus used in Example 38 except for not having the ozone applying device and the UV-ray irradiating device.

Comparative Example 10

A toner was prepared in the same manner as in Example 38 except for using a toner manufacturing apparatus having the same constitution as that in the toner manufacturing apparatus used in Example 38 except for not having the ozone applying device.

Comparative Example 11

A toner was prepared in the same manner as in Example 38 except for using a toner manufacturing apparatus having the same constitution as that in the toner manufacturing apparatus used in Example 38 except for not having the UV-ray irradiating device.

Comparative Example 12

When preparation of a toner was tried in the same manner as in Comparative Example 1 except for using the binder resin solution (resin liquid) prepared in Example 11 as it was as the discharge liquid for preparing the toner, the resin liquid could not be discharged. That is, the toner could not be prepared in Comparative Example 12.

Comparative Example 13

The toner obtained in Comparative Example 1 was applied with cleaning (water washing) by ion exchanged water and then dried to form a final toner.

Cleaning with the ion exchange water and drying were conducted as below.

At first, for cleaning with ion exchanged water, 100 parts by weight of ion exchanged water was added to one part by weight of the toner and they were rotated at a number of rotation of 4000 rpm for one min. Then, the cleaning water was removed by filtration under a reduced pressure. Such a series of procedures (application of cleaning water, rotation, removal of cleaning water) were repeated twice.

After completing the cleaning by the procedures described above, a drying treatment was conducted until the water content was reduced to 0.7 wt % or less by using a vacuum drier by keeping at a pressure reduction of 2 torr, at 40° C. for 5 hours.

The cleaning and drying described above required about 6 hours.

Comparative Example 14

A discharging liquid (liquid suspension of binder resin) was prepared in the same manner as in Example 1 except for not using the sodium polyacrylate and the sodium alkyl diphenyl ether disulfonate. While the liquid could marginally keep the state in which the dispersoid was dispersed in the dispersion medium in a state being stirred by a relatively intense stirring force, solid particles corresponding to the dispersoid floated near the liquid surface once the stirring was stopped, failing to maintain the dispersed state. Further, when it was attempted to discharge the liquid by using the toner manufacturing apparatus used in Example 1, only the water corresponding to the dispersion medium was discharged at the initial stage but solid particles corresponding to the dispersoid were not discharged. As the liquid was discharged continuously, the discharge portion suffered from clogging by solid particles corresponding to the dispersoid suspended near the surface of the liquid making the discharge of the liquid impossible. That is, the toner could not be prepared in Comparative Example 14.

For the toner particles obtained in Examples 1 to 55, the surface shape was observed by using a scanning type electron microscope (SEM). For the toner particles in Examples 1 to 55, it was confirmed that relatively large irregularity was not observed on the surface and the particle was substantially in a spherical shape. On the other hand, for the toner particles of Comparative Example 12, it was confirmed that the particle had relatively large irregularity and the shape varied greatly between each of the particles (toner particles).

For each of the examples and the comparative examples, toner preparation conditions are shown in Table 1, Table 2, Table 3 and Table 4. Tables 1 to 4 show the polyester resin as PES, styrene-acrylate ester copolymer as St-Ac, sodium polyacrylate as A, sodium alkyl diphenyl ether sulfonate as B, polyethylene glycol as C, and charge controlling agent as CCA each in the abbreviation form.

TABLE 1

| | Ozone | | | UV-ray | | | | Material | | |
|---|---|---|---|---|---|---|---|---|---|---|
| | Applied region | Density [ppm] | Processing time [min] | Irradiated region | Peak wavelength [nm] | Irradiation time [min] | Irradiation pattern | Resin material | Dispersant | CCA |
| Example 1 | Second region | 10 | 0.5 | Second region | 300 | 0.5 | Continuous | PES | A, B | contained |
| Example 2 | Second region | 10 | 0.5 | Second region | 350 | 0.5 | Continuous | PES | A, B | contained |
| Example 3 | Second region | 10 | 0.5 | Second region | 400 | 0.5 | Continuous | PES | A, B | contained |
| Example 4 | Second region | 10 | 0.5 | Second region | 200 | 0.5 | Continuous | PES | A, B | contained |
| Example 5 | Second region | 150 | 0.5 | Second region | 300 | 0.5 | Continuous | PES | A, B | contained |

TABLE 1-continued

| | Ozone | | | UV-ray | | | | Material | | |
|---|---|---|---|---|---|---|---|---|---|---|
| | Applied region | Density [ppm] | Processing time [min] | Irradiated region | Peak wavelength [nm] | Irradiation time [min] | Irradiation pattern | Resin material | Dis-per-sant | CCA |
| Example 6 | Second region | 120 | 2 | Second region | 300 | 2 | Continuous | PES | A, B | contained |
| Example 7 | Second region | 10 | 4 | Second region | 300 | 4 | Continuous | PES | A, B | contained |
| Example 8 | Second region | 10 | 4 | Second region | 300 | 4 | Intermittent | PES | A, B | contained |
| Example 9 | Second region | 10 | 0.5 | Second region | 300 | 0.5 | Continuous | PES | C, B | contained |
| Example 10 | Second region | 10 | 0.5 | Second region | 300 | 0.5 | Continuous | PES | A, B | not contained |
| Example 11 | Second region | 10 | 0.5 | Second region | 300 | 0.5 | Continuous | St-Ac | A, B | contained |
| Example 12 | Second region | 10 | 0.5 | Second region | 400 | 0.5 | Continuous | St-Ac | A, B | contained |
| Example 13 | Second region | 10 | 0.5 | Second region | 200 | 0.5 | Continuous | St-Ac | A, B | contained |
| Example 14 | Second region | 150 | 0.5 | Second region | 300 | 0.5 | Continuous | St-Ac | A, B | contained |
| Example 15 | Second region | 120 | 2 | Second region | 300 | 2 | Continuous | St-Ac | A, B | contained |
| Example 16 | Second region | 10 | 4 | Second region | 300 | 4 | Continuous | St-Ac | A, B | contained |
| Example 17 | Second region | 10 | 4 | Second region | 300 | 4 | Intermittent | St-Ac | A, B | contained |
| Example 18 | Second region | 10 | 0.5 | Second region | 300 | 0.5 | Continuous | St-Ac | C, B | contained |

TABLE 2

| | Ozone | | | UV-ray | | | | Material | | |
|---|---|---|---|---|---|---|---|---|---|---|
| | Applied region | Density [ppm] | Processing time [min] | Irradiated region | Peak wavelength [nm] | Irradiation time [min] | Irradiation pattern | Resin material | Dispersant | CCA |
| Example 19 | Second region | 10 | 0.5 | Second region | 300 | 0.5 | Continuous | St-Ac | A, B | not contained |
| Example 20 | Second region | 10 | 0.5 | First region | 300 | 0.5 | Continuous | PES | A, B | contained |
| Example 21 | Second region | 10 | 0.5 | First region | 400 | 0.5 | Continuous | PES | A, B | contained |
| Example 22 | Second region | 10 | 0.5 | First region | 200 | 0.5 | Continuous | PES | A, B | contained |
| Example 23 | Second region | 120 | 0.5 | First region | 300 | 0.5 | Continuous | PES | A, B | contained |
| Example 24 | Second region | 120 | 12 | First region | 300 | 2 | Continuous | PES | A, B | contained |
| Example 25 | Second region | 10 | 78 | First region | 300 | 8 | Continuous | PES | A, B | contained |
| Example 26 | Second region | 10 | 78 | First region | 300 | 8 | Intermittent | PES | A, B | contained |
| Example 27 | Second region | 10 | 0.5 | First region | 300 | 0.5 | Continuous | PES | C, B | contained |
| Example 28 | Second region | 10 | 0.5 | First region | 300 | 0.5 | Continuous | PES | A, B | not contained |
| Example 29 | Second region | 10 | 0.5 | First region | 300 | 0.5 | Continuous | St-Ac | A, B | contained |
| Example 30 | Second region | 10 | 0.5 | First region | 400 | 0.5 | Continuous | St-Ac | A, B | contained |
| Example 31 | Second region | 10 | 0.5 | First region | 200 | 0.5 | Continuous | St-Ac | A, B | contained |
| Example 32 | Second region | 150 | 0.5 | First region | 300 | 0.5 | Continuous | St-Ac | A, B | contained |
| Example 33 | Second region | 120 | 12 | First region | 300 | 2 | Continuous | St-Ac | A, B | contained |
| Example 34 | Second region | 10 | 8 | First region | 300 | 8 | Continuous | St-Ac | A, B | contained |
| Example 35 | Second region | 10 | 8 | First region | 300 | 8 | Intermittent | St-Ac | A, B | contained |
| Example 36 | Second region | 10 | 0.5 | First region | 300 | 0.5 | Continuous | St-Ac | C, B | contained |

TABLE 3

| | Ozone | | | UV-ray | | | | Material | | |
|---|---|---|---|---|---|---|---|---|---|---|
| | Applied region | Density [ppm] | Processing time [min] | Irradiated region | Peak wavelength [nm] | Irradiation time [min] | Irradiation pattern | Resin material | Dispersant | CCA |
| Example 37 | Second region | 10 | 0.5 | First region | 300 | 0.5 | Continuous | St-Ac | A, B | not contained |
| Example 38 | Ozone/UV-irradiation area | 10 | 0.5 | Ozone/UV-irradiation area | 300 | 0.5 | Continuous | PES | A, B | contained |
| Example 39 | Ozone/UV-irradiation area | 10 | 0.5 | Ozone/UV-irradiation area | 400 | 0.5 | Continuous | PES | A, B | contained |
| Example 40 | Ozone/UV-irradiation area | 10 | 0.5 | Ozone/UV-irradiation area | 200 | 0.5 | Continuous | PES | A, B | contained |
| Example 41 | Ozone/UV-irradiation area | 150 | 0.5 | Ozone/UV-irradiation area | 300 | 0.5 | Continuous | PES | A, B | contained |
| Example 42 | Ozone/UV-irradiation area | 120 | 2 | Ozone/UV-irradiation area | 300 | 2 | Continuous | PES | A, B | contained |
| Example 43 | Ozone/UV-irradiation area | 10 | 4 | Ozone/UV-irradiation area | 300 | 4 | Continuous | PES | A, B | contained |
| Example 44 | Ozone/UV-irradiation area | 10 | 4 | Ozone/UV-irradiation area | 300 | 4 | Intermittent | PES | A, B | contained |

TABLE 3-continued

| | Ozone | | | UV-ray | | | | Material | | |
|---|---|---|---|---|---|---|---|---|---|---|
| | Applied region | Density [ppm] | Processing time [min] | Irradiated region | Peak wavelength [nm] | Irradiation time [min] | Irradiation pattern | Resin material | Dispersant | CCA |
| Example 45 | Ozone/UV-irradiation area | 10 | 0.5 | Ozone/UV-irradiation area | 300 | 0.5 | Continuous | PES | C, B | contained |
| Example 46 | Ozone/UV-irradiation area | 10 | 0.5 | Ozone/UV-irradiation area | 300 | 0.5 | Continuous | PES | A, B | not contained |
| Example 47 | Ozone/UV-irradiation area | 10 | 0.5 | Ozone/UV-irradiation area | 300 | 0.5 | Continuous | St-Ac | A, B | contained |
| Example 48 | Ozone/UV-irradiation area | 10 | 0.5 | Ozone/UV-irradiation area | 400 | 0.5 | Continuous | St-Ac | A, B | contained |
| Example 49 | Ozone/UV-irradiation area | 10 | 0.5 | Ozone/UV-irradiation area | 200 | 0.5 | Continuous | St-Ac | A, B | contained |
| Example 50 | Ozone/UV-irradiation area | 150 | 0.5 | Ozone/UV-irradiation area | 300 | 0.5 | Continuous | St-Ac | A, B | contained |
| Example 51 | Ozone/UV-irradiation area | 120 | 2 | Ozone/UV-irradiation area | 300 | 2 | Continuous | St-Ac | A, B | contained |
| Example 52 | Ozone/UV-irradiation area | 10 | 4 | Ozone/UV-irradiation area | 300 | 4 | Continuous | St-Ac | A, B | contained |
| Example 53 | Ozone/UV-irradiation area | 10 | 4 | Ozone/UV-irradiation area | 300 | 4 | Intermittent | St-Ac | A, B | contained |
| Example 54 | Ozone/UV-irradiation area | 10 | 0.5 | Ozone/UV-irradiation area | 300 | 0.5 | continuous | St-Ac | C, B | contained |

TABLE 4

| | Ozone | | | UV-ray | | | | Material | | |
|---|---|---|---|---|---|---|---|---|---|---|
| | Applied region | Density [ppm] | Processing time [min] | Irradiated region | Peak wavelength [nm] | Irradiation time [min] | Irradiation pattern | Resin material | Dispersant | CCA |
| Example 55 | Ozone/UV-irradiation area | 10 | 0.5 | Ozone/UV-irradiation area | 300 | 0.5 | Continuous | St-Ac | A, B | not contained |
| Comp. Example 1 | — | — | — | — | — | — | — | PES | A, B | contained |
| Comp. Example 2 | — | — | — | Second region | 300 | 0.5 | Continuous | PES | A, B | contained |
| Comp. Example 3 | Second region | 10 | 0.5 | — | — | — | — | PES | A, B | contained |
| Comp. Example 4 | — | — | — | — | — | — | — | PES | C, B | contained |
| Comp. Example 5 | — | — | — | — | — | — | — | St-Ac | A, B | contained |
| Comp. Example 6 | — | — | — | First region | 300 | 0.5 | — | PES | A, B | contained |
| Comp. Example 7 | — | — | — | First region | 300 | 0.5 | — | PES | C, B | contained |
| Comp. Example 8 | — | — | — | First region | 300 | 0.5 | — | St-Ac | A, B | contained |
| Comp. Example 9 | — | — | — | — | — | — | — | PES | A, B | contained |
| Comp. Example 10 | — | — | | Ozone/UV-irradiation area | 300 | 0.5 | Continuous | PES | A, B | contained |
| Comp. Example 11 | Ozone/UV-irradiation area | 10 | 0.5 | — | — | — | — | PES | A, B | contained |
| Comp. Example 12 | — | — | — | — | — | — | — | St-Ac | — | contained |
| Comp. Example 13 | — | — | — | — | — | — | — | PES | A, B | contained |
| Comp. Example 14 | — | — | — | — | — | — | — | PES | — | contained |

2 Evaluation

For each of the toners obtained as described above, charging property, storability, durability, and transfer efficiency were evaluated.

2.1 Charging Property

For the toners of each of the examples and each of the comparative examples, charged amount was measured and, further, the standard deviation thereof was determined. The charged amount was measured by using an attraction type small-sized charged amount measuring apparatus (manufactured by Treck Japan Co.) under the conditions at 20° C. and 62% RH.

2.2 Storability (Circumstantial Property)

The toners of each of the examples and each of the comparative examples were placed each by 10 g in a sample bottle and left in a thermostable tank at 50° C., 85% RH for 48 hours. Then presence or absence of coagulation (agglomerate) was confirmed with naked eyes and they were evaluated in accordance with the following 3 stages of criteria.

⊙: Presence of coagulation (agglomeration) was not observed at all

Δ: small coagulation (agglomeration) was slightly observed x: coagulation (agglomeration) was observed distinctly.

2.3 Durability

The toners of each of the examples and each of the comparative examples were set to a developing machine of a color laser printer (LP-2000C, manufactured by Seiko Epson Co.)

Then, the developing machine was rotated continuously so as not to conduct printing. 12 hours after, the developing machine was taken out, the uniformity of a thin toner layer on the developing roller was confirmed with naked eyes and they were evaluated in accordance with the following 4 stages of criteria.

⊙: disturbance was not observed at all in the thin layer

O: disturbance was slightly observed in the thin layer

Δ: some disturbance was observed in the thin layer x: streak disturbance was observed distinctly in the thin layer.

2.4 Transfer Efficiency

Each of the toners obtained as described above was evaluated for the transfer efficiency.

The transfer efficiency was evaluated as described below by using the color laser printer (LP-2000C, manufactured by Seiko Epson Co.) as described below.

A toner on the light sensitive body just after the developing step to the light sensitive body (before transfer) and a toner on the light sensitive body after transfer (after printing) were sampled by using separate tapes and the weights were measured respectively. Assuming the toner weight on the light sensitive body before transfer as $W_b$ [g], and the toner weight on the light sensitive body after transfer as $W_a$ [g], the value obtained as: $(W_b-W_a)\times 100/W_b$ was defined as a transfer efficiency.

The results are shown together with the average circularity R, the standard deviation of circularity, the average grain size Dt on the weight base and the standard deviation of the grain size of the toner particles in Table 5, Table 6, Table 7, and Table 8.

TABLE 5

| | Shape of toner particle | | | | | Evaluation | | | | |
|---|---|---|---|---|---|---|---|---|---|---|
| | | | | | | Charging property | | | | |
| | Average circularity R | Standard deviation of circularity | Average grain size Dt on weight base [μm] | Standard deviation of grain size [μm] | Water content of toner particle [wt %] | Charged amount [μC/g] | Standard deviation of charged amount [μC/g] | Storability | Transfer efficiency (%) | Durability |
| Example 1 | 0.98 | 0.011 | 6.8 | 0.4 | 0.3 | −48.2 | 4.8 | ⊙ | 94.1 | ⊙ |
| Example 2 | 0.93 | 0.015 | 7.0 | 0.5 | 0.5 | −40.1 | 6.2 | ⊙ | 89.1 | ⊙ |
| Example 3 | 0.89 | 0.018 | 7.8 | 0.6 | 0.5 | −39.1 | 5.9 | ⊙ | 85.4 | O |
| Example 4 | 0.86 | 0.026 | 6.6 | 0.6 | 0.9 | −36.7 | 7.8 | O | 83.0 | O |
| Example 5 | 0.81 | 0.054 | 5.3 | 0.8 | 0.4 | −32.0 | 12.2 | O | 69.1 | O |
| Example 6 | 0.81 | 0.038 | 5.1 | 0.8 | 0.6 | −30.2 | 14.9 | O | 65.2 | O |
| Example 7 | 0.85 | 0.031 | 6.2 | 0.9 | 0.7 | −35.9 | 9.6 | O | 78.5 | O |
| Example 8 | 0.81 | 0.025 | 6.0 | 0.7 | 0.5 | −39.4 | 7.3 | ⊙ | 86.7 | ⊙ |
| Example 9 | 0.89 | 0.038 | 6.5 | 0.5 | 0.6 | −34.6 | 6.2 | O | 88.6 | O |
| Example 10 | 0.87 | 0.030 | 6.8 | 0.5 | 0.5 | −30.8 | 9.0 | O | 80.3 | O |
| Example 11 | 0.92 | 0.013 | 6.6 | 0.7 | 0.5 | −45.2 | 4.3 | O | 92.5 | O |
| Example 12 | 0.83 | 0.016 | 6.4 | 0.6 | 0.8 | −39.5 | 6.1 | ⊙ | 89.3 | O |
| Example 13 | 0.86 | 0.021 | 7.4 | 0.9 | 0.6 | −38.8 | 9.0 | ⊙ | 87.6 | ⊙ |
| Example 14 | 0.77 | 0.031 | 6.1 | 1.1 | 1.0 | −33.2 | 14.4 | O | 65.4 | O |
| Example 15 | 0.86 | 0.041 | 5.5 | 1.0 | 0.7 | −35.1 | 12.7 | O | 68.9 | O |
| Example 16 | 0.84 | 0.030 | 6.0 | 0.8 | 0.9 | −32.6 | 11.6 | O | 70.3 | O |
| Example 17 | 0.79 | 0.037 | 6.9 | 0.7 | 0.9 | −39.2 | 9.9 | ⊙ | 85.2 | ⊙ |

TABLE 6

| | Shape of toner particle | | | | | Evaluation | | | | |
|---|---|---|---|---|---|---|---|---|---|---|
| | | | | | | Charging property | | | | |
| | Average circularity R | Standard deviation of circularity | Average grain size Dt on weight base [μm] | Standard deviation of grain size [μm] | Water content of toner particle [wt %] | Charged amount [μC/g] | Standard deviation of charged amount [μC/g] | Storability | Transfer efficiency (%) | Durability |
| Example 18 | 0.87 | 0.019 | 6.1 | 1.1 | 0.7 | −40.2 | 8.2 | ⊙ | 70.6 | ⊙ |
| Example 19 | 0.82 | 0.024 | 6.3 | 0.8 | 0.6 | −34.1 | 9.9 | O | 75.2 | O |
| Example 20 | 0.95 | 0.011 | 6.8 | 0.5 | 0.3 | −41.9 | 6.1 | ⊙ | 92.6 | ⊙ |
| Example 21 | 0.93 | 0.014 | 6.4 | 0.6 | 0.5 | −38.4 | 5.4 | O | 89.0 | ⊙ |
| Example 22 | 0.91 | 0.019 | 6.3 | 0.7 | 0.5 | −36.2 | 6.1 | O | 86.4 | ⊙ |
| Example 23 | 0.90 | 0.017 | 7.4 | 0.9 | 0.6 | −30.4 | 7.1 | O | 88.5 | O |
| Example 24 | 0.90 | 0.013 | 5.5 | 0.7 | 0.4 | −29.6 | 7.6 | O | 79.7 | O |
| Example 25 | 0.82 | 0.012 | 5.8 | 0.6 | 0.6 | −32.9 | 6.9 | O | 80.6 | O |
| Example 26 | 0.83 | 0.017 | 5.8 | 0.8 | 0.8 | −38.6 | 9.0 | ⊙ | 84.6 | O |
| Example 27 | 0.91 | 0.016 | 6.5 | 0.6 | 0.6 | −33.7 | 5.5 | O | 90.1 | O |
| Example 28 | 0.87 | 0.015 | 6.4 | 0.9 | 0.6 | −32.0 | 11.0 | O | 78.7 | O |
| Example 29 | 0.92 | 0.016 | 6.4 | 0.6 | 0.5 | −40.3 | 5.9 | ⊙ | 90.1 | O |
| Example 30 | 0.91 | 0.018 | 6.8 | 0.5 | 0.6 | −37.2 | 6.1 | O | 88.7 | O |
| Example 31 | 0.89 | 0.019 | 6.3 | 0.8 | 0.6 | −36.8 | 6.5 | O | 84.1 | O |
| Example 32 | 0.89 | 0.014 | 5.8 | 0.8 | 0.5 | −38.1 | 6.3 | ⊙ | 85.9 | ⊙ |
| Example 33 | 0.81 | 0.014 | 5.5 | 0.7 | 0.7 | −34.6 | 6.0 | O | 74.6 | O |
| Example 34 | 0.86 | 0.018 | 5.7 | 0.9 | 0.5 | −36.6 | 7.8 | O | 78.6 | O |

TABLE 7

| | Shape of toner particle | | | | | Evaluation | | | | |
|---|---|---|---|---|---|---|---|---|---|---|
| | | | | | | Charging property | | | | |
| | Average circularity R | Standard deviation of circularity | Average grain size Dt on weight base [μm] | Standard deviation of grain size [μm] | Water content of toner particle [wt %] | Charged amount [μC/g] | Standard deviation of charged amount [μC/g] | Storability | Transfer efficiency (%) | Durability |
| Example 35 | 0.91 | 0.016 | 5.3 | 0.6 | 0.6 | −35.8 | 5.5 | ○ | 76.4 | ◎ |
| Example 36 | 0.90 | 0.019 | 6.3 | 0.6 | 0.5 | −37.8 | 6.2 | ○ | 77.0 | ○ |
| Example 37 | 0.86 | 0.026 | 7.0 | 0.8 | 0.5 | −30.4 | 12.4 | ○ | 71.5 | ○ |
| Example 38 | 0.97 | 0.012 | 6.6 | 0.6 | 0.3 | −48.3 | 4.2 | ◎ | 97.6 | ◎ |
| Example 39 | 0.94 | 0.016 | 6.4 | 0.4 | 0.4 | −44.1 | 4.6 | ◎ | 94.4 | ◎ |
| Example 40 | 0.94 | 0.015 | 6.9 | 0.5 | 0.3 | −40.2 | 5.1 | ◎ | 92.2 | ◎ |
| Example 41 | 0.95 | 0.018 | 6.1 | 0.4 | 0.4 | −32.6 | 5.5 | ○ | 92.3 | ○ |
| Example 42 | 0.91 | 0.019 | 5.8 | 0.4 | 0.4 | −36.9 | 8.3 | ◎ | 86.7 | ○ |
| Example 43 | 0.93 | 0.021 | 5.8 | 0.6 | 0.5 | −36.4 | 7.2 | ◎ | 88.2 | ○ |
| Example 44 | 0.92 | 0.022 | 6.3 | 0.5 | 0.4 | −37.8 | 9.1 | ◎ | 85.9 | ◎ |
| Example 45 | 0.92 | 0.020 | 6.8 | 0.4 | 0.3 | −40.9 | 6.7 | ◎ | 94.3 | ◎ |
| Example 46 | 0.94 | 0.019 | 7.0 | 0.4 | 0.3 | −31.1 | 12.5 | ○ | 80.4 | ○ |
| Example 47 | 0.91 | 0.020 | 6.4 | 0.5 | 0.4 | 47.9 | 5.5 | ◎ | 97.4 | ◎ |
| Example 48 | 0.92 | 0.013 | 6.5 | 0.4 | 0.4 | −45.6 | 6.1 | ◎ | 96.3 | ◎ |
| Example 49 | 0.92 | 0.014 | 6.5 | 0.5 | 0.5 | −44.8 | 5.4 | ◎ | 96.7 | ◎ |
| Example 50 | 0.90 | 0.016 | 6.7 | 0.5 | 0.6 | −39.2 | 5.7 | ○ | 88.4 | ◎ |
| Example 51 | 0.91 | 0.016 | 5.9 | 0.8 | 0.4 | −36.4 | 8.1 | ○ | 86.7 | ◎ |

TABLE 8

| | Shape of toner particle | | | | | Evaluation | | | | |
|---|---|---|---|---|---|---|---|---|---|---|
| | | | | | | Charging property | | | | |
| | Average circularity R | Standard deviation of circularity | Average grain size Dt on weight base [μm] | Standard deviation of grain size [μm] | Water content of toner particle [wt %] | Charged amount [μC/g] | Standard deviation of charged amount [μC/g] | Storability | Transfer efficiency (%) | Durability |
| Example 52 | 0.88 | 0.019 | 5.8 | 0.7 | 0.4 | −38.8 | 7.7 | ◎ | 82.5 | ○ |
| Example 53 | 0.86 | 0.018 | 5.8 | 0.4 | 0.6 | −37.2 | 8.1 | ◎ | 84.7 | ○ |
| Example 54 | 0.90 | 0.017 | 6.4 | 0.5 | 0.6 | −44.7 | 6.0 | ◎ | 96.3 | ◎ |
| Example 55 | 0.82 | 0.021 | 7.0 | 0.6 | 0.8 | −31.1 | 13.3 | ○ | 81.7 | ○ |
| Comp. Example 1 | 0.79 | 0.025 | 10.3 | 1.0 | 1.1 | −5.4 | 5.0 | X | 47.4 | X |
| Comp. Example 2 | 0.80 | 0.028 | 8.9 | 0.9 | 0.9 | −15.5 | 4.2 | X | 52.8 | X |
| Comp. Example 3 | 0.80 | 0.026 | 9.1 | 0.7 | 0.8 | −17.2 | 4.1 | X | 55.9 | X |
| Comp. Example 4 | 0.75 | 0.024 | 9.4 | 0.9 | 0.9 | −6.8 | 3.5 | X | 43.2 | X |
| Comp. Example 5 | 0.77 | 0.023 | 8.2 | 0.5 | 0.9 | −8.2 | 6.3 | X | 40.5 | X |
| Comp. Example 6 | 0.81 | 0.019 | 9.7 | 0.9 | 0.7 | −15.4 | 6.1 | X | 57.1 | X |
| Comp. Example 7 | 0.84 | 0.024 | 9.4 | 0.9 | 0.8 | −16.6 | 6.0 | X | 50.5 | X |
| Comp. Example 8 | 0.82 | 0.028 | 10.5 | 0.7 | 1.1 | −12.9 | 5.0 | X | 49.6 | X |
| Comp. Example 9 | 0.79 | 0.023 | 8.5 | 1.1 | 1.0 | −5.1 | 3.1 | X | 39.8 | X |
| Comp. Example 10 | 0.80 | 0.022 | 7.3 | 0.9 | 0.8 | −17.0 | 5.8 | X | 54.1 | X |
| Comp. Example 11 | 0.81 | 0.023 | 7.4 | 0.8 | 1.0 | −12.1 | 6.4 | X | 53.2 | X |
| Comp. Example 13 | 0.75 | 0.025 | 9.4 | 1.2 | 0.9 | −4.1 | 2.2 | X | 40.6 | X |

As apparent from Table 5 to Table 8, each of the toners of the invention (Examples 1 to 55) had a large absolute value of the charged amount and less varied in view of the charged amount. Further, the toner of the invention was excellent also in the storability (circumstantial property). Further, the toner of the invention was also excellent in the characteristics such as the durability and the transfer efficiency. Further, the toner of the invention was less varied for the size and the shape between each of the particles and the reliability for the entire toner was high.

On the contrary, in the toners for each of the comparative examples, no satisfactory results could be obtained.

Particularly, in Comparative Examples 1 to 11, the absolute value for the charged amount of the toner particles was extremely small.

Further, in Comparative Example 13, while the absolute value for the charged amount of the toner particle was relatively large, charged amount varied greatly between each of the particles and the reliability was low as the entire toner. Further, an extremely long time was necessary for the manufacture of the toner to deteriorate the productivity and it caused large burden on the circumstance since a great amount of discharged water was yielded.

Further, when the toner was manufactured and evaluated in the same manner as described above while changing the structure near the head of the toner manufacturing apparatus from the constitution as shown in FIG. 2 to the constitution as shown in FIG. 5 to FIG. 8, same results as described above were obtained. Further, in the toner manufacturing apparatus having the head as shown in FIG. 5 to FIG. 8, even a liquid dispersion of a relatively high viscosity (high content of dispersoid) could be discharged suitably.

What is claimed is:

1. A toner manufacturing apparatus for manufacturing a toner by using a liquid dispersion in which a dispersoid containing a material for manufacturing a toner is dispersed in a dispersion medium, and containing a dispersant improving the dispersibility of the dispersoid, the apparatus including:

a device for applying ozone to at least one of a liquid dispersion and a liquid dispersion from which at least a portion of the dispersion medium has been removed; and a device for irradiating UV-rays to at least one of the liquid dispersion and the liquid dispersion from which at least a portion of the dispersion medium has been removed.

2. A toner manufacturing apparatus according to claim 1, wherein the toner manufacturing apparatus includes a discharge portion for discharging the liquid dispersion as a discharged product in a droplet form, and is adapted to apply the ozone or irradiate with the UV-rays to the discharged product.

* * * * *